US012796773B2

(12) United States Patent
Salari-Sharif et al.

(10) Patent No.: US 12,796,773 B2
(45) Date of Patent: Nov. 17, 2026

(54) SHOE MIDSOLE LATTICE STRUCTURES

(71) Applicant: adidas AG, Herzogenaurach (DE)

(72) Inventors: Ladan Salari-Sharif, Camas, WA (US); Christian Manuel Arias Delgado, Portland, OR (US); Berin B, Portland, OR (US); Yuanjie Li, Portland, OR (US); Zachary Coonrod, Portland, OR (US); Iain Hannah, Portland, OR (US)

(73) Assignee: adidas AG, Herzogenaurach (DE)

( * ) Notice: Subject to any disclaimer, the term of this patent is extended or adjusted under 35 U.S.C. 154(b) by 175 days.

(21) Appl. No.: 18/313,135

(22) Filed: May 5, 2023

(65) Prior Publication Data

US 2024/0365922 A1 Nov. 7, 2024

(51) Int. Cl.
*A43B 13/18* (2006.01)
*A43B 13/12* (2006.01)

(52) U.S. Cl.
CPC ..... *A43B 13/186* (2013.01); *A43B 13/125* (2013.01)

(58) Field of Classification Search
CPC ... A43B 13/186; A43B 13/181; A43B 13/125; A43B 1/0009
See application file for complete search history.

(56) References Cited

U.S. PATENT DOCUMENTS 354,693 A 12/1886 Dick
1,111,437 A 9/1914 Butterfield
2,205,356 A 6/1940 Rose et al.
2,853,809 A 9/1958 Carlo
3,253,601 A 5/1966 Scholl
3,416,174 A 12/1968 Novitske
3,793,750 A 2/1974 Bowerman
4,012,855 A 3/1977 Gardner
(Continued)

FOREIGN PATENT DOCUMENTS

CN 101611953 A 12/2009
CN 102578760 A 7/2012
(Continued)

OTHER PUBLICATIONS

"Adidas Breaks the Mould With 3D-Printed Performance Footwear," Adidas Group, [Retrieved on Oct. 7, 2015], Retrieved from the Internet: ( http://www.adidas-group.com/en/media/news-archive/press-releases/2015/adi-das-breaks-mould-3d-printed-performance-footwear/ ).
(Continued)

*Primary Examiner* — Haley A Smith
(74) *Attorney, Agent, or Firm* — Sterne, Kessler, Goldstein & Fox P.L.L.C.

(57) ABSTRACT

Midsoles for articles of footwear are formed of a variety of three dimensional mesh lattices. The lattices can be populated by unit cells of various base geometries. Some base geometries are structures of struts and nodes that approximate the overall shape of an implicit surface. Some base geometries are structures of struts and nodes that include struts having at least two different effective diameters. Some lattices are compound lattices that include and blend together at least two lattices populated by cells having different base geometries. Some compound lattices have a skin that includes beams extending across multiple cells at the exterior of the compound lattice.

24 Claims, 38 Drawing Sheets

(56) References Cited

U.S. PATENT DOCUMENTS 4,271,606 A 6/1981 Rudy
4,297,796 A 11/1981 Stirtz et al.
4,309,831 A 1/1982 Pritt
4,378,643 A 4/1983 Johnson
4,439,936 A 4/1984 Clarke et al.
4,607,440 A 8/1986 Roberts et al.
4,774,774 A 10/1988 Allen, Jr.
5,236,637 A 8/1993 Hull
5,337,492 A 8/1994 Anderie et al.
5,367,791 A 11/1994 Gross et al.
5,391,072 A 2/1995 Lawton et al.
5,423,135 A 6/1995 Poole et al.
5,529,473 A 6/1996 Lawton et al.
5,799,417 A 9/1998 Burke et al.
5,862,614 A 1/1999 Koh
5,930,916 A 8/1999 Connor
5,983,529 A 11/1999 Serna
5,985,383 A 11/1999 Allen et al.
6,014,821 A 1/2000 Yaw
6,021,588 A 2/2000 Alviso
6,076,283 A 6/2000 Boie
6,259,962 B1 7/2001 Gothait
6,367,172 B2 4/2002 Hernandez
6,665,958 B2 12/2003 Goodwin
6,763,611 B1 7/2004 Fusco
7,383,647 B2 6/2008 Chan et al.
7,438,846 B2 10/2008 John
7,676,955 B2 3/2010 Dojan et al.
7,704,430 B2 4/2010 Johnson et al.
7,892,474 B2 2/2011 Shkolnik et al.
8,110,135 B2 2/2012 El-Siblani
8,191,284 B2 6/2012 Cho
8,522,454 B2 9/2013 Schindler et al.
8,739,639 B2 6/2014 Owings et al.
8,776,396 B2 7/2014 Huynh
9,205,601 B2 12/2015 DeSimone et al.
9,211,678 B2 12/2015 DeSimone et al.
9,216,546 B2 12/2015 DeSimone et al.
9,320,316 B2 4/2016 Guyan et al.
9,453,142 B2 9/2016 Rolland et al.
D789,060 S 6/2017 Guyan et al.
D809,752 S 2/2018 Campbell
9,930,929 B2 4/2018 Cooper et al.
10,010,133 B2 7/2018 Guyan
10,010,134 B2 7/2018 Guyan
10,016,013 B2 7/2018 Kormann et al.
10,034,516 B2 7/2018 Gheorghian et al.
10,039,343 B2 8/2018 Guyan
D829,425 S 10/2018 Albrecht et al.
D831,315 S 10/2018 Mahoney
10,104,934 B2 10/2018 Guyan
D841,300 S 2/2019 Albrecht et al.
D841,301 S 2/2019 Albrecht et al.
10,231,511 B2 3/2019 Guyan et al.
10,259,171 B2 4/2019 Robeson et al.
D847,481 S 5/2019 Albrecht et al.
D857,362 S 8/2019 Thompson
D859,801 S 9/2019 Jenkins et al.
D862,051 S 10/2019 Goussev et al.
D862,866 S 10/2019 Albrecht et al.
10,426,226 B2 10/2019 Guyan et al.
10,434,706 B2 10/2019 Robeson et al.
D873,546 S 1/2020 Henrichot
D876,056 S 2/2020 Henrichot
D878,016 S 3/2020 Henrichot
D879,428 S 3/2020 Braun et al.
D879,434 S 3/2020 Fick et al.
10,575,588 B2 3/2020 Perrault et al.
D880,120 S 4/2020 Fick et al.
D880,122 S 4/2020 Fick et al.
D880,131 S 4/2020 Fick et al.
D882,227 S 4/2020 Braun et al.
10,639,861 B2 5/2020 Minh et al.
D890,485 S 7/2020 Perrault et al.
D907,904 S 1/2021 Perrault et al.
2002/0078598 A1 6/2002 Bell
2004/0087230 A1 5/2004 Wildeman
2006/0201028 A1 9/2006 Chan et al.
2007/0011914 A1 1/2007 Keen et al.
2007/0043582 A1 2/2007 Peveto et al.
2008/0289218 A1 11/2008 Nakano
2009/0013556 A1 1/2009 Nishiwaki et al.
2009/0126225 A1 5/2009 Jarvis
2009/0139112 A1 6/2009 Garneau
2009/0183392 A1 7/2009 Shane
2009/0293309 A1 12/2009 Keating et al.
2010/0122471 A1 5/2010 Edington et al.
2010/0170106 A1 7/2010 Brewer et al.
2010/0199520 A1 8/2010 Dua et al.
2010/0251565 A1 10/2010 Litchfield et al.
2010/0281714 A1 11/2010 Carboy et al.
2011/0099855 A1 5/2011 Cho
2012/0117825 A9 5/2012 Jarvis
2012/0178259 A1 7/2012 Miyazaki et al.
2012/0180335 A1 7/2012 Mahoney
2012/0186107 A1 7/2012 Crary et al.
2013/0118036 A1 5/2013 Gibson
2013/0145653 A1 6/2013 Bradford
2013/0171019 A1 7/2013 Gessler et al.
2013/0292862 A1 11/2013 Joyce
2013/0295212 A1 11/2013 Chen et al.
2014/0020191 A1 1/2014 Jones et al.
2014/0026773 A1 1/2014 Miller
2014/0029030 A1 1/2014 Miller
2014/0109441 A1 4/2014 McDOWELL et al.
2014/0150297 A1 6/2014 Holmes et al.
2014/0182170 A1 7/2014 Wawrousek et al.
2014/0223783 A1 8/2014 Wardlaw et al.
2014/0226773 A1 8/2014 Toth et al.
2014/0259779 A1 9/2014 Hashish et al.
2014/0259787 A1 9/2014 Guyan et al.
2014/0259788 A1 9/2014 Dojan et al.
2014/0259789 A1 9/2014 Dojan et al.
2014/0299009 A1 10/2014 Miller et al.
2014/0300675 A1 10/2014 Miller et al.
2014/0300676 A1 10/2014 Miller et al.
2014/0310991 A1 10/2014 Greene et al.
2015/0000161 A1 1/2015 Peyton et al.
2015/0033577 A1 2/2015 Dahl et al.
2015/0033579 A1 2/2015 Barnes et al.
2015/0033581 A1 2/2015 Barnes et al.
2015/0089841 A1 4/2015 Smaldone et al.
2015/0128448 A1 5/2015 Lockyer
2015/0181976 A1 7/2015 Cooper et al.
2015/0223560 A1 8/2015 Wawrousek et al.
2015/0245686 A1 9/2015 Cross
2015/0331402 A1 11/2015 Lin et al.
2015/0351493 A1 12/2015 Ashcroft et al.
2015/0360419 A1 12/2015 Willis et al.
2016/0051009 A1* 2/2016 Kormann ..... A43B 1/08 36/103
2016/0122493 A1* 5/2016 Farris ..... B29C 44/3453 521/82
2016/0137839 A1 5/2016 Rolland et al.
2016/0160077 A1 6/2016 Rolland et al.
2016/0180440 A1 6/2016 Dibenedetto et al.
2016/0288376 A1 10/2016 Sun et al.
2016/0295971 A1 10/2016 Arnese et al.
2016/0324260 A1 11/2016 Guyan
2016/0324261 A1 11/2016 Guyan
2016/0325520 A1* 11/2016 Berger ..... F16S 3/08
2016/0360828 A1 12/2016 Guyan
2016/0374428 A1 12/2016 Kormann et al.
2017/0129167 A1 5/2017 Castanon
2017/0129169 A1 5/2017 Batchelder et al.
2017/0150778 A1 6/2017 Youngs et al.
2018/0014606 A1 1/2018 Mokos
2018/0070736 A1 3/2018 Achten et al.
2018/0103719 A1 4/2018 Chen
2018/0126630 A1 5/2018 Panzer et al.
2018/0243976 A1 8/2018 Feller
2018/0271211 A1* 9/2018 Perrault ..... B33Y 50/00
2018/0271213 A1* 9/2018 Perrault ..... A43B 13/141
2018/0290374 A1 10/2018 Willis et al.

(56) References Cited

U.S. PATENT DOCUMENTS

| | | | | |
|---|---|---|---|---|
| 2018/0368518 | A1 | 12/2018 | Re et al. | |
| 2019/0069632 | A1 | 3/2019 | Meschter | |
| 2019/0098960 | A1 | 4/2019 | Weisskopf et al. | |
| 2019/0160733 | A1 | 5/2019 | Mirkin et al. | |
| 2019/0223543 | A1 | 7/2019 | Tamm et al. | |
| 2019/0223551 | A1 | 7/2019 | Hoffer et al. | |
| 2019/0269200 | A1 | 9/2019 | Tseng | |
| 2019/0289960 | A1 | 9/2019 | Loveder | |
| 2020/0093221 | A1 | 3/2020 | Caldwell et al. | |
| 2020/0156308 | A1 | 5/2020 | Ramos et al. | |
| 2020/0329815 | A1 | 10/2020 | Schmid | |
| 2021/0195989 | A1 | 7/2021 | Iwasa et al. | |
| 2021/0195995 | A1 | 7/2021 | Sakamoto et al. | |
| 2022/0104579 | A1* | 4/2022 | Corcoran-Tadd .... | A43B 13/125 |
| 2022/0110406 | A1 | 4/2022 | Salari-Sharif et al. | |
| 2022/0110407 | A1* | 4/2022 | Hettinga ..... | A43B 13/186 |
| 2022/0110408 | A1* | 4/2022 | Coonrod ..... | A43B 13/16 |
| 2022/0142284 | A1* | 5/2022 | Laperriere ..... | A42B 3/06 |
| 2024/0032649 | A1 | 2/2024 | Corcoran-Tadd et al. | |

FOREIGN PATENT DOCUMENTS

| | | | |
|---|---|---|---|
| CN | 203378623 | U | 1/2014 |
| CN | 209391169 | U | 9/2019 |
| CN | 209403686 | U | 9/2019 |
| CN | 110859355 | A | 3/2020 |
| EP | 0526892 | A2 | 2/1993 |
| EP | 2564719 | A1 | 3/2013 |
| EP | 2424398 | B1 | 12/2015 |
| EP | 3013171 | A1 | 5/2016 |
| EP | 3165109 | A1 | 5/2017 |
| EP | 2564714 | B1 | 7/2018 |
| EP | 3939462 | A2 | 1/2022 |
| ES | 2442448 | A1 | 2/2014 |
| ES | 2578730 | A1 | 7/2016 |
| JP | 3192899 | B2 | 7/2001 |
| JP | 2002238609 | A | 8/2002 |
| JP | 2011251190 | A | 12/2011 |
| JP | 2014151201 | A | 8/2014 |
| JP | 3192899 | U | 9/2014 |
| WO | WO-2010126708 | A2 | 11/2010 |
| WO | WO-2014008331 | A2 | 1/2014 |
| WO | WO-2014009587 | A1 | 1/2014 |
| WO | WO-2014015037 | A2 | 1/2014 |
| WO | WO-2014100462 | A1 | 6/2014 |
| WO | WO-2015164234 | A1 | 10/2015 |
| WO | WO-2015169941 | A1 | 11/2015 |
| WO | WO-2015169942 | A1 | 11/2015 |
| WO | WO-2016066750 | A1 | 5/2016 |
| WO | WO-2017210298 | A1 | 12/2017 |
| WO | WO-2021169804 | A1 | 9/2021 |

OTHER PUBLICATIONS

Green, D., Adidas is finally bringing 3D-printed shoes into the mainstream,Business Insider.com, Dennis Green, Retrieved from the Internet: (URL: https://www.businessinsider.com/adidas-releases-futurecraft-4d-shoe-2017-4/ commerce-on-business-insider), (Year: 2017).

Janusziewicz, R., et al., "Layerless Fabrication With Continuous Liquid Interface Production," Proceedings of the National Academy of Sciences of the United States of America 113(42):11703-11708, National Academy of Sciences, United States (Oct. 2016).

Nikolic, I., Reebok Flexagon Training Shoes, Behance.net, Ilija Nikolic, Retrieved from the Internet (URL: https://www.behance.net/gallery/68953047/REEBOK-FLEXAGON-Training-Shoes?t- racking_source=curated_galleries_list) 2018, 10 pages.

Panetta., et al., "Elastic Textures for Additive Fabrication," ACM Transactions on Graphics 34(4), Article No. 135 (Aug. 2015).

Pearson, D., Adidas is giving Olympic athletes its first-ever 3D-printed shoes,Highsnobiety.com, Retrieved from the Internet: (URL: https://www.highsnobiety.com/2016/08/11/adidas-3d-printed-shoes-olympics/ ), (Year: 2016).

Reebok Flexagon, Retrieved from the Internet (URL: https://www.reebok.com/us/reebok-flexagon/CN2583.html ), 2018.

Richard, B., Here's what 3D printed Future Craft adidas Yeezy boosts would look like Yeezys geared up for the future Retrieved from the Internet: (URL: https://solecollector.com/news/2015/11/adidas-yeezy-futurecraft-3d-print ), (Year: 2015).

Tumbleston, J.R., et al., "Continuous Liquid Interface Production of 3d Objects," Science 347(6228):1349-1352, American Association for the Advancement of Science, United States (Mar. 2015).

Worman, C., Top Tennis Shoes Featuring a 6-Month Outsole Warranty, Retrieved from the Internet (URL: https://blogs.tennisexpress.com/blogs/top-tennis-shoes-featuring-a-6-month-outsole-warranty/), (Year: 2018), 11 pages.

* cited by examiner

510

| Sample | Mass [g] | 50% Stiffness | Forward Motion | % Energy Return | Stiffness/Mass |
|---|---|---|---|---|---|
| Implicit Surface Unit Cell | 38.36 | 35.73 | 12.08 | 52.40 | 0.93 |
| Polygon Mesh of an Implicit Surface Unit Cell | 35.31 | 81.67 | 10.10 | 49.94 | 2.31 |

FIG. 6G

SHOE MIDSOLE LATTICE STRUCTURES

FIELD

The described embodiments generally relate to soles for articles of footwear. More particularly, described embodiments relate to soles for articles of footwear including midsoles with various lattice structures that provide desired mechanical and/or aesthetic characteristics to the midsole.

BACKGROUND

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes that provide proper cushioning and support, the soreness and fatigue associated with every day activity is more acute, and its onset may be accelerated. This discomfort for the wearer may diminish the incentive for further activity. Equally important, inadequately cushioned footwear can lead to injuries such as blisters; muscle, tendon, and ligament damage; and bone stress fractures. Improper footwear can also lead to other ailments, including back pain.

Individuals are often concerned with the amount of cushioning an article of footwear provides. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole of an article of footwear functions, in part, to provide cushioning to the wearer's foot and to protect it from these forces.

Proper footwear should be durable, comfortable, and provide other beneficial characteristics for an individual. Therefore, a continuing need exists for innovations in footwear.

BRIEF SUMMARY

A first embodiment (1) of the present application is directed to a midsole for an article of footwear. The midsole can comprise a three-dimensional mesh. The three dimensional mesh can comprise a plurality of interconnected first unit cells. Each interconnected first unit cell can comprise a first base strut geometry. The first base strut geometry can be defined by a first plurality of struts and a first plurality of nodes at which one or more struts are connected. The three dimensional mesh can comprise a plurality of interconnected second unit cells outside of the plurality of interconnected first unit cells. Each interconnected second unit cell can comprise a second base strut geometry different than the first base strut geometry. The second base strut geometry can be defined by a second plurality of struts and a second plurality of nodes at which one or more struts are connected. The three dimensional mesh can comprise a transition region located between the plurality of interconnected first unit cells and the plurality of interconnected second unit cells. The transition region can comprise a third plurality of struts connecting nodes among the first plurality of nodes to nodes among the second plurality of nodes. The transition region can lack any instance of the first base strut geometry or any instance of the second base strut geometry.

In a second embodiment (2) further to embodiment (1), the struts of the first plurality of struts can be aligned on edges of polygons of a polygon mesh of an implicit surface and contact struts of the plurality of struts in at least one neighboring second unit cells.

In a third embodiment (3) further to embodiment (1) or embodiment (2), each second unit cell can comprise an upper-forward quadrant and a lower-rearward quadrant. The upper-forward quadrant and the lower-rearward quadrant can each contain thin struts and thick struts among the second plurality of struts and nodes among the second plurality of nodes. Each second unit cell can also comprise an upper-rearward quadrant and a lower-forward quadrant. The upper-rearward quadrant and the lower-forward quadrant can each contain thin struts and thick struts among the second plurality of struts and nodes among the second plurality of nodes. The thick struts and thin struts in the upper-forward and lower-rearward quadrants can be arranged differently than in the upper-rearward and lower-forward quadrants.

In a fourth embodiment (4) further to any of embodiments (1)-(3), the plurality of interconnected first unit cells can surround the plurality of interconnected second unit cells on at least one plane.

In a fifth embodiment (5) further to any of embodiments (1)-(4), the transition region can comprise a plurality of third unit cells. Each third unit cell can comprise a first side and a second side. The first side can be adjoined by one of the first unit cells and the second side can be adjoined by one of the second unit cells. Each third unit cell can comprise a first segment that comprises the first side and is identical in structure to a segment of the adjoining first unit cell. Each third unit cell can comprise a second segment that comprises the second side and is identical in structure to a segment of the adjoining second unit cell and is different in structure than the first segment.

In a sixth embodiment (6) further to embodiment (5), each third unit cell can comprise a third segment that is located between the first segment and the second segment. The third segment can comprise every part of the third unit cell other than the first segment and second segment. The third segment can be non-identical to any portion of the first base strut geometry having equal volume to the third segment or the second base strut geometry having equal volume to the third segment.

In a seventh embodiment (7) further to embodiment (5) or embodiment (6), the first segment and second segment each be a respective quarter of the third unit cell.

In an eighth embodiment (8) further to any of embodiments (5)-(7), the third segment can comprise a third plurality of nodes. Each node of the third plurality of nodes can be located at a position within the third unit cell that is a mean average of a position of a node of the first plurality of nodes within the first unit cell and a position of a node of the second plurality of nodes within the second unit cell.

A ninth embodiment (9) of the present application is directed to a midsole for an article of footwear. The midsole can comprise a three-dimensional mesh. The three dimensional mesh can comprise a plurality of interconnected first unit cells. Each interconnected first unit cell can comprise a base surface geometry that comprises a solid representation of a periodic implicit surface that contacts solid representations of the implicit surface in at least two neighboring first unit cells. The three dimensional mesh can comprise a plurality of interconnected second unit cells outside of the plurality of interconnected first unit cells. Each interconnected second unit cell can comprise a base strut geometry comprising a plurality of struts and a plurality of nodes at which one or more struts are connected. The three-dimensional mesh can comprise a transition region located between the plurality of interconnected first unit cells and the plurality of interconnected second unit cells. The transition region can comprise a third plurality of struts connecting some of the solid representations of the implicit surface to some of the nodes among the plurality of nodes. The transition region can lack any instance of the base surface geometry or any instance of the base strut geometry.

In a tenth embodiment (10) further to embodiment (9), the plurality of interconnected second unit cells can form a lattice having a first lattice shear modulus in a first direction and a second lattice shear modulus in a second direction opposite the first direction. The first lattice shear modulus can be at least 10% greater than the second lattice shear modulus.

In an eleventh embodiment (11) further to embodiment (10), each second unit cell can comprise an upper-forward quadrant and a lower-rearward quadrant, each of which contains thin struts and thick struts among the plurality of struts and nodes among the plurality of nodes. Each second unit cell can comprise an upper-rearward quadrant and a lower-forward quadrant, each of which contains thin struts, thick struts, and nodes among the plurality of nodes arranged in a second geometry. The thick struts and thin struts can be arranged differently in the first geometry than in the second geometry.

In a twelfth embodiment (12) further to any of embodiments (9)-(11), the transition region can comprise a plurality of third unit cells. Each third unit cell can comprise a first side and a second side, the first side being adjoined by one of the first unit cells and the second side being adjoined by one of the second unit cells. Each third unit cell can comprise a first segment that comprises the first side and is identical in structure to a segment of the adjoining first unit cell that comprises a side of the first unit. Each third unit cell can comprise a second segment that comprises the second side and is identical in structure to a segment of the adjoining second unit cell that comprises a side of the second unit cell.

In a thirteenth embodiment (13) further to embodiment (12), each third unit cell can comprise a third segment. The third segment can be that is located between the first segment and the second segment. The third segment can comprise every part of the third unit cell other than the first segment and second segment. The third segment can be non-identical to any portion of the base surface geometry having equal volume to the third segment or the base strut geometry having equal volume to the third segment.

In a fourteenth embodiment (14) further to any of embodiments (9)-(13), the third segment can comprise a transition geometry. The transition geometry can include first structures identical to portions of the base surface geometry and second structures identical to portions the base strut geometry.

In a fifteenth embodiment (15) further to embodiment (14), the first structures can be ribbons. The second structures can be struts and inter-strut gaps.

A sixteenth embodiment (16) of the present application is directed to a midsole for an article of footwear. The midsole can comprise a three-dimensional mesh comprising a plurality of interconnected unit cells. Each interconnected unit cell can comprise a plurality of struts and a plurality of nodes at which one or more struts are connected. The struts of the plurality of struts can be aligned on edges of polygons of a polygon mesh of an implicit surface.

In a seventeenth embodiment (17) further to embodiment (16), in each unit cell, the polygons of the polygon mesh can be identical. At least 90% of the edges of the polygons of the polygon mesh have a respective strut of the plurality of struts aligned thereon.

In an eighteenth embodiment (18) further to embodiment (16) or embodiment (17), one or more of the unit cells can comprise a portion of a beam. The portion of the beam may not aligned on any of the edges of the polygons of the polygon mesh. One or more of the unit cells can comprise at least two additional struts outside of the plurality of struts. The additional struts can be connected to one another by the portion of the beam.

In a nineteenth embodiment (19) further to embodiment (18), the beam can extend through multiple unit cells among the plurality of interconnected unit cells.

In a twentieth embodiment (20) further to embodiment (18) or embodiment (19), the beam can comprise an effective diameter that is at least 50% greater than an average effective diameter of the plurality of struts.

In a twenty-first embodiment (21) further to any of embodiments (16)-(20), the plurality of interconnected unit cells can be a plurality of interconnected first unit cells. The midsole can comprise a plurality of interconnected second unit cells outside of the plurality of interconnected first unit cells. Each interconnected second unit cell can comprise a solid representation of the implicit surface that contacts solid representations of the implicit surface in at least two neighboring first unit cells.

In a twenty-second embodiment (22) further to embodiment (21), the midsole can comprise a plurality of third unit cells. Each third unit cell can comprise a first side and a second side. The first side can be adjoined by one of the first unit cells and the second side being adjoined by one of the second unit cells. A first segment that comprises the first side and can be identical in structure to a segment of the adjoining first unit cell that comprises a side of the first unit cell. A second segment that comprises the second side and can be identical in structure to a segment of the adjoining second unit cell that comprises a side of the second unit cell.

A twenty-third embodiment (23) of the present application is directed to a method of manufacturing a midsole for an article of footwear. The method can comprise approximating an implicit surface with a polygon mesh. The method can comprise modeling a network of struts. Each strut can be aligned on an edge of a polygon within the polygon mesh. The method can comprise additively manufacturing a lattice of unit cells, wherein each unit cell has a base geometry of the network of struts.

In a twenty-fourth embodiment (24) further to embodiment (23), the lattice of unit cells can be a first lattice. The unit cells can be first unit cells. The base geometry can be a first base geometry. The method can comprise additively manufacturing a second lattice of second unit cells. Each second unit cell can have a second base geometry that is different than the first base geometry.

In a twenty-fifth embodiment (25) further to embodiment (23) or embodiment (24), the second base geometry can be a base surface geometry.

In a twenty-sixth embodiment (26) further to any of embodiments (23)-(25), the second lattice can be located posteriorly from the first lattice.

In a twenty-seventh embodiment (27) further to any of embodiments (23)-(26), the method can comprise additively manufacturing a transition region between the first lattice and the second lattice. The transition region can lack any instance of the first base geometry and the second base geometry. The transition region can connect first unit cells to second unit cells.

In a twenty-eighth embodiment (28) further to embodiment (27), the transition region can comprise transition unit cells. Each transition unit cell can comprise a plurality of nodes. Each node of the plurality of nodes can be located at a position within the third unit cell that is a mean average of a position of a node of the first base geometry within the first unit cell and a position of a node of the second base geometry within the second unit cell.

In a twenty-ninth embodiment (29) further to embodiment (27) or embodiment (28), the transition region can comprise transition unit cells. The transition unit cells can include first structures identical to portions of the first base geometry and second structures identical to portions the second base geometry.

In a thirtieth embodiment (30) further to embodiment (29), the first structures can be struts and inter-strut gaps and the second structures can be ribbons.

A thirty-first embodiment (31) of the present application is directed to a midsole for an article of footwear. The midsole can comprise a three-dimensional lattice. The three-dimensional lattice can comprise a plurality of interconnected unit cells. Each interconnected unit cell can comprise a plurality of struts defining a three-dimensional shape and a plurality of nodes at which two or more struts are connected. The plurality of struts can comprise thin struts, each of which has a first effective diameter along its length. The plurality of struts can comprise thick struts, each of which has a second effective diameter along its length. The second effective diameter can be greater than the first effective diameter. Each unit cell can comprise an upper-forward quadrant and a lower-rearward quadrant. Each of the upper-forward quadrant and the lower-rearward quadrant can contain thin struts, thick struts, and nodes among the plurality of nodes arranged in a first geometry. Each unit cell can comprise an upper-rearward quadrant and a lower-forward quadrant. Each of the upper-rearward quadrant and the lower-forward quadrant can contain thin struts, thick struts, and nodes among the plurality of nodes arranged in a second geometry, wherein the thick struts and thin struts are arranged differently in the first geometry than in the second geometry.

In a thirty-second embodiment (32) further to embodiment (31), the unit cell can be defined within a cubic space and the upper-forward quadrant. The lower-rearward quadrant can be symmetrical about a plane that contains four corners of the cubic space and bisects the upper-forward quadrant and the lower-rearward quadrant.

In a thirty-third embodiment (33) further to embodiment (31) or embodiment (32), the unit cell can be defined within a cubic space. The upper-rearward quadrant and the lower-forward quadrant can be asymmetrical about a plane that contains four corners of the cubic space and bisects the upper-rearward quadrant and the lower-forward quadrant.

In a thirty-fourth embodiment (34) further to any of embodiments (31)-(33), the first geometry can have one less plane of symmetry than the second geometry.

In a thirty fifth embodiment (35) further to any of embodiments (31)-(34), the first geometry can have either or both of: a modeled compressive modulus that is less than a modeled compressive modulus of the second geometry; and a modeled shear modulus that is less than a modeled shear modulus of the second geometry.

In a thirty-sixth embodiment (36) further to any of embodiments (31)-(35), the first geometry can contain an equal number of struts as the second geometry.

In a thirty-seventh embodiment (37) further to embodiment (36), the second geometry can include more thick struts than the first geometry.

In a thirty-eighth embodiment (38) further to any of embodiments (31)-(37), the unit cell can be defined within a cubic space having eight corners. Each of the quadrants can comprise two corner nodes. Each corner node can be located at a respective one of the eight corners. The corner nodes in the upper-forward quadrant can each be directly connected to a respective thin strut in the upper-forward quadrant. The corner nodes in the lower-rearward can each be directly connected to a respective thin strut in the lower-rearward quadrant. The corner nodes in the upper-rearward quadrant can each be directly connected to a respective thick strut in the upper-rearward quadrant. The corner nodes in the lower-forward quadrant can each be directly connected to a respective thick strut in the lower-forward quadrant.

In a thirty-ninth embodiment (39) further to embodiment (38), each strut in the upper-forward quadrant and the lower-rearward quadrant can be directly connected to a corner node is connected by another node to two thick struts and one thin strut.

In a fortieth embodiment (40) further to embodiment (38) or embodiment (39), each strut in the upper-rearward quadrant and the lower-forward quadrant directly connected to a corner node is connected by another node to two thick struts and one thin strut.

In a forty-first embodiment (41) further to any of embodiments (31)-(40), each quadrant can comprise an internal edge node located on a plane that bisects all four quadrants and at a respective edge of a cubic space within which the unit cell is defined. Each internal edge node can be connected to two thin struts in the same quadrant.

In a forty-second embodiment (42) further to embodiment (41), no internal edge node is directly connected to any thick struts.

In a forty-third embodiment (43) further to any of embodiments (31)-(42), each quadrant can comprise part of two boundary edge nodes. Each boundary edge node can be shared by two of the quadrants and located at a respective edge of a cubic space within which the unit cell is defined. The first geometry can comprise two thin struts that directly connect to boundary edge nodes and two thick struts that directly connect to boundary edge nodes. The second geometry can comprise four thick struts that directly connect to boundary edge nodes and no thin struts that directly connect to boundary edge nodes.

In a forty-fourth embodiment (43) further to any of embodiments (31)-(42), a ratio of the first effective diameter to the second effective diameter can be less than or equal to 4:5.

In a forty-fifth embodiment (45) further to any of embodiments (31)-(44), the midsole can comprise an exterior and a skin that covers at least a portion of the exterior.

In a forty-sixth embodiment (46) further to embodiment (45), the skin can comprise skin cells that differ in geometry from the unit cells.

In a forty-seventh embodiment (47) further to embodiment (46), the skin can comprises beams that extend across multiple of the skin cells.

In a forty-eighth embodiment (48) further to embodiment (47), the skin can include a convergence line at which some of the beams terminate.

In a forty-ninth embodiment (49) further to embodiment (48), the beams can extend upward and toward a toe end of the midsole on both sides of the convergence line.

In a fiftieth embodiment (50) further to embodiment (49), the convergence line can be located at a heel end of the midsole.

A fifty-first embodiment (51) of the present application is directed to a midsole for an article of footwear. The midsole can comprise a three dimensional lattice comprising a plurality of interconnected unit cells. The midsole can comprise a skin that covers at least a portion of an exterior of the lattice and includes a plurality of skin cells that differ in geometry from the unit cells.

In a fifty-second embodiment (52) further to embodiment (51), each unit cell can comprise a plurality of struts defining a three-dimensional shape and a plurality of nodes at which two or more struts are connected. Each unit cell can comprise an upper-forward quadrant and a lower-rearward quadrant, each of struts among the plurality of struts and nodes among the plurality of nodes arranged in a first geometry. Each unit cell can comprise an upper-rearward quadrant and a lower-forward quadrant, each of which contains struts among the plurality of struts and nodes among the plurality of nodes arranged in a second geometry that differs from the first geometry.

In a fifty-third embodiment (53) according to embodiment (52), the plurality of struts can comprise thin struts. Each thin strut can have a first effective diameter along its length. The plurality of struts can comprise a plurality of thick struts. Each thick strut can have a second effective diameter along its length. The second effective diameter can be greater than the first effective diameter.

In a fifty-fourth embodiment (54) further to embodiment (52) or embodiment (53), the skin can comprise beams that extend across multiple of the skin cells.

In a fifty-fifth embodiment (55) further to embodiment (54), the skin can include a convergence line at which some of the beams terminate.

In a fifty-sixth embodiment (56) further to embodiment (55), the beams extend upward and toward a toe end of the midsole on both sides of the convergence line.

In a fifty-seventh embodiment (57) further to embodiment (56), the convergence line can be located at a heel end of the midsole.

BRIEF DESCRIPTION OF THE DRAWINGS

FIG. 6G is a table comparing mechanical properties of a unit cell of a polygon mesh of an implicit surface and a unit cell of a solid representation of the implicit surface.

DETAILED DESCRIPTION

Figure 1:
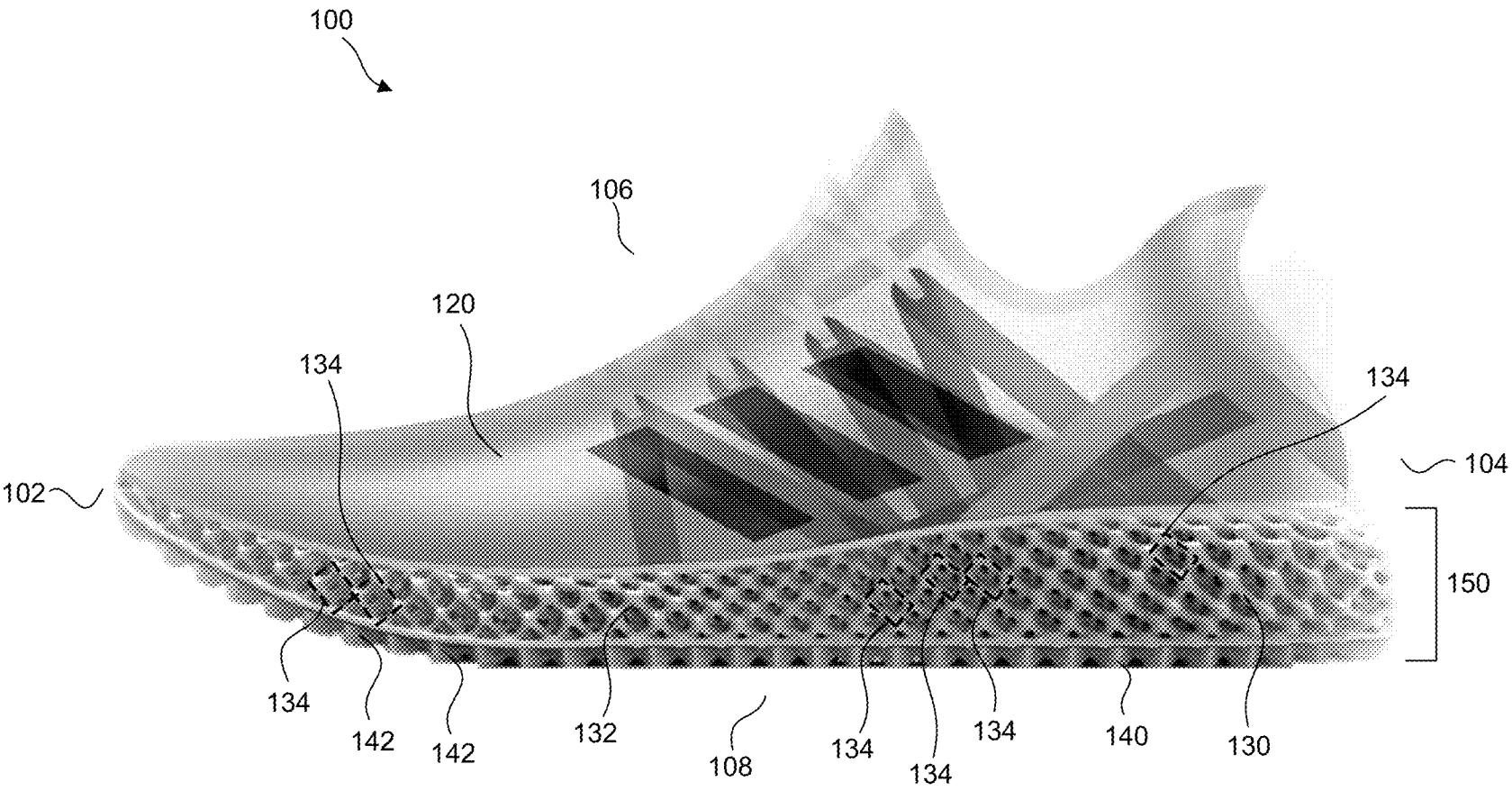
FIG. 1 is a side view of an article of footwear according to some embodiments.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An article of footwear has many purposes. Among other things, an article of footwear can cushion a wearer's foot, support a wearer's foot, protect a wearer's foot (e.g., from injury), and optimize the performance of a wearer's foot. Each of these purposes, alone or in combination, provides for a comfortable article of footwear suitable for use in a variety of scenarios (e.g., exercise and every day activities). The features of an article of footwear (e.g., shape, components, and materials used to make footwear) can be altered to produce desired characteristics, for example, cushioning, support, stability, ride, and propulsion characteristics.

Stability provided by an article of footwear can protect a wearer's foot from injury, such as spraining his or her ankle. Propulsion provided by an article of footwear can optimize the performance of a wearer's foot by, for example, maximizing the energy transfer from the individual's foot to the surface his or her foot is in contact with (e.g., the ground) via the article of footwear. Maximizing the energy transfer between the individual's foot and a surface (i.e., reducing energy lost via and/or absorbed by an article of footwear) can help an athlete, for example, accelerate faster, maintain a higher maximum speed, change directions faster, and jump higher. Cushioning and ride characteristics provided by an article of footwear can provide comfort for an individual during an athletic or everyday activity.

In some embodiments, three-dimensional meshes described herein can leverage characteristics of unit cells that make up the three-dimensional meshes to create mechanically anisotropic properties. These mechanically anisotropic properties can be designed to provide desired mechanical characteristics for a three-dimensional mesh defining all or a portion of a sole. One such property that can be designed to achieve specific mechanical characteristics is "lattice shear modulus." In some embodiments, all or a portion of a three-dimensional mesh can be designed to include anisotropic lattice shear moduli that impart desired mechanical characteristics to the three-dimensional mesh. In some embodiments, a plurality of regions of a three-dimensional mesh can be designed to include anisotropic lattice shear moduli that impart desired mechanical characteristics to the different regions of the three-dimensional mesh. Desired mechanical characteristics for a three-dimensional mesh may in turn create desired footwear sole characteristics, for example, cushioning, propulsion, stability, ride, and/or weight characteristics.

In some embodiments, a unit cell for a lattice in a shoe sole can be or include a structure of struts and nodes wherein the struts correspond to edges of polygons of a polygon mesh of an implicit surface. The polygon mesh can correspond to a polygon mesh rendering of the implicit surface. A majority of struts or every strut in the structure of struts and nodes can extend along a respective edge of a polygon in the polygon mesh. A majority of struts or every strut that extends along a respective edge of a polygon in the polygon mesh can have the same two end points as the edge. A majority of nodes or every node in the structure of struts and nodes can be centered at a respective corner of a polygon in the polygon mesh. The structure of struts and nodes can cause a lattice of unit cells each including the structure of struts and nodes to have advantageous mechanical performance.

In some embodiments, three-dimensional meshes described herein can leverage characteristics of different lattice types joined by a transition region. In some embodiments, a compound lattice can include a first lattice, a second lattice, and a transition region located between and joining the first lattice and the second lattice. The transition region can include transition cells that include a first segment adjoining the first lattice and a second segment adjoining the second lattice. The first segment in each transition cell can be identical in geometry to a corresponding segment in unit cells of the first lattice. The second segment in each transition cell can be identical in geometry to corresponding segments in unit cells of the second lattice. The first segment can include an entire face of the transition cell that adjoins the first lattice. The second segment can include an entire face of the transition cell that adjoins the second lattice. Each transition cell can each include a third segment that includes a remainder of the transition cell outside of the first segment and the second segment. The third segment can include a geometry that does not appear in the first lattice or the second lattice. The third segment can be more alike to the geometry of unit cells of the first lattice near the first segment and more alike to the geometry of unit cells of the second lattice near the second segment. The transition region can effectively transfer force between the first lattice and the second lattice.

In some embodiments, a compound lattice can include a first lattice of identical unit cells and a skin extending across at least a portion of an exterior of the compound lattice. In a shoe including a midsole including the compound lattice, the skin can extend across an entirety of the exterior of the compound lattice except for the portions of the exterior of the compound lattice that adjoin other portions of the shoe. In further embodiments, in a shoe including a midsole including the compound lattice, the skin can extend across an entirety of the exterior of the first lattice except for where the first lattice adjoins another lattice, a transition region located between the first lattice and a second lattice, or another portion of the shoe. The skin can include cells including structural similarities to the unit cells of the first lattice. In some embodiments, cells of the skin can include structures identical to a portion of one of the unit cells. In further embodiments, cells of the skin can include structures of struts and nodes that each correspond to a subset of a structure of struts and nodes found in each of the unit cells.

In some embodiments, the cells of a skin can include structures of struts and nodes corresponding to subsets of the structures in the unit cells of the first lattice. In some embodiments, the cells of the skin can additionally include struts that create geometries that do not appear in the unit cells in the first lattice. For example, a cell of the skin may include a structure of struts and nodes that corresponds to a subset of the structure present in the unit cells of the first lattice, and the cell of the skin can additionally include struts that each differ in any one or any combination of length, angle, and location within the cell from any struts in the structure present in the unit cells of the first lattice. The struts that define a geometry not found in the unit cells of the first lattice can be referred to as non-aligned struts. In some embodiments, the skin can include beams extending across multiple cells of the skin. In such embodiments, the non-aligned struts can connect to the beams. The non-aligned struts can connect the beams to the structures within the cells of the skin that are identical to subsets of the structure found in the unit cells of the first lattice. In some embodiments, the beams can have a greater diameter than the struts. In some embodiments, the beams can be the exterior-most elements in the cells of the skin into which the beams extend. In some embodiments, the beams can provide forward motion to a lattice by contributing to an anisotropic character of a lattice shear modulus of the compound lattice that causes the compound lattice to deform in a forward direction when exposed to compressive forces in at least one direction transverse to the forward direction. The at least one direction transverse to the forward direction can be or include a vertical direction extending through the thickness of the sole that includes the midsole that includes the compound lattice. In some embodiments, the beams can provide a desired aesthetic appearance to an external surface of a midsole.

In some embodiments, a three-dimensional mesh can comprise a plurality of interconnected unit cells, each interconnected unit cell comprising a plurality of struts defining a three-dimensional shape and a plurality of nodes at which one or more struts are connected, wherein the plurality of struts includes thin struts each of which has a first effective diameter along its length and thick struts, each of which has a second effective diameter along its length, the second effective diameter being greater than the first effective diameter. Each unit cell can have an upper-forward quadrant and a lower-rearward quadrant, each of which contains thin struts, thick struts, and nodes. Each unit cell can also have an upper-rearward quadrant and a lower-forward quadrant, each of which contains thin struts, thick struts, and nodes among the plurality of nodes arranged in a second geometry, wherein the thick struts and thin struts are arranged differently in the first geometry than in the second geometry. In some embodiments, the placement of the thick struts and thin struts can provide a favorable combination of forward motion, weight, and durability to the lattice In particular embodiments, mechanically anisotropic properties of three-dimensional meshes as described herein can be designed to create forward propulsion when a sole including the three-dimensional mesh contacts the ground. In such embodiments, the three-dimensional mesh can include a lattice shear modulus measured in a forward direction that is less than a lattice shear modulus measured in a rearward direction. By designing a three-dimensional mesh in this fashion, the three-dimensional mesh can convert vertical loading energy into forward displacement, which propels a wearer's foot forward when a sole including the three-dimensional mesh contacts the ground during use. In other words, by designing a three-dimensional mesh in this fashion, the three-dimensional mesh can be predisposed to deform forwards when a sole including the three-dimensional mesh contacts the ground during use.

A three-dimensional mesh predisposed to deform in a particular direction (for example, in a forward direction) can offer multiple advantages for a wearer. For example, forward motion created by the three-dimensional mesh can yield improved efficiency while running. In other words, a three-dimensional mesh predisposed to deform forward can reduce the energy a wearer is required expend to continue his or her forward motion. As another example, a three-dimensional mesh predisposed to deform laterally (for example medially) can improve efficiency when a wearer changes direction by providing additional support under typical lateral loading conditions associated with, for example a lateral or medial cut during running.

In some embodiments, three-dimensional meshes described herein can include unit cells composed of different types of sub-cells, which can also be referred to as "partial unit cells." As described herein, unit cells can be constructed by assembling sub-cells in certain arrangements to create anisotropic lattice shear moduli. In particular embodiments, unit cells can be constructed by assembling sub-cells in certain arrangements to create anisotropic lattice shear moduli that create forward propulsion when a sole including the three-dimensional mesh contacts the ground.

As used herein, the term "three-dimensional mesh" means a three-dimensional structure comprising interconnected structural members defining a plurality of unit cells. The structural members, and thus the unit cells, can be connected at nodes. The unit cells can be arranged in a lattice configuration. For example, the interconnected structural members can be struts that are connected at nodes and that define unit cells arranged in a lattice configuration. Exemplary lattice configurations include, but are not limited to modified basic cubic lattices, modified body-centered cubic lattices, and modified face-centered cubic lattices.

As used herein, the term "lattice shear modulus" means the shear modulus (slope of the shear stress versus shear strain curve in the elastic region) for a three-dimensional mesh, or a portion thereof. A "lattice shear modulus" as described herein can be measured using, as an example, the following solid model simulation. A 7×7×2 unit cell puck composed of unit cells for the three-dimensional mesh is modeled using FEA (finite element analysis) modeling software. Suitable FEA modeling software includes Abaqus FEA modeling software. The 7×7×2 unit cell puck includes two layers of seven longitudinal rows of seven unit cells arranged adjacent to each other in the transverse direction as described herein. The unit cell puck is modeled as being sandwiched between and in contact with a top plate and a bottom plate. The following parameters were input into the FEA modeling software for the simulation: (1) material characteristics of the modeled struts for the unit cell puck (including density and tensile properties), (2) the loading conditions, and (3) the contact mechanics between the unit cell puck and the two plates (including the frictional properties).

Lattice shear moduli of the 7×7×2 unit cell puck in different directions is determined by a shear simulation with 45-degree load in the direction in which the lattice shear modulus is being evaluated. To determine the lattice shear modulus in a forward longitudinal direction, a 45-degree load in the forward longitudinal direction is modeled. To determine the lattice shear modulus in a rearward longitudinal direction, a 45-degree load in the rearward longitudinal direction is modeled. To determine the lattice shear modulus in a medial transverse direction, a 45-degree load in the medial transverse direction is modeled. To determine the lattice shear modulus in a lateral transverse direction, a 45-degree load in the lateral transverse direction is modeled.

The modeled stress-strain behavior of the 7×7×2 unit cell puck is plotted and the lattice shear modulus in the different directions is calculated by measuring the slope of the stress-strain curve in the elastic deformation region in the plot.

In some cases, uniaxial compression loading can be modeled using the FEA modeling software to determine a "lattice compressive modulus" for a three-dimensional mesh, or a portion thereof. To determine the lattice compressive modulus for a three-dimensional mesh, the same model 7×7×2 unit cell puck is compressed at up to 50% strain. For this model, the tow plates are free to move in the longitudinal and transverse directions, and therefore the unit cell pucks are free to deform in the longitudinal and transverse directions. The modeled stress-strain behavior of the 7×7×2 unit cell puck can be plotted and the lattice compressive modulus can be calculated by measuring the slope of the stress-strain curve in the elastic deformation region in the plot. Further, this uniaxial compression loading can be used to determine a lattice displacement in the forward direction for a three-dimensional mesh, or a portion thereof. The lattice displacement in the forward direction is the amount the 7×7×2 puck deforms forward under the uniaxial compression loading, measured in millimeters.

As used herein, "anisotropic" means dependent on direction. "Isotropic" generally means independent of direction. A material or component with a particular property that is isotropic at a particular point would have that same property regardless of measurement direction. For example, if Young's modulus is isotropic at a point, the value of the Young's modulus is the same regardless of the stretching direction used to measure Young's modulus.

An isotropic material or component has 2 independent elastic constants, often expressed as the Young's modulus and Poisson's ratio of the material (although other ways to express may be used), which do not depend on position in such a material or component. A fully anisotropic material or component has 21 independent elastic constants. An orthotropic material or component has 9 independent elastic constants.

Orthotropic materials or components are a sub-set of anisotropic materials or components. By definition, an orthotropic material or component has at least two orthogonal planes of symmetry where material properties are independent of direction within each plane. An orthotropic material or component has nine independent variables (i.e. elastic constants) in its stiffness matrix. An anisotropic material or component can have up 21 elastic constants to define its stiffness matrix, if the material or component completely lacks planes of symmetry.

The mechanically anisotropic characteristic(s) of midsoles disclosed herein may offer a multitude of different options for customizing (tailoring) a midsole to an individual's, or group of individuals' needs. For example, lattice shear moduli may vary between different zones or portions on a midsole to provide desired characteristics (e.g., cushioning, support, stability, ride, and/or propulsion characteristics) for an individual, or group of individuals.

Midsoles including a three-dimensional mesh as discussed herein can be manufactured using one or more additive manufacturing methods. Additive manufacturing methods can allow for fabrication of three-dimensional objects without the need for a mold. By reducing or eliminating the need for molds, additive manufacturing methods can reduce costs for a manufacturer, and in turn a consumer, of a product (e.g., a shoe). Integral manufacturing of a midsole using additive manufacturing can make the assembly of separate elements of the midsole unnecessary. Similarly, an additively manufactured midsole can be fabricated from single material, which may facilitate easy recycling of the midsole.

Further, since molds may not be required, additive manufacturing methods facilitate customization of products. Additive manufacturing methods can be leveraged to provide customized and affordable footwear for individuals. Exemplary additive manufacturing techniques include for example, selective laser sintering, selective laser melting, selective heat sintering, stereo lithography, fused deposition modeling, or 3-D printing in general. Various additive manufacturing techniques related to articles of footwear are described for example in US 2009/0126225, WO 2010/126708, US 2014/0300676, US 2014/0300675, US 2014/0299009, US 2014/0026773, US 2014/0029030, WO 2014/008331, WO 2014/015037, US 2014/0020191, EP 2564719, EP 2424398, and US 2012/0117825. In some embodiments, the additive manufacturing process can include a continuous liquid interface production process. For example, the additive manufacturing process can include a continuous liquid interface production process as described in U.S. Pat. No. 9,453,142, issued on Sep. 27, 2016, which is hereby incorporated in its entirety by reference thereto.

In some embodiments, 3-D printing a three-dimensional mesh can include 3-D printing the mesh in an intermediate green state, shaping the mesh in the green state, and curing the green mesh in its final shape.

Techniques for producing an intermediate object from resins by additive manufacturing are known. Suitable techniques include bottom-up and top-down additive manufacturing, generally known as stereolithography. Such methods are known and described in, for example, U.S. Pat. No. 5,236,637 to Hull, U.S. Pat. Nos. 5,391,072 and 5,529,473 to Lawton, U.S. Pat. No. 7,438,846 to John, U.S. Pat. No. 7,892,474 to Shkolnik, U.S. Pat. No. 8,110,135 to El-Siblani, U.S. Patent Application Publication No. 2013/0292862 to Joyce, and US Patent Application Publication No. 2013/0295212 to Chen et al. The disclosures of these patents and applications are incorporated by reference herein in their entirety.

In some embodiments, the additive manufacturing step is carried out by one of the family of methods sometimes referred to as continuous liquid interface production (CLIP). CLIP is known and described in, for example, U.S. Pat. Nos. 9,211,678; 9,205,601; 9,216,546; and others; in J. Tumbleston et al., Continuous liquid interface production of 3D Objects, Science 347, 1349-1352 (2015); and in R. Janusziewcz et al., Layerless fabrication with continuous liquid interface production, *Proc. Natl. Acad. Sci. USA* 113, 11703-11708 (Oct. 18, 2016). Other examples of methods and apparatus for carrying out particular embodiments of CLIP include, but are not limited to: Batchelder et al., US Patent Application Pub. No. US 2017/0129169 (May 11, 2017); Sun and Lichkus, US Patent Application Pub. No. US 2016/0288376 (Oct. 6, 2016); Willis et al., US Patent Application Pub. No. US 2015/0360419 (Dec. 17, 2015); Lin et al., US Patent Application Pub. No. US 2015/0331402 (Nov. 19, 2015); D. Castanon, US Patent Application Pub. No. US 2017/0129167 (May 11, 2017). B. Feller, US Pat App. Pub. No. US 2018/0243976 (published Aug. 30, 2018); M. Panzer and J. Tumbleston, US Pat App Pub. No. US 2018/0126630 (published May 10, 2018); K. Willis and B. Adzima, US Pat App Pub. No. US 2018/0290374 (Oct. 11, 2018) L. Robeson et al., PCT Patent Pub. No. WO 2015/164234 (see also U.S. Pat. Nos. 10,259,171 and 10,434,706); and C. Mirkin et al., PCT Patent Pub. No. WO 2017/210298 (see also US Pat. App. US 2019/0160733). The disclosures of these patents and applications are incorporated by reference herein in their entirety.

While stereolithography techniques such as CLIP can be preferred, it will be appreciated that other additive manufacturing techniques, such as jet printing (see, e.g., U.S. Pat. No. 6,259,962 to Gothait and US Patent App. Serial No. US 2020/0156308 to Ramos et al.) can also be used.

In some embodiments, a three-dimensional mesh can have anisotropic lattice shear moduli in forward and rearward directions as described herein. In some embodiments, one or more regions of a three-dimensional mesh can have anisotropic lattice shear moduli in forward and rearward directions as described herein. In some embodiments, the lattice shear modulus in the forward direction can be greater than the lattice shear modulus in the rearward direction. In some embodiments, the lattice shear modulus in the forward direction can be less than the lattice shear modulus in the rearward direction.

By tailoring the lattice shear modulus in the forward direction to be greater than or less than the lattice shear modulus in the rearward direction, a sole can be designed to have desired characteristics when acted on by vertical forces, forward forces, and rearward forces during use. For example, a lattice shear modulus in the rearward direction can be designed to be relatively stiff to provide propulsion while an athlete is accelerating in a forward direction (which applies a significant rearward force on a sole). A relatively stiff lattice shear modulus, and therefore a relatively flexible lattice shear modulus in the forward direction, can also provide forward propulsion by transforming vertical forces applied to the sole into forward displacement while an athlete is accelerating forward, thereby facilitating the forward acceleration. As another example, a lattice shear modulus in the forward direction can be designed to be relatively flexible to provide cushion during a heel strike or while an athlete is deaccelerating (both of which can apply a significant forward force on a sole).

Figure 2:
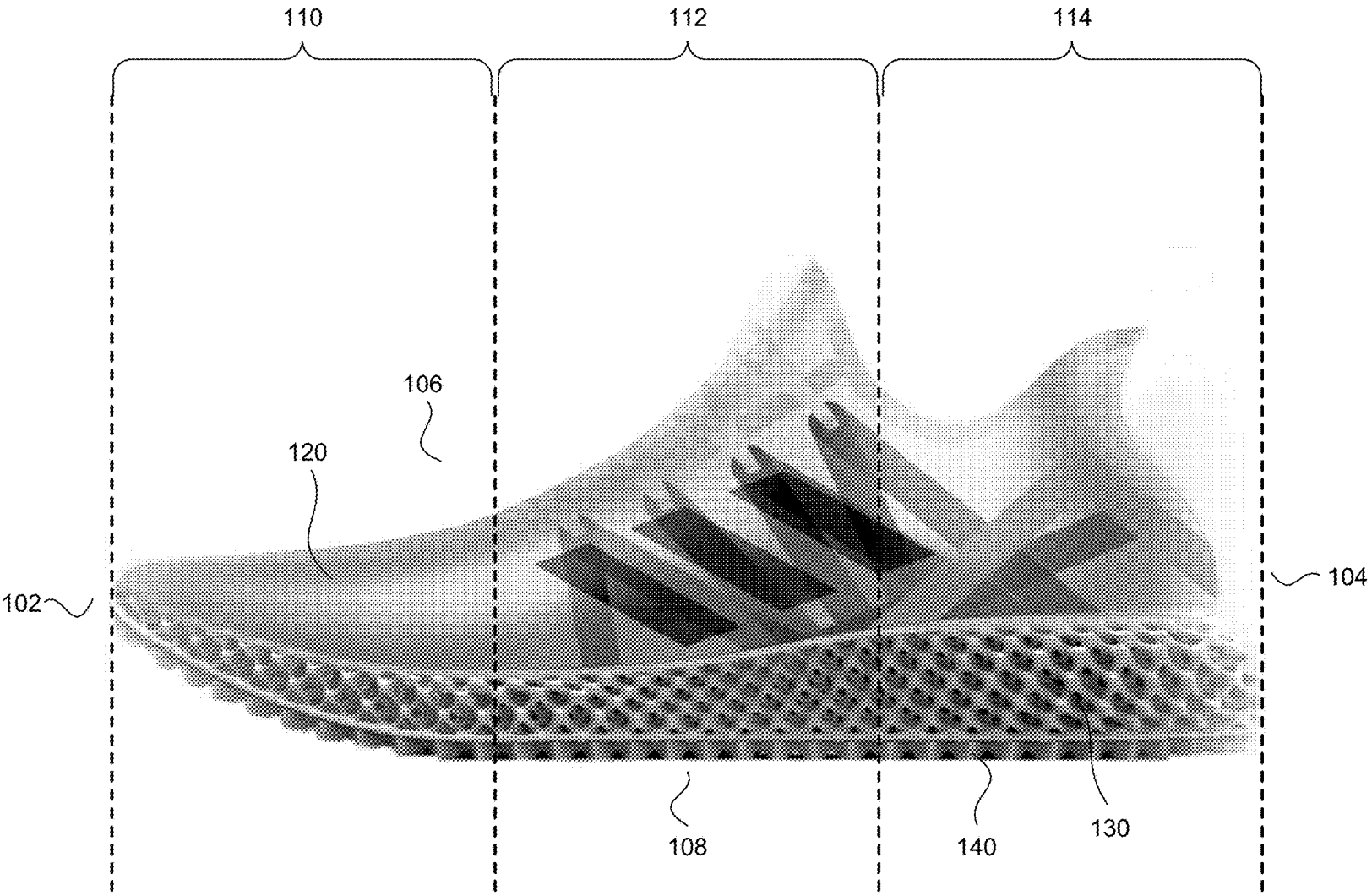
FIG. 2 is a side view of an article of footwear according to some embodiments showing portions of the article of footwear.

FIGS. 1 and 2 show an article of footwear 100 according to some embodiments. Article of footwear 100 can include an upper 120 coupled to a midsole 130. Article of footwear 100 includes a forefoot end 102, a heel end 104, a medial side 106, and a lateral side 108 opposite medial side 106. Also, as shown for example in FIG. 2, article of footwear 100 includes a forefoot portion 110, a midfoot portion 112, and a heel portion 114. Portions 110, 112, and 114 are not intended to demarcate precise areas of article of footwear 100. Rather, portions 110, 112, and 114 are intended to represent general areas of article of footwear 100 that provide a frame of reference. Although portions 110, 112, and 114 apply generally to article of footwear 100, references to portions 110, 112, and 114 also can apply specifically to upper 120 or midsole 130, or individual components of upper 120 or midsole 130.

In some embodiments, article of footwear 100 can include an outsole 140 coupled to midsole 130. Together, midsole 130 and outsole 140 can define a sole 150 of article of footwear 100. In some embodiments, outsole 140 can be directly manufactured (e.g., 3-D printed) on the bottom side of midsole 130. In some embodiments, outsole 140 and midsole 130 can be manufactured in one manufacturing process (e.g., one 3-D printing process) and no bonding, e.g. via adhesives, may be necessary. In some embodiments, outsole 140 can include a plurality of protrusions 142 to provide traction for article of footwear 100. Protrusions 142 can be referred to as tread.

As shown in FIG. 1, in some embodiments midsole 130 can include a three-dimensional mesh 132 composed of a plurality of interconnected unit cells 134. Midsole 130 can be any of the midsoles described herein, for example, midsole 300 or the midsole 763 of FIG. 8B. Also, midsole 130 can include any of the three-dimensional meshes discussed herein.

Upper 120 and sole 150 can be configured for a specific type of footwear, including, but not limited to, a running shoe, a hiking shoe, a water shoe, a training shoe, a fitness shoe, a dancing shoe, a biking shoe, a tennis shoe, a cleat (e.g., a baseball cleat, a soccer cleat, or a football cleat), a basketball shoe, a boot, a walking shoe, a casual shoe, or a dress shoe. Moreover, sole 150 can be sized and shaped to provide a desired combination of cushioning, stability, propulsion, and ride characteristics to article of footwear 100. The term "ride" may be used herein in describing a sense of smoothness or flow occurring during a gait cycle including heel strike, midfoot stance, toe off, and the transitions between these stages. In some embodiments, sole 150 can provide particular ride features including, but not limited to, appropriate control of pronation and supination, support of natural movement, support of unconstrained or less constrained movement, appropriate management of rates of change and transition, and combinations thereof.

Sole 150 and portions thereof (e.g., midsole 130 and outsole 140) can comprise material(s) for providing desired cushioning, ride, propulsion, support, and stability. Suitable materials for sole 150 (e.g., midsole 130 and/or outsole 140) include, but are not limited to, a foam, a rubber, ethyl vinyl acetate (EVA), thermoplastic polyurethane (TPU), expanded thermoplastic polyurethane (eTPU), polyether block amide (PEBA), expanded polyether block amide (ePEBA), thermoplastic rubber (TPR), and a thermoplastic polyurethane (PU). In some embodiments, the foam can comprise, for example, an EVA based foam or a PU based foam and the foam can be an open-cell foam or a closed-cell foam. In some embodiments, midsole 130 and/or outsole 140 can comprise elastomers, thermoplastic elastomers (TPE), foam-like plastics, gel-like plastics, and combinations thereof. In some embodiments, midsole 130 and/or outsole 140 can comprise polyolefins, for example polyethylene (PE), polystyrene (PS) and/or polypropylene (PP). In some embodiments, sole 150 can include a shank or torsion bar. In such embodiments, the shank or torsion bar can be made of a Nylon polymer.

Sole 150 and portions thereof (e.g., midsole 130 and outsole 140) can be formed using an additive manufacturing process, including, but not limited to, selective laser sintering, selective laser melting, selective heat sintering, stereo lithography, fused deposition modeling etc., or 3-D printing in general. In some embodiments, midsole 130 and/or outsole 140 can be formed using an additive manufacturing process including a continuous liquid interface production process. For example, midsole 130 and/or outsole 140 can be formed using a continuous liquid interface production process as described in U.S. Pat. No. 9,453,142, issued on Sep. 27, 2016, which is hereby incorporated in its entirety by reference thereto. In some embodiments, midsole 130 and outsole 140 can be formed as a single piece via an additive manufacturing process. In such embodiments, midsole 130 and outsole 140 can be a single integrally formed piece.

In some embodiments, outsole 140 can be formed by injection molding, blow molding, compression molding, rotational molding, or dipping. In such embodiments, midsole 130 and outsole 140 can be discrete components that are formed separately and attached. In some embodiments, midsole 130 can be attached to outsole 140 via, for example, but not limited to, adhesive bonding, stitching, welding, or a combination thereof. In some embodiments, midsole 130 can be attached to outsole 140 via an adhesive disposed between midsole 130 and outsole 140. Similarly, midsole 130 can be attached to upper 120 via, for example, but not limited to, adhesive bonding, stitching, welding, or a combination thereof.

Figure 3:
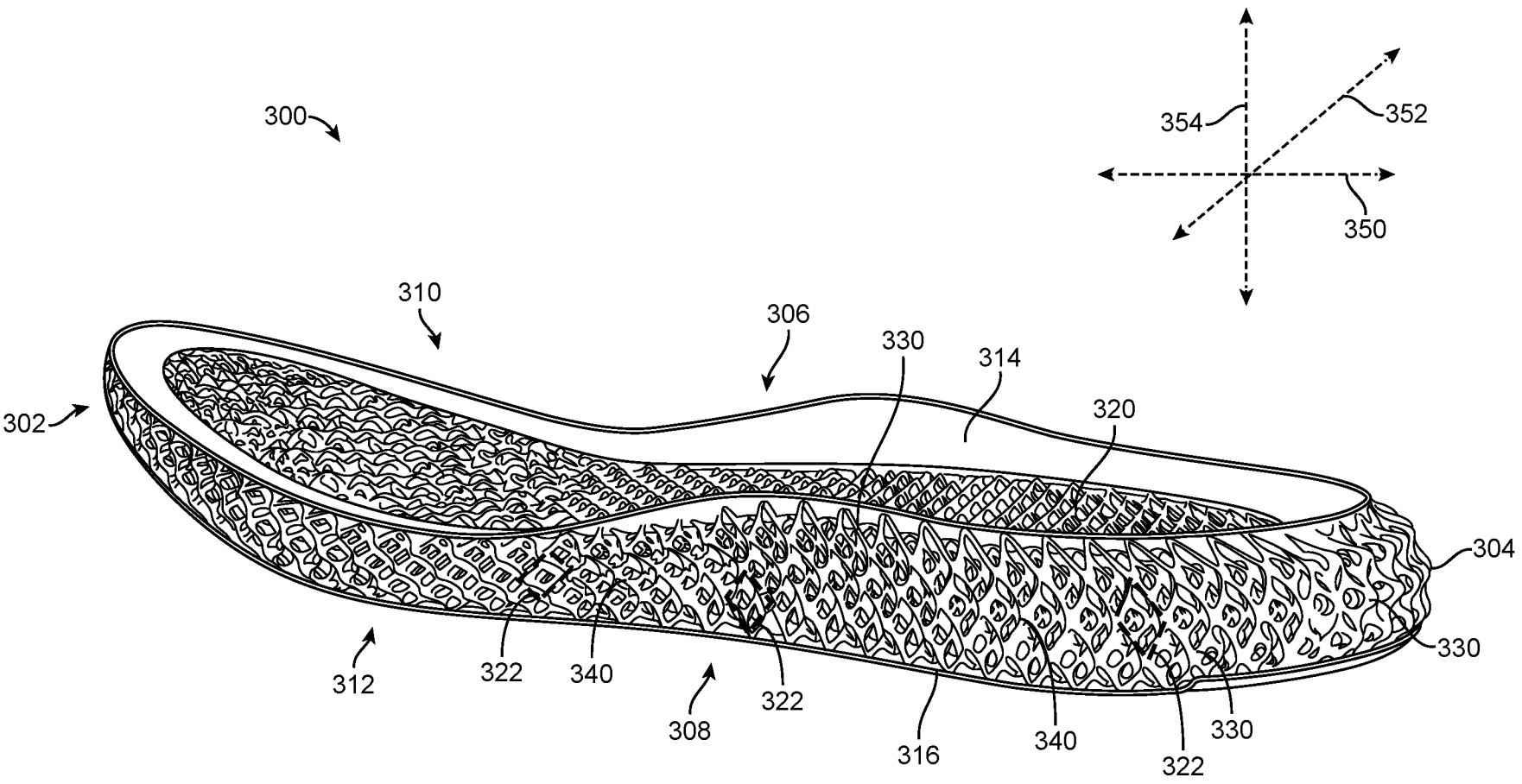
FIG. 3 is a perspective view of a midsole according to some embodiments.

FIG. 3 shows a midsole 300 according to some embodiments. Midsole 300 includes a forefoot end 302, a heel end 304, a medial side 306, a lateral side 308, a top side 310, and a bottom side 312. A longitudinal direction 350 of midsole 300 extends between forefoot end 302 and heel end 304.

Longitudinal direction 350 includes a forward longitudinal direction ("forward direction") extending from heel end 304 to forefoot end 302 and a rearward longitudinal direction ("rearward direction") extending from forefoot end 302 to heel end 304. A transverse direction 352 of midsole 300 extends between medial side 306 and lateral side 308 of midsole 300. Transverse direction 352 includes a medial transverse direction ("medial direction") extending from lateral side 308 to medial side 306 and a lateral transverse direction ("lateral direction") extending from medial side 306 to lateral side 308. A vertical direction 354 of midsole 300 extends between top side 310 and bottom side 312 of midsole 300. Vertical direction 354 includes an upward vertical direction ("upward direction") extending from bottom side 312 to top side 310 and a downward vertical direction ("downward direction") extending from top side 310 to bottom side 312. Top side 310 can be considered an "upper-facing side" and bottom side 312 can be considered a "ground-facing side."

Midsole 300 can be defined, in whole or in part, by a three-dimensional mesh 320. For example, in some embodiments, three-dimensional mesh 320 can define one or more of a forefoot portion 110 of midsole 300, a midfoot portion 112 of midsole 300, and/or a heel portion 114 of midsole. In some embodiments, three-dimensional mesh 320 can define all or a portion of forefoot portion 110 of midsole 300. In some embodiments, three-dimensional mesh 320 can define all or a portion of midfoot portion 112 of midsole 300. In some embodiments, three-dimensional mesh 320 can define all or a portion of heel portion 114 of midsole 300.

Similar to midsole 300, three-dimensional mesh 320 can be described as having a forefoot end 302, a heel end 304, a medial side 306, a lateral side 308, a top side 310, and a bottom side 312. Unless specified otherwise, a forefoot end 302, heel end 304, medial side 306, lateral side 308, top side 310, and bottom side 312 for a three-dimensional mesh 320 does not necessarily correspond to a forefoot end 302, heel end 304, medial side 306, lateral side 308, top side 310, or bottom side 312 of midsole 300. A forefoot end 302 of three-dimensional mesh 320 refers to a foremost end of three-dimensional mesh 320 and a heel end 304 of three-dimensional mesh 320 refers to a rearmost end of three-dimensional mesh 320. A medial side 306 of three-dimensional mesh 320 refers to a medial-most side of three-dimensional mesh 320 and a lateral side 308 of three-dimensional mesh 320 refers to a lateral-most side of three-dimensional mesh 320. A top side 310 of three-dimensional mesh 320 refers to a topmost side of three-dimensional mesh 320 and a bottom side 312 of three-dimensional mesh 320 refers to a bottommost side of three-dimensional mesh 320.

In some embodiments, midsole 300 can include a rim 314 disposed around all or a portion of the perimeter of top side 310 of midsole 300. In some embodiments, rim 314 can be disposed around all or a portion of the perimeter of medial and lateral sides 306/308 of midsole 300. In embodiments including rim 314, rim 314 can provide stability for the perimeter of midsole 300 and/or can facilitate attachment of midsole 300 to an upper (e.g., upper 120). In some embodiments, an outsole 316 can be coupled to bottom side 312 of midsole 300.

Three-dimensional mesh 320 includes a plurality of interconnected unit cells 322. The interconnected unit cells 322 can include a plurality of struts 330 defining a three-dimensional shape of a respective unit cell 322. A plurality of struts 330 of three-dimensional mesh 320 are connected at nodes 340. The number of struts 330 that are connected at a node 340 is the "valence number" of the node 340. For example, if four struts 330 are connected at a node 340, that node 340 has a valence of four. In some embodiments, nodes 340 can have a valence number in the range of two to twelve. For example, a node 340 can have a valence number of two, three, four, five, six, seven, eight, nine, ten, eleven, or twelve, or within a range having any two of these values as endpoints.

Each of the interconnected unit cells 322 can include a base geometry. In some embodiments, all or a portion of the interconnected unit cells 322 can include a base strut geometry. In some embodiments, all or a portion of the interconnected unit cells 322 can include a base surface geometry.

As used herein "base geometry" means the base three dimensional shape of a unit cell. A base geometry is the three dimensional shape of a unit cell in an unwarped and unmodified state (e.g., when unit cell 322 is not deformed by loading, conformed to a specific shape, or modified as described herein). The base geometry of a unit cell 322 can be, but is not limited to, a dodecahedron (e.g., rhombic), a tetrahedron, an icosahedron, a cube, a cuboid, a prism, or a parallelepiped.

As used herein "base strut geometry" means the base three-dimensional shape, connection, and arrangement of the struts and nodes defining a full unit cell. As used herein "base surface geometry" means the base three-dimensional shape of a body formed by one or more ribbons of material that define a solid representation of an implicit surface for a full unit cell. In some embodiments, the implicit surface can be a periodic implicit surface such that the base surface geometry of each unit cell contacts the base surface geometry of at least some adjacent unit cells to create a lattice. Any implicit surface mentioned within the present disclosure can, in at least some embodiments, be such a periodic implicit surface unless stated otherwise. One example of a suitable periodic surface is a gyroid, but in various embodiments any type of periodic surface can be used.

Herein, a solid representation of an implicit surface refers to a solid object following the shape of an implicit surface. Whereas an actual implicit surface has no thickness, a solid representation of an implicit surface has a thickness on one or both sides of the actual implicit surface in a three dimensional space. The thickness gives the solid representation volume, meaning the solid representation can be built as a physical object from solid material. The added thickness or thicknesses can be uniform, or at least approximately uniform notwithstanding fillets or local deformities, and thin in comparison to the overall size of the represented implicit surface. In various embodiments, the relative density of a unit cell of the solid representation can be from 5% to 30%, from 5% to 40%, from 10% to 25%, or from 15% to 20%. The term "relative density" as used herein refers to an amount of a unit cell occupied by solid material as a percentage of a total volume of the unit cell. In other embodiments, the thickness can be added by filling in spaces enclosed by the implicit surface, or spaces enclosed by multiple implicit surfaces joined together.

In some embodiments, the implicit surfaces can be created using a combination of random Fourier series functions, in which linear and or nonlinear coefficient as well as linear and nonlinear variables inside sinuous and cosine terms over the x, y and z space are iterated to generate the functions. The resulting unit cells can have different planes of symmetry, such as, in various examples, zero planes of symmetry, one plane of symmetry, or more than one plane of symmetry. The function can derived in a way that satisfies the periodicity of the unit cell. Criteria for the selection of an applicable implicit surface within the design space domain can include any one or any combination of number of terms in the equation, number of connected components, the edge boundary length, surface area, and volume fraction.

Interconnected unit cells 322 can be organized in a lattice framework that defines a volume of three-dimensional mesh 320. A lattice framework is composed of a plurality of lattice cells in which unit cells 322 are populated and arranged. A lattice framework is an invisible framework used to arrange unit cells 322, or partial unit cells (i.e., sub-cells), and construct a three-dimensional mesh 320 as described herein. In some embodiments, the lattice framework can be an unwarped lattice framework, for example a purely cubic lattice framework. In some embodiments, the lattice framework can be a warped lattice framework, for example a warped cubic lattice framework. A warped lattice framework can include warped lattice cells and unwarped lattice cells. Other exemplary lattice frameworks include, but are not limited to, a tetrahedron lattice framework, a warped tetrahedron lattice framework, a dodecahedron lattice framework, or a warped dodecahedron lattice framework.

Unit cells 322 can be any of the other unit cells described herein. Accordingly, unit cells 322 can, in various embodiments, be isotropic unit cells, anisotropic unit cells, unit cells of a base strut geometry, unit cells of a base surface geometry, unit cells of a base strut geometry wherein the struts lie along edges of polygons within a polygon mesh of an implicit surface, unit cells of a base surface geometry wherein the surface is an implicit surface, and unit cells of one geometry within a compound lattice including unit cells of another geometry.

A lattice framework can be generated using a computer modeling program such, as but not limited to, Grasshopper 3D and/or Rhinoceros 3D CAD software. In some embodiments, a lattice framework can be created and/or populated in the same or a similar manner as described in U.S. Pat. No. 10,575,588, published Mar. 3, 2020, which is hereby incorporated by reference in its entirety.

Three-dimensional mesh 320 can include one or more mechanically anisotropic regions. A three-dimensional mesh 320 with one or more mechanically anisotropic regions can define all or a portion of a forefoot portion 110 of midsole 300, a midfoot portion 112 of midsole 300, and/or a heel portion 114 of midsole. In some embodiments, a mechanically anisotropic region can define all or a portion of forefoot portion 110 of midsole 300. In some embodiments, a mechanically anisotropic region can define all or a portion of midfoot portion 112 of midsole 300. In some embodiments, a mechanically anisotropic region can define all or a portion of heel portion 114 of midsole 300. In some embodiments, three-dimensional mesh 320 can include at least two mechanically anisotropic regions.

A mechanically anisotropic region of three-dimensional mesh 320 can have a first lattice shear modulus measured in a first direction and a second lattice shear modulus different from the first lattice shear modulus and measured in a second direction opposite to the first direction. In some embodiments, a mechanically anisotropic region of three-dimensional mesh 320 can have a third lattice shear modulus measured in a third direction and a fourth lattice shear modulus different from the third lattice shear modulus and measured in a fourth direction opposite to the third direction.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

In some embodiments, a plurality of interconnected unit cells 405 defining an anisotropic region of three-dimensional mesh 320, can each include a soft sub-cell and a stiff sub-cell. The anisotropic region of three-dimensional mesh 320 is anisotropic with respect to lattice shear modulus.

Figure 5B:
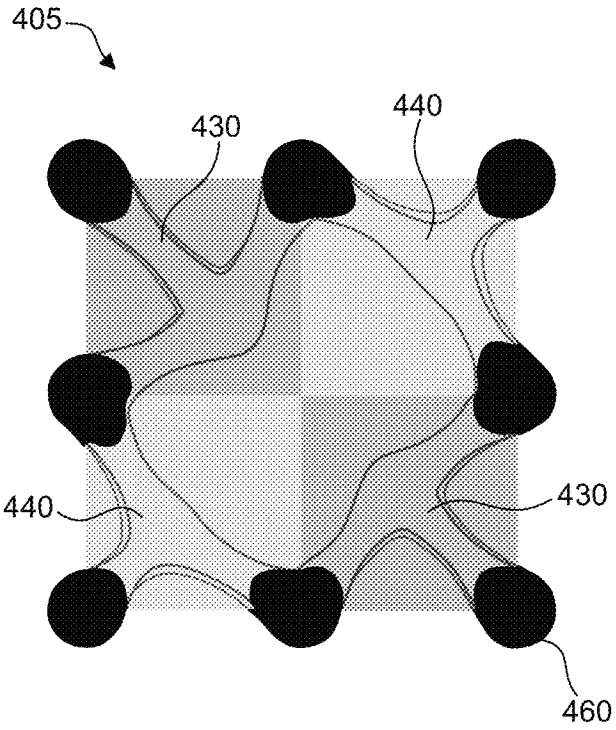
FIG. 5B is a side view of the unit cell shown in FIG. 5A.
Figure 5A:
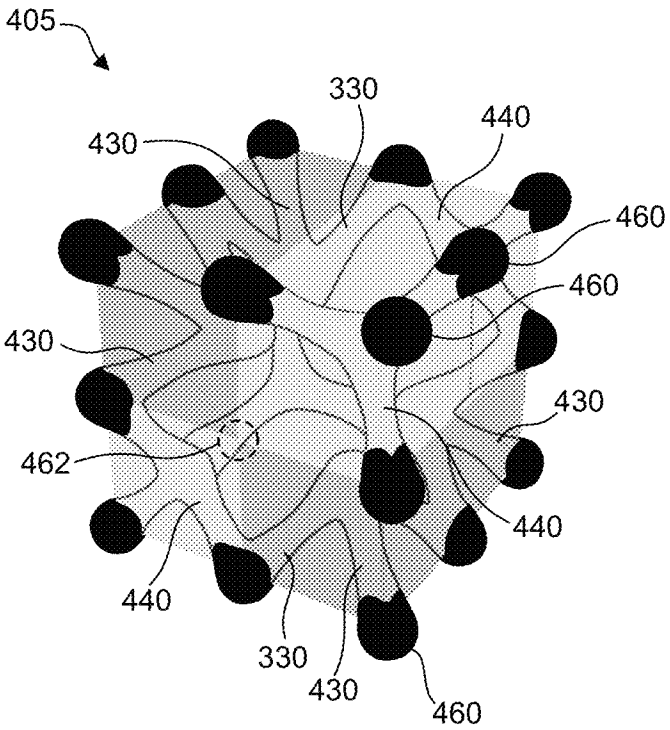
FIG. 5A is a perspective view of a unit cell according to some embodiments.

Unit cells 405 can have all the features illustrated and described above with regard to unit cells 322. In some embodiments, each of the plurality of interconnected unit cells 405 can each include a plurality of soft sub-cells and a plurality of stiff sub-cells. In some embodiments, each of the plurality of interconnected unit cells 405 can each include a plurality of the same soft sub-cells and a plurality of the same stiff sub-cells. FIGS. 5A and 5B illustrate exemplary soft-sub cells 430 and stiff sub-cells 440 according to some embodiments.

In some embodiments, every interconnected unit cell 405 defining the anisotropic region of three-dimensional mesh 320, can include a soft sub-cell and a stiff sub-cell. In some embodiments, every interconnected unit cell 405 defining three-dimensional mesh 320, or an anisotropic region thereof, can include a plurality of soft sub-cells and a plurality of stiff sub-cells. In some embodiments, every interconnected unit cell 405 located in portions of three-dimensional mesh 320, or an anisotropic region thereof, having a thickness measured in vertical direction 354 at least a large as the thickness of a unit cell 405 can include a soft sub-cell and a stiff sub-cell. In some embodiments, every interconnected unit cell 405 located in portions of three-dimensional mesh 320, or an anisotropic region thereof, having a thickness measured in vertical direction 354 at least a large as the thickness of a unit cell 405 can include a plurality of soft sub-cells and a plurality of stiff sub-cells.

In some embodiments, a plurality of interconnected unit cells 405 defining three-dimensional mesh 320, or an anisotropic region thereof, can include eight sub-cells. In some embodiments, the eight sub-cells can include a plurality of soft sub-cells and a plurality of stiff sub-cells. In some embodiments, the eight sub-cells can include four soft sub-cells and four stiff sub-cells. In some embodiments, the eight sub-cells can include four of the same soft sub-cells and four of the same stiff sub-cells.

Soft sub-cells are composed of a plurality of struts 330 and one or more nodes 340 that define a portion of unit cell 405. In other words, soft sub-cells are partial unit cells defining a portion of unit cell 405. As used herein, a "soft sub-cell" is a sub-cell for a lattice structure having: (i) a modeled compressive modulus that is less than a modeled compressive modulus of a lattice structure for a "stiff sub-cell" defining a portion of the same unit cell 405, (ii) a modeled shear modulus that is less than a modeled shear modulus of a lattice structure for a "stiff sub-cell" defining a portion of the same unit cell 405, or (iii) both.

Stiff sub-cells are composed of a plurality of struts 330 and one or more nodes 340 that define a portion of unit cell 405. In other words, stiff sub-cells are partial unit cells defining a portion of unit cell 405. As used herein, a "stiff sub-cell" is a sub-cell for a lattice structure having (i) a modeled compressive modulus that is greater than a modeled compressive modulus of a lattice structure for a "soft sub-cell" defining a portion of the same unit cell 405, (ii) a modeled shear modulus that is greater than a modeled shear modulus of a lattice structure for a "soft sub-cell" defining a portion of the same unit cell 405, or (iii) both.

A soft sub-cell for a unit cell 405 can be a sub-cell for a first lattice structure and a stiff sub-cell for the unit cells 405 can be a sub-cell for a second lattice structure different from the first lattice structure. In some embodiments, the first lattice structure can be an isotropic lattice structure. In some embodiments, the second lattice structure can be an isotropic lattice structure. In some embodiments, the first lattice structure and the second lattice structure can be isotropic lattice structures. Exemplary isotropic lattice structures include, but are not limited to, those described in U.S. Publication No. 2022/0110406, published on Apr. 14, 2022, which is hereby incorporated by reference in its entirety.

In some embodiments, the first lattice structure for soft sub-cells can have a first modeled compressive modulus and the second lattice structure for stiff sub-cells can have a second modeled compressive modulus 15% or more greater than the first modeled compressive modulus. In some embodiments, the first lattice structure for soft sub-cells can have a first modeled compressive modulus and the second lattice structure for stiff sub-cells can have a second modeled compressive modulus greater than the first modeled compressive modulus by 15% to 500%, including subranges. For example, the second lattice structure can have a second modeled compressive modulus that is 15% to 500% greater than the first modeled compressive modulus, 15% to 400% greater than the first modeled compressive modulus, 15% to 200% greater than the first modeled compressive modulus, 15% to 100% greater than the first modeled compressive modulus, 100% to 500% greater than the first modeled compressive modulus, or 200% to 500% greater than the first modeled compressive modulus, or within a range having any two of these values as endpoints.

In some embodiments, the first lattice structure for soft sub-cells can have a first modeled shear modulus and the second lattice structure for stiff sub-cells can have a second modeled shear modulus 15% or more greater than the first modeled shear modulus. In some embodiments, the first lattice structure for soft sub-cells can have a first modeled shear modulus and the second lattice structure for stiff sub-cells can have a second modeled shear modulus greater than the first modeled shear modulus by 15% to 500%, including subranges. For example, the second lattice structure can have a second modeled shear modulus that is 15% to 500% greater than the first modeled shear modulus, 15% to 400% greater than the first modeled shear modulus, 15% to 200% greater than the first modeled shear modulus, 15% to 100% greater than the first modeled shear modulus, 100% to 500% greater than the first modeled shear modulus, or 200% to 500% greater than the first modeled shear modulus, or within a range having any two of these values as endpoints.

As used herein, a "modeled compressive modulus" and a "modeled shear modulus" for a lattice structure are determined using the following model. A beam model simulation of a unit cell puck is modeled using FEA modeling software. Suitable FEA modeling software includes Abaqus FEA modeling software. For model efficiency purposes, a unit cell puck as small as a 3×3×1 unit cell puck can be used. A 3×3×1 unit cell puck includes one layer of 3 longitudinal rows of 3 unit cells arranged and adjacent to each other in the transverse direction as described herein. Other unit cell puck sizes can be used as long as the same size is used when comparing a modeled compressive modulus or a modeled shear modulus for two or more lattice structures. The unit cell puck is modeled as being sandwiched between and in contact with a top plate and a bottom plate. The following parameters were input into the FEA modeling software for the simulation: (1) material characteristics of the modeled struts for the unit cell puck (including density and elastic material properties), (2) the loading conditions, and (3) the contact mechanics between the unit cell puck and the two plates (including the frictional properties).

To determine a "modeled compressive modulus," a uniaxial compression load is applied by compressing the puck up to 50% strain using the top plate and capturing the resulting stress-strain curve. The modeled compressive modulus is calculated by measuring the slope of the stress-strain curve in the elastic deformation region.

To determine a "modeled shear modulus" the top plate is compressed with a 45-degree angle from the horizontal plane and the resulting stress-strain curve is captured. The modeled shear modulus is calculated by measuring the slope of the stress-strain curve in the elastic deformation region.

Figure 4B:
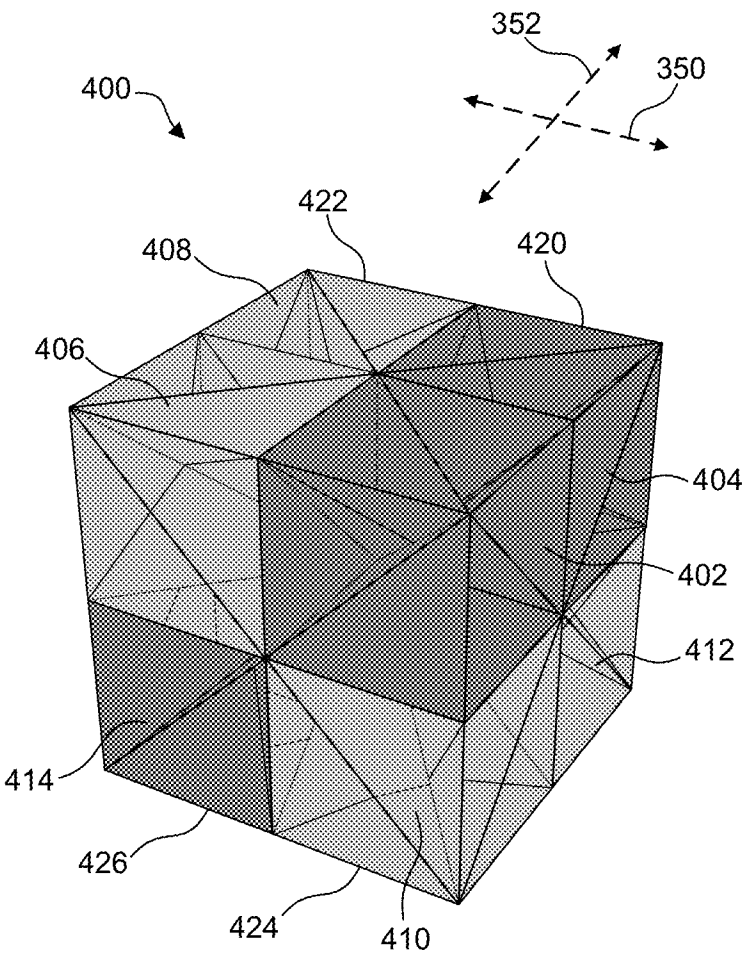
FIG. 4B is a second perspective of the lattice cell shown in FIG. 4A.
Figure 4A:
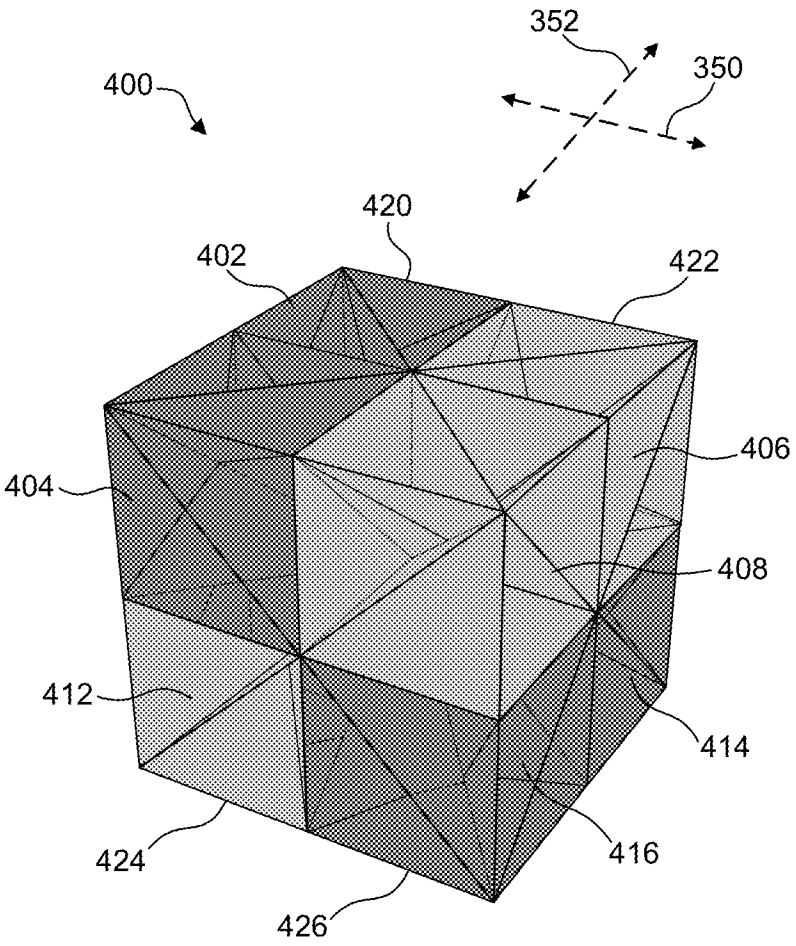
FIG. 4A is a first perspective view of a lattice cell according to some embodiments.

By arranging soft sub-cells and stiff-sub cells at different locations in unit cells 405, the mechanical properties of the unit cell 405, and therefore three-dimensional mesh 320, can be controlled. As discussed above, unit cells 405 for a three-dimensional mesh 320 can be populated and arranged in lattice cells for a lattice framework defining the volume of a three-dimensional mesh 320. The location of soft sub-cells and stiff sub-cells in unit cells 405 can be defined by the location of the soft sub-cells and the stiff sub-cells in a lattice cell 400 in which a unit cell 405 is populated. FIGS. 4A and 4B show a lattice cell 400 according to some embodiments. FIGS. 5A and 5B show a unit cell 405 composed of soft sub-cells 430 and stiff sub-cells 440 located in lattice cell 400 according to some embodiments.

In some embodiments, the location of soft sub-cells and stiff sub-cells in a lattice cell 400 can be defined by the location of one or more soft sub-cells and one or more stiff sub-cells in two or more of the following quadrants of lattice cell 400: (i) an upper-forward quadrant 420, (ii) an upper-rearward quadrant 422, (iii) a lower-forward quadrant 424, and (iv) a lower-rearward quadrant 426. Upper-forward quadrant 420 and upper-rearward quadrant 422 are the two upper-most quadrants of lattice cell 400 in upward vertical direction 354. Upper-forward quadrant 420 and upper-rearward quadrant 422 are located above lower-forward quadrant 424 and lower-rearward quadrant 426, respectively. Upper-forward quadrant 420 and lower-forward quadrant 424 are the two forward-most quadrants of lattice cell 400 in forward longitudinal direction 350. Upper-forward quadrant 420 and lower-forward quadrant 424 are located forward of upper-rearward quadrant 422 and lower-rearward quadrant 426, respectively. A unit cell 405 populated in a lattice cell 400 can also be described as having an upper-forward quadrant 420, an upper-rearward quadrant 422, a lower-forward quadrant 424, and a lower-rearward quadrant 426.

In some embodiments, unit cells 405 of three-dimensional mesh 320 can include one or more soft sub-cells located in upper-forward quadrant 420. In some embodiments, unit cells 405 of three-dimensional mesh 320 can include two soft sub-cells located in upper-forward quadrant 420.

In some embodiments, unit cells 405 of three-dimensional mesh 320 can include one or more stiff sub-cells located in upper-forward quadrant 420. In some embodiments, unit cells 405 of three-dimensional mesh 320 can include two stiff sub-cells located in upper-forward quadrant 420.

In some embodiments, unit cells 405 of three-dimensional mesh 320 can include one or more soft sub-cells located in upper-rearward quadrant 422. In some embodiments, unit cells 405 of three-dimensional mesh 320 can include two soft sub-cells located in upper-rearward quadrant 422.

In some embodiments, unit cells 405 of three-dimensional mesh 320 can include one or more stiff sub-cells located in upper-rearward quadrant 422. In some embodiments, unit cells 405 of three-dimensional mesh 320 can include two stiff sub-cells located in upper-rearward quadrant 422.

In some embodiments, unit cells 405 of three-dimensional mesh 320 can include one or more soft sub-cells located in lower-forward quadrant 424. In some embodiments, unit cells 405 of three-dimensional mesh 320 can include two soft sub-cells located in lower-forward quadrant 424.

In some embodiments, unit cells 405 of three-dimensional mesh 320 can include one or more stiff sub-cells located in lower-forward quadrant 424. In some embodiments, unit cells 405 of three-dimensional mesh 320 can include two stiff sub-cells located in lower-forward quadrant 424.

In some embodiments, unit cells 405 of three-dimensional mesh 320 can include one or more soft sub-cells located in lower-rearward quadrant 426. In some embodiments, unit cells 405 of three-dimensional mesh 320 can include two soft sub-cells located in lower-rearward quadrant 426.

In some embodiments, unit cells 405 of three-dimensional mesh 320 can include one or more stiff sub-cells located in lower-rearward quadrant 426. In some embodiments, unit cells 405 of three-dimensional mesh 320 can include two stiff sub-cells located in lower-rearward quadrant 426.

In some embodiments, unit cells 405 of three-dimensional mesh 320 can include the following sub-cells: (i) at least one soft sub-cell located in the upper-forward quadrant 420, (ii) at least one stiff sub-cell located in the upper-rearward quadrant 422, (iii) at least one stiff sub-cell located in the lower-forward quadrant 424, and (iv) at least one soft sub-cell located in the lower-rearward quadrant 426. In such embodiments, this arrangement of soft and stiff sub-cells can result in a three-dimensional mesh 320 capable of converting vertical loading energy into forward displacement, which can propel a wearer's foot forward when a sole including the three-dimensional mesh 320 contacts the ground during use. In other words, this arrangement of soft and stiff sub-cells can result in a three-dimensional mesh 320 predisposed to deform forwards (i.e., in forward longitudinal direction 350) when a sole including the three-dimensional mesh 320 contacts the ground.

The opposite result can be achieved by rotating the orientation of the unit cells 405 by 180°. In such embodiments, unit cells 405 of three-dimensional mesh 320 can include the following sub-cells: (i) at least one stiff sub-cell located in the upper-forward quadrant 420, (ii) at least one soft sub-cell located in the upper-rearward quadrant 422, (iii) at least one soft sub-cell located in the lower-forward quadrant 424, and (iv) at least one stiff sub-cell located in the lower-rearward quadrant 426. In such embodiments, this arrangement of soft and stiff sub-cells can result in a three-dimensional mesh 320 that is predisposed to deform rearwards (i.e., in rearward longitudinal direction 350) when a sole including the three-dimensional mesh 320 contacts the ground.

FIGS. 5A and 5B show a lattice cell 400 populated with soft sub-cells 430 and stiff sub-cells 440 for a unit cell 405 according to some embodiments. The unit cell 405 shown includes: (i) two soft sub-cells 430 located side-by-side in the upper-forward quadrant 420, (ii) two stiff sub-cells 440 located side-by-side in the upper-rearward quadrant 422, (iii) two stiff sub-cells 440 located in the lower-forward quadrant 424, and (iv) two soft sub-cells 430 located in the lower-rearward quadrant 426. This arrangement of soft and stiff sub-cells can result in a three-dimensional mesh 320 that is predisposed to deform forwards (i.e., in forward longitudinal direction 350) when a sole including the three-dimensional mesh 320 contacts the ground.

In some embodiments, the location of soft sub-cells and stiff sub-cells in a lattice cell 400 can be defined by the location of a soft sub-cell or a stiff sub-cell in two or more of the following eight zones of lattice cell 400: (i) an upper-forward-medial zone 402, (ii) an upper-forward-lateral zone 404, (iii) an upper-rearward-medial zone 406, (iv) an upper-rearward-lateral zone 408, (v) a lower-forward-medial zone 410, (vi) a lower-forward-lateral zone 412, (vii) a lower-rearward-medial zone 414, and (viii) a lower-rearward-lateral zone 416. Upper-forward-medial zone 402 and upper-forward-lateral zone 404 are located in upper-forward quadrant 420 of lattice cell 400, with zone 402 located medially to zone 404 in transverse direction 352. Upper-rearward-medial zone 406 and upper-rearward-lateral zone 408 are located in upper-rearward quadrant 422 of lattice cell 400, with zone 406 located medially to zone 408 in transverse direction 352. Lower-forward-medial zone 410 and lower-forward-lateral zone 412 are located in lower-forward quadrant 424 of lattice cell 400, with zone 410 located medially to zone 412 in transverse direction 352. Lower-rearward-medial zone 414 and lower-rearward-lateral zone 416 are located in lower-rearward quadrant 426 of lattice cell 400, with zone 414 located medially to zone 416 in transverse direction 352.

A sub-cell located in upper-forward-medial zone 402 can be referred to as an upper-forward-medial sub-cell. In some embodiments, an upper-forward-medial sub-cell can be a soft sub-cell. In some embodiments, an upper-forward-medial sub-cell can be a stiff sub-cell.

A sub-cell located in upper-forward-lateral zone 404 can be referred to as an upper-forward-lateral sub-cell. In some embodiments, an upper-forward-lateral sub-cell can be a soft sub-cell. In some embodiments, an upper-forward-lateral sub-cell can be a stiff sub-cell.

A sub-cell located in upper-rearward-medial zone 406 can be referred to as an upper-rearward-medial sub-cell. In some embodiments, an upper-rearward-medial sub-cell can be a soft sub-cell. In some embodiments, an upper-rearward-medial sub-cell can be a stiff sub-cell.

A sub-cell located in upper-rearward-lateral zone 408 can be referred to as an upper-rearward-lateral sub-cell. In some embodiments, an upper-rearward-lateral sub-cell can be a soft sub-cell. In some embodiments, an upper-rearward-lateral sub-cell can be a stiff sub-cell.

A sub-cell located in lower-forward-medial zone 410 can be referred to as a lower-forward-medial sub-cell. In some embodiments, a lower-forward-medial sub-cell can be a soft sub-cell. In some embodiments, a lower-forward-medial sub-cell can be a stiff sub-cell.

A sub-cell located in lower-forward-lateral zone 412 can be referred to as a lower-forward-lateral sub-cell. In some embodiments, a lower-forward-lateral sub-cell can be a soft sub-cell. In some embodiments, a lower-forward-lateral sub-cell can be a stiff sub-cell.

A sub-cell located in lower-rearward-medial zone 414 can be referred to as a lower-rearward-medial sub-cell. In some embodiments, a lower-rearward-medial sub-cell can be a soft sub-cell. In some embodiments, a lower-rearward-medial sub-cell can be a stiff sub-cell.

A sub-cell located in lower-rearward-lateral zone 416 can be referred to as a lower-rearward-lateral sub-cell. In some embodiments, a lower-rearward lateral sub-cell can be a soft sub-cell. In some embodiments, a lower-rearward lateral sub-cell can be a stiff sub-cell.

FIGS. 5A and 5B show lattice cell 400 populated with four soft sub-cells 430 and four stiff sub-cells 440 for a unit cell 405 according to some embodiments. The unit cell 405 shown includes: (i) an upper-forward-medial soft sub-cell 430 located in upper-forward-medial zone 402, (ii) an upper-forward-lateral soft sub-cell 430 located in upper-forward-lateral zone 404, (iii) an upper-rearward-medial stiff sub-cell 440 located in upper-rearward-medial zone 406, (iv) an upper-rearward-lateral stiff sub-cell 440 located in upper-rearward-lateral zone 408, (v) a lower-forward-medial stiff sub-cell 440 located in lower-forward-medial zone 410, (vi) a lower-forward-lateral stiff sub-cell 440 located in lower-forward-lateral zone 412, (vii) a lower-rearward-medial soft sub-cell 430 located in lower-rearward-medial zone 414, and (viii) a lower-rearward-lateral soft-sub cell 430 located in lower-rearward-lateral zone 416.

Sub-cells populated in lattice cell 400 can include struts 330 connected at a plurality of edge nodes 460 located at edges of lattice cell 400. In some embodiments, sub-cells populated lattice cell 400 can include struts 330 connected at a plurality of face nodes 462 located on faces of lattice cell 400. For structural integrity of mesh 320, it is preferred to populate lattice cells 400 with soft and stiff sub-cells that share the same edge nodes 460, and in embodiments including face nodes 462, that share the same face nodes 462. If soft and stiff sub-cells that do not share the same edge nodes 460 and/or face nodes 462 are populated into lattice cell 400, it can result in a unit cell with one or more struts 330 not connected to another strut 330 within mesh 320.

By arranging soft and stiff sub-cells in any of the various combinations discussed above, mechanical properties of three-dimensional mesh 320, or an anisotropic region thereof, can be manipulated and leveraged to create desired performance characteristics for three-dimensional mesh 320. Exemplary mechanical properties that be manipulated and leveraged include, but are not limited to, lattice shear moduli in different directions and lattice compressive modulus. The position of soft and stiff sub-cells in the different zones and quadrants of lattice cell 400 can influence the mechanical properties of unit cells 405, and therefore three-dimensional mesh 320, in different directions. In some embodiments, soft and stiff sub-cells can be positioned to create unit cells 405 that result in a three-dimensional mesh 320 with different lattice shear moduli in forward and rearward directions. In some embodiments, soft and stiff sub-cells can be positioned to create unit cells 405 that result in a three-dimensional mesh 320 with different lattice shear moduli in a medial and lateral directions.

Figure 6A:
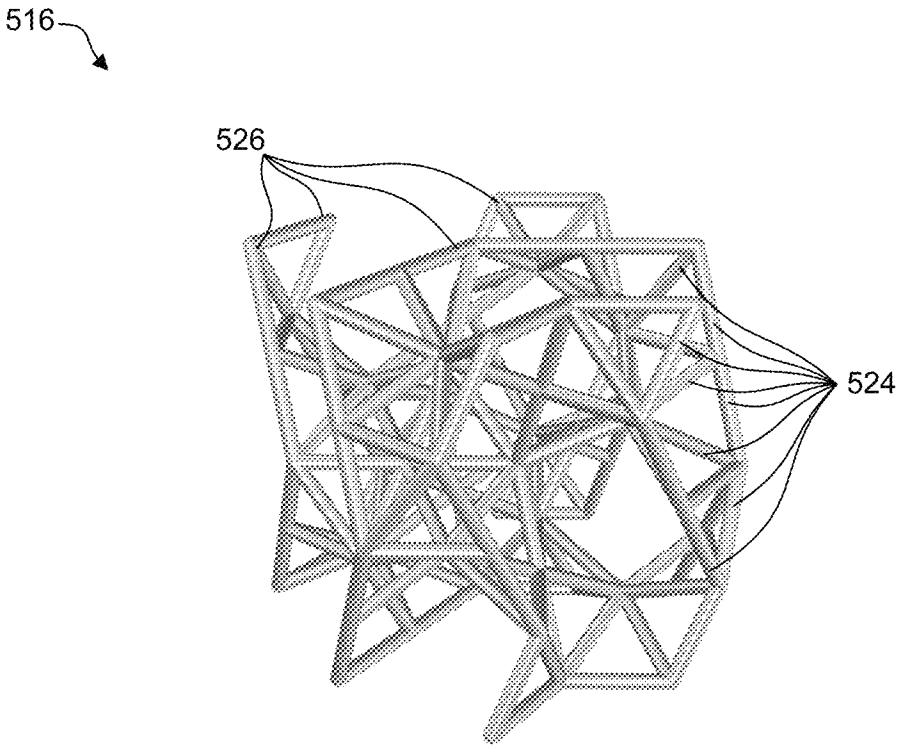
FIG. 6A is a perspective view of a unit cell according to some embodiments.

In some embodiments, unit cells, such as unit cells 322 described above, can be a unit cell having a base strut geometry that approximates the overall shape of an implicit surface. FIG. 6A shows a unit cell 516 including a structure of struts 524 and nodes 526 having a base strut geometry that approximates the overall shape of an implicit surface according to some embodiments. The arrangement of struts 524 in unit cell 516 form a base strut geometry that approximates the overall shape of an implicit surface. In some embodiments, unit cells having a base strut geometry that approximates the overall shape of an implicit surface, such as unit cell 516, can provide useful mechanical properties associated with the approximated implicit surface, such as high specific stiffness, at a relatively low weight due to the relatively small amount of material used to manufacture unit cell 516. In further embodiments, unit cells having a base strut geometry that approximates the overall shape of an implicit surface, such as unit cell 516, can provide better mechanical properties than a unit cell having a complete solid representation of the implicit surface, such as any one or any combination of, for example, greater stiffness per unit weight and greater 50% stiffness. As used herein, 50% stiffness refers to the stiffness exhibited by a sample in deformation from an unloaded state to a state that is halfway between the unloaded state and the sample's elastic limit. An article including a lattice of unit cells 516 or unit cells that similarly approximate an implicit surface with struts 524 and nodes 526 can therefore have desirable mechanical properties and a low total weight. In some embodiments, a midsole for a shoe, such as the midsole 130 illustrated in FIGS. 1 and 2 and described above, that includes a mesh or lattice of unit cells 516 or unit cells that similarly approximate an implicit surface can lend the shoe mechanical properties desirable for running shoes while adding relatively little to the shoe's total weight.

A base strut geometry that approximates the overall shape of an implicit surface in the manner that the base strut geometry of unit cell 516 approximates the overall shape of an implicit surface can be designed in a process that includes identifying the implicit surface to be approximates, representing the implicit surface with polygons, and placing struts along edges of the polygons. The process can be applied to any implicit surface. The implicit surface identified to be approximated can therefore depend on the desired properties for a lattice to be made from the unit cells resulting from the design process. A polygon mesh representation of the implicit surface can then be created. The creation of the polygon mesh can optionally include representing the polygon mesh as a digital model, though modeling the mesh is not a necessary step of the design process. The creation of the polygon mesh in any embodiment of the present disclosure can be done according to any method usable for converting a curved surface to a polygon mesh, including, in some embodiments, any known process used for representing curved surfaces in computer graphics. For example, any polygon mesh mentioned herein can be created by any process for creating a polygon mesh from a shape or surface. Certain such processes are known, for example, in the field of computer rendering, though suitable meshing processes for the purposes of the present disclosure are not limited thereto. The base strut geometry can then be defined by placing a strut along each edge of each polygon in the polygon mesh. Each strut can have the same endpoints as the edge along which the strut is placed. A node can be placed at every vertex where two edges of any polygon meet.

Figure 6B:
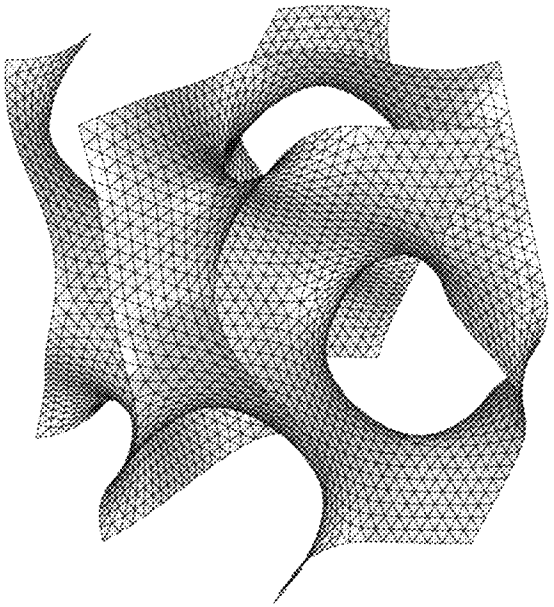
FIG. 6B is a perspective view of a first polygon mesh of an implicit surface according to some embodiments.

FIG. 6B is a polygon mesh 510 of an implicit surface unit cell according to an embodiment. In some embodiments, the implicit surface can be a periodic implicit surface such that, in a lattice populated by unit cells each having a base surface geometry in the shape of the implicit surface, the base surface geometry of each unit cell would contact the base surface geometry of at least some adjacent unit cells to create a lattice of interconnected unit cells. In some embodiments, the implicit surface base geometry can contact the implicit surface base geometry of at least two neighboring unit cells to create a lattice. One example of a suitable periodic surface is a gyroid, but in various embodiments any type of periodic surface can be used.

A method of manufacturing a strut based geometry derived from the implicit surface can include approximating the implicit surface with a polygon mesh such as the polygon mesh 510. Polygon mesh 510 is a digital approximation of the implicit surface made of several polygons.

In the illustrated example, the polygons are triangles, though the mesh could be made of other polygons in other examples. Polygon mesh 510 of FIG. 6B is a relatively high count polygon mesh 510, meaning it has a relatively large number of polygons relative to the scale of the implicit surface it is used to approximate.

Low count polygon mesh 512 approximates the implicit surface less closely than the relatively high count polygon mesh 510, but with a smaller number of larger polygons 520. Polygons 520 of the illustrated example are also triangles, though polygons 520 can be other polygons in other examples. The size of polygons 520 in a polygon mesh used as a basis for unit cell 516 can be selected, for example, to achieve desired mechanical properties of the resulting unit cell 516, to make the resulting unit cell 516 possible to manufacture efficiently, or a combination of both. The illustrated example shown in FIGS. 6A, 6C, and 6D and described herein relates to deriving unit cell 516 from low count polygon mesh 514, but in various embodiments unit cell 516 can be derived from a polygon mesh having relatively more, smaller polygons or relatively few, larger polygons as appropriate for the objectives of any implementation of the present disclosure. Thus, the high count polygon mesh 510 and low count polygon mesh 512 are compared herein to show differences how a single implicit surface unit cell can be approximated using meshes of polygons of various sizes, but the concepts of the present disclosure may be implemented with meshes of polygons having proportions to the size of the unit cell that differ from any example shown herein. Polygon meshes having various quantities of polygons 520 per unit area can be used for any of the applications described herein, such as for providing a basis from which a base strut geometry can be derived as described below. In some embodiments, polygon meshes for these purposes can have from 1 polygon per 5 square mm to 1 polygon per 100 square mm. In further embodiments, polygon meshes for these purposes can have from 1 polygon per 10 square mm to 1 polygon per 60 mm. In further embodiments, polygon meshes for these purposes can have about 50 polygons per 500 square mm. In further embodiments, polygon meshes for these purposes can have about 5 polygons per 300 square mm.

Any polygon mesh described herein can be a geometry constructed entirely of unit polygons. Optionally, every unit polygon in any polygon mesh mentioned herein may be identical in shape and size. Thus, to any extent polygons of different shapes and sizes may be found in a polygon mesh constructed of identical unit polygons, those polygons of different shapes and sizes can themselves be constructed of multiple unit polygons. In some embodiments, the unit polygons can be triangles. In some embodiments, the unit polygons can be equilateral triangles.

Figure 6C:
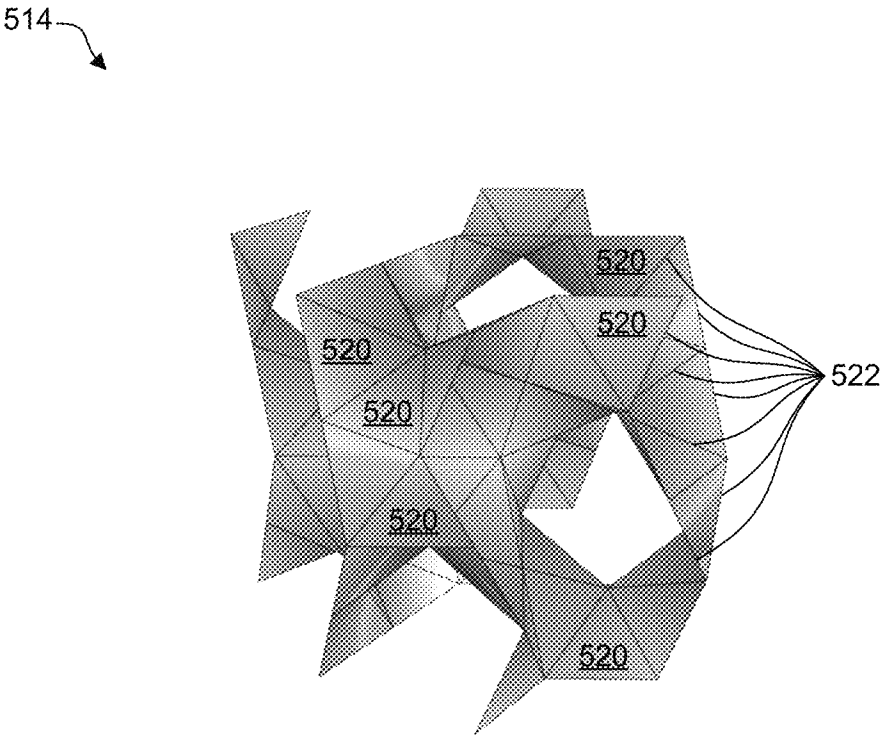
FIG. 6C is a perspective view of a second polygon mesh of an implicit surface according to some embodiments.

Low count polygon mesh 514 can be found either by first creating a high count polygon mesh 510 then converting the high count polygon mesh 510 to a low count polygon mesh 512, as shown by FIGS. 6B and 6C in sequence, or by directly approximating the implicit surface with polygon mesh 514 having the intended polygon size for the end product without first passing through meshes having polygons of any other sizes.

Each polygon 520 is defined between edges 522. Because polygons 520 of the illustrated example are triangles, each polygon 520 has three edges 522, though polygons 520 of other embodiments can be non-triangular polygons having a different number of edges 522. Edges 522 divide each polygon 520 from its neighboring polygons 520 such that some edges 522 are shared between two polygons 520. The number of edges 522 in the polygon mesh 514 of the illustrated embodiment is therefore less than three times the number of polygons 520, even though each polygon 520 in the illustrated embodiment has three edges 522.

Figure 6D:
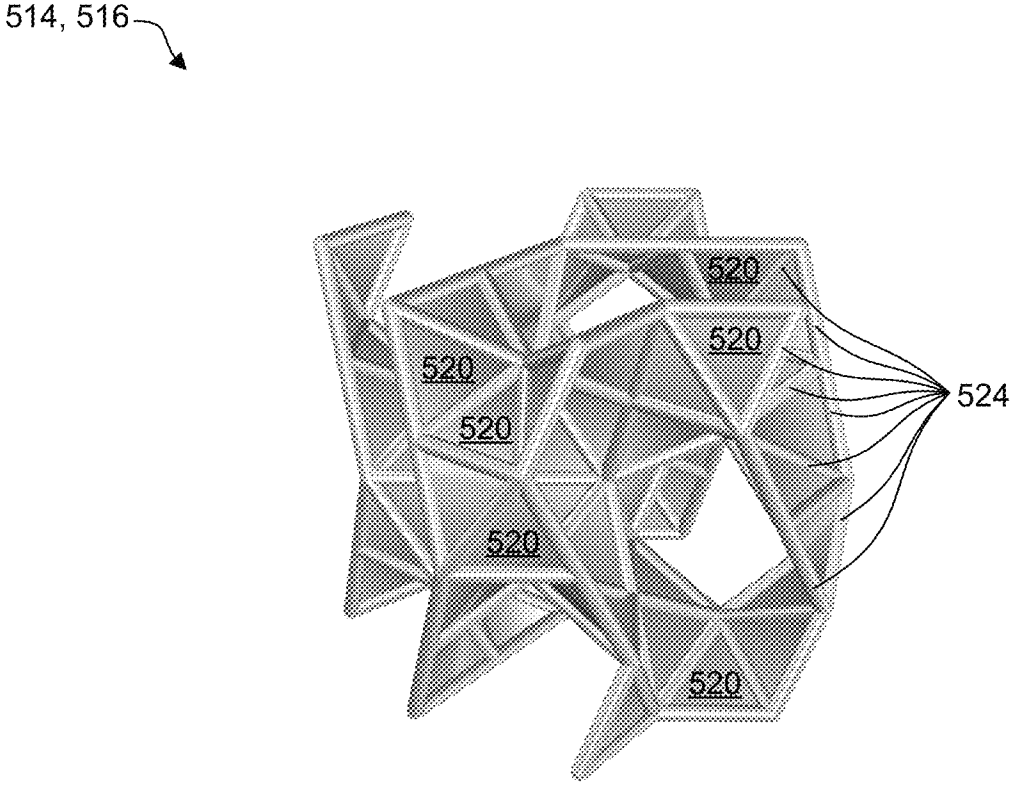
FIG. 6D is a perspective view of the unit cell of FIG. 6A overlaid on the second polygon mesh of FIG. 6C.

FIG. 6D illustrates a unit cell 516 of a lattice structure overlaid on the polygon mesh 514. Unit cell 516 includes a plurality of struts 524 that meet one another at nodes 526. Struts 524 are each aligned on an edge 522 of the polygon mesh 514 such that a strut 524 extends along each edge 522. Each strut 524 each extends between the same two points as the edge 522 on which the strut 524 is aligned, meaning each strut 524 is centered on a respective one of the edges 522 and has an equal length to the respective one of the edges 522. In other embodiments, unit cell 516 can have more or fewer struts 524 than the polygon mesh 514 has edges.

Unit cell 516 as described herein can be either a physical object or a three-dimensional digital model of a three-dimensional object. That is, the process for designing a unit cell as described herein can be carried out with computer modeling software. The design process can therefore result in the unit cell 516 as a three-dimensional digital model. The digital model may then be used as a basis for fabricating a physical object, such as, for example, by use of "slicing" software to generate instructions for an additive manufacturing device. The additive manufacturing device can then create the unit cell 516 as a physical object by following the instructions. Accordingly, any properties related to the shape and size of the unit cell 516 illustrated or described herein are true of both the unit cell 516 as a three-dimensional digital model and the unit cell 516 as a physical object unless specified otherwise. Thus, whereas FIG. 6D illustrates unit cell 516 as a digital model overlaid on a digital model of the polygon mesh 514 of an implicit surface to show that the struts 524 align on edges 522 of the polygon mesh 514, the unit cell 516 as a physical object includes struts 524 that have the same spatial and proportional relationship to a theoretical implicit surface positioned in real space.

FIG. 6A depicts the unit cell 516 alone, without the polygon mesh 514. Thus, struts 524 of unit cell 516 as depicted in FIG. 6A remain aligned on edges 522 of polygon mesh 514 even though polygon mesh 514 is not visible in FIG. 6A. The foregoing description of the alignment of struts 524 on edges 522 therefore remains true whether unit cell 516 is a digital model or a physical object. Accordingly, just as struts 524 of a digital model of unit cell 516 are aligned on edges 522 of a digital model of polygon mesh 514 regardless of whether polygon mesh 514 is illustrated together with unit cell 516, a physical object with the form of unit cell 516 will include struts 524 aligned on edges 522 of a theoretical polygon mesh 514 of an implicit surface.

In some embodiments, all of the struts 524 of a unit cell can be aligned on a respective edge 522 of a polygon mesh 514 of an implicit surface such that each strut 524 extends along each edge 522 of the polygon mesh 514. In some embodiments, at least 90% of the struts 524 of a unit cell can be aligned on an edge 522 of a count polygon mesh 514 of an implicit surface such that at least 90% of the struts 524 extend along each edge 522 of the polygon mesh 514. In some embodiments, at least 80% of the struts of a unit cell 516 can be aligned on an edge of a polygon mesh 514 of an implicit surface such that at least 80% of the struts extend along each edge of the polygon mesh 514. In some embodiments, unit cell 516 can include struts 524 aligned on at least 90% of the edges 522 within the low count polygon mesh 514. In some embodiments, unit cell 516 can include struts 524 aligned on at least 80% of the edges 522 within the polygon mesh 514.

Figure 6E:
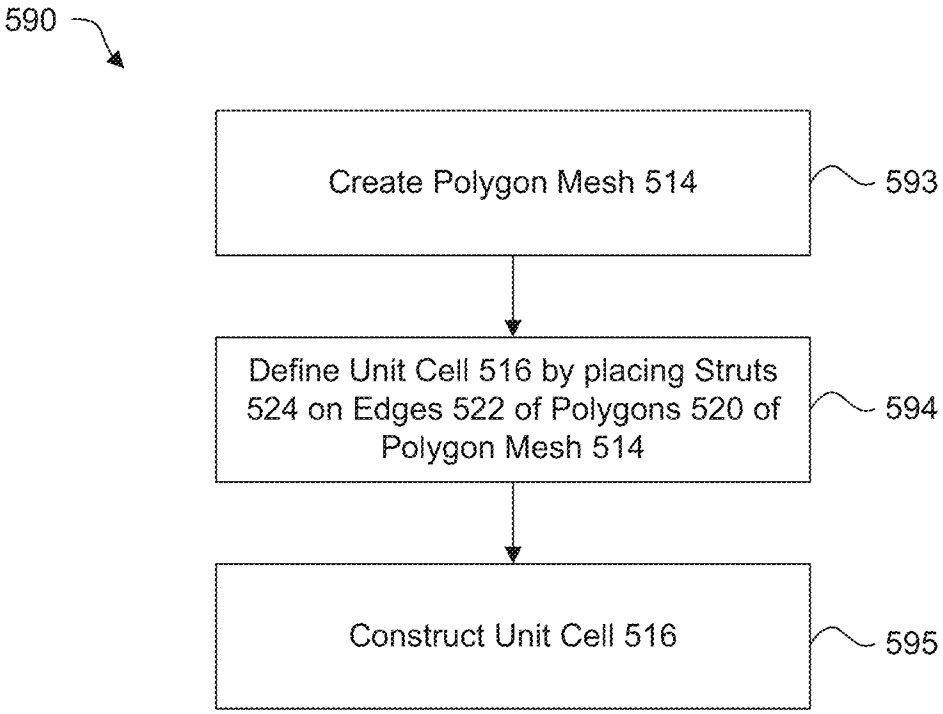
FIG. 6E is a flowchart of a process for manufacturing the unit cell of FIG. 6D.

FIG. 6E illustrates a process 590 of manufacturing a unit cell 516 according to the embodiment of FIGS. 6A-6D. Process 590 includes a creating step 593 wherein a polygon mesh such as polygon mesh 514 of a selected implicit surface is computed. A defining step 594 follows creating step 593 and includes defining unit cell 516 by placing struts 524 on edges 522 of polygons 520 of low count polygon mesh 514. A constructing step 595 follows defining step 594 and includes constructing unit cell 516 as a physical object of solid material, using, for example, an additive manufacturing process as described herein. Process 590 is an example of how a unit cell 516 may be designed and produced, but unit cell 516 can be manufactured by sequences of steps other than the sequence illustrated in FIG. 6E and described above.

In some embodiments wherein the base implicit surface is periodic, the structure of struts 524 extending along edges of the polygon mesh of the implicit surface can also be periodic such that, in a lattice of unit cells 516, the struts 524 of the base strut geometry of each unit cell 516 contact the struts 524 of at least some neighboring unit cells to create a lattice. In some embodiments, the struts 524 of the base geometry of each unit cell 516 can contact struts 524 of at least two neighboring unit cells 516.

Figure 6F:
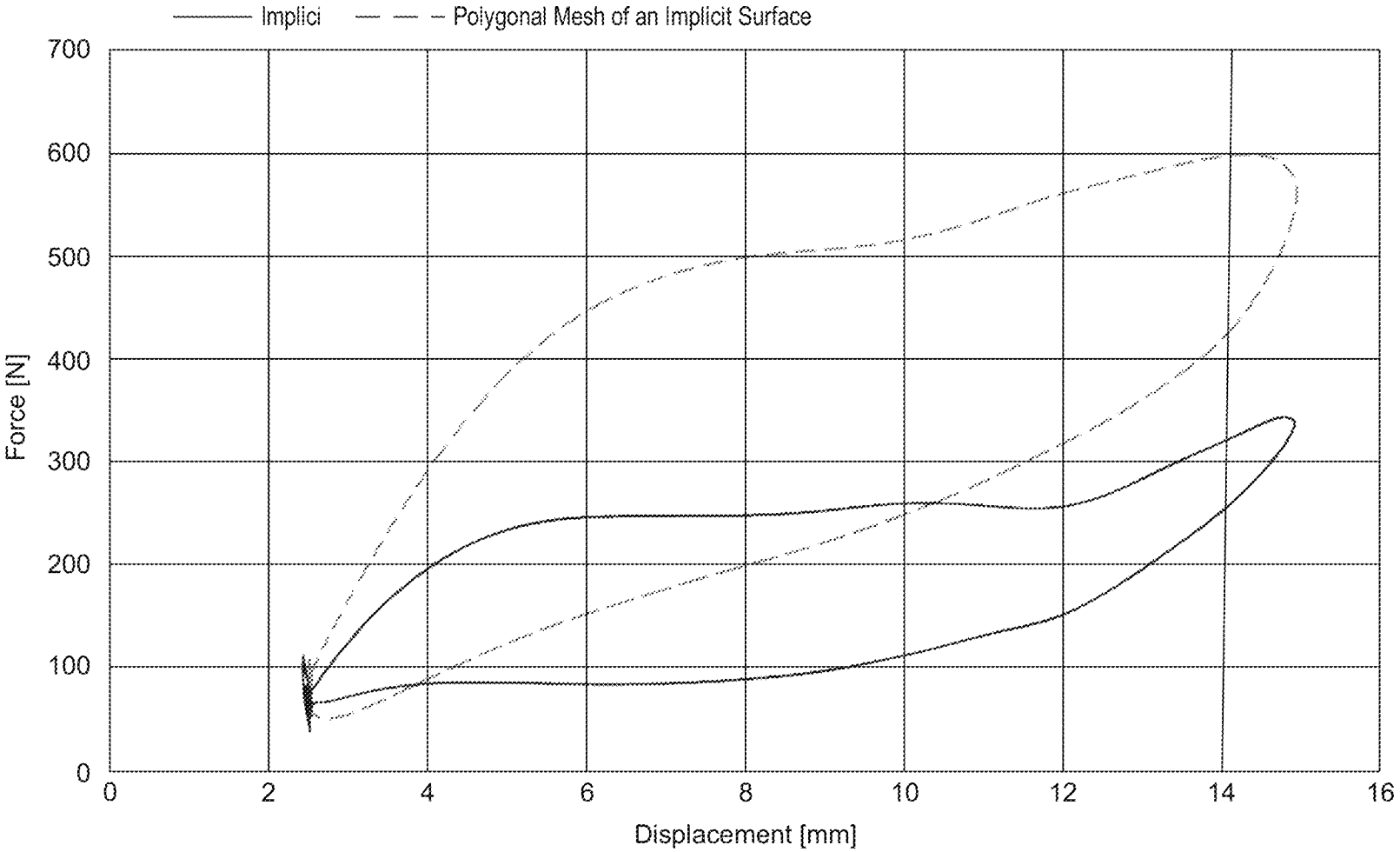
FIG. 6F is a graph showing stress-displacement curves for each of a unit cell of a polygon mesh of an implicit surface and a unit cell of a solid representation of the implicit surface.

FIG. 6F shows the relative force-displacement properties of a lattice of unit cells having base strut geometries approximating an implicit surface and a lattice of unit cells having a base surface geometry of a solid representation of the same implicit surface for compression normal to a forward-backward axis. The unit cells of the lattices used for the test represented in FIG. 6F have the same relative density. As shown in FIG. 6F, a unit cell 516 according to the embodiments described herein having a base strut geometry approximating an implicit surface such as unit cell 516, can have improved mechanical properties for the purpose of a forward-motion promoting midsole compared to a unit cell having a base surface geometry of a solid representation of the corresponding implicit surface. For example, a lattice of unit cells 516 may be stiffer than a lattice of unit cells having a base surface geometry of the implicit surface from which the unit cells 516 are derived.

FIG. 6G presents test results comparing the properties of a lattice of unit cells having a base surface geometry of an implicit surface and a lattice of unit cells, such as unit cell 516, having a base strut geometry derived from the implicit surface according to a method such as process 590 as described herein. The lattices compared in FIG. 6G are the same lattices compared in FIG. 6F. The unit cell having the base strut geometry has less mass than the unit cell having the base surface geometry, but a 50% stiffness value that is more than twice as large. As a result, the unit cell having a base strut geometry has a stiffness/weight ratio that this more than twice as large as the stiffness/weight ratio of the unit cell having the base surface geometry.

In some embodiments, unit cells having base strut geometries can be derived from implicit surfaces by using polygon meshes having different properties than those of the polygon meshes 510, 514 described above. In some embodiments, the polygons may differ from the polygons 520 described above.

Figure 6H:
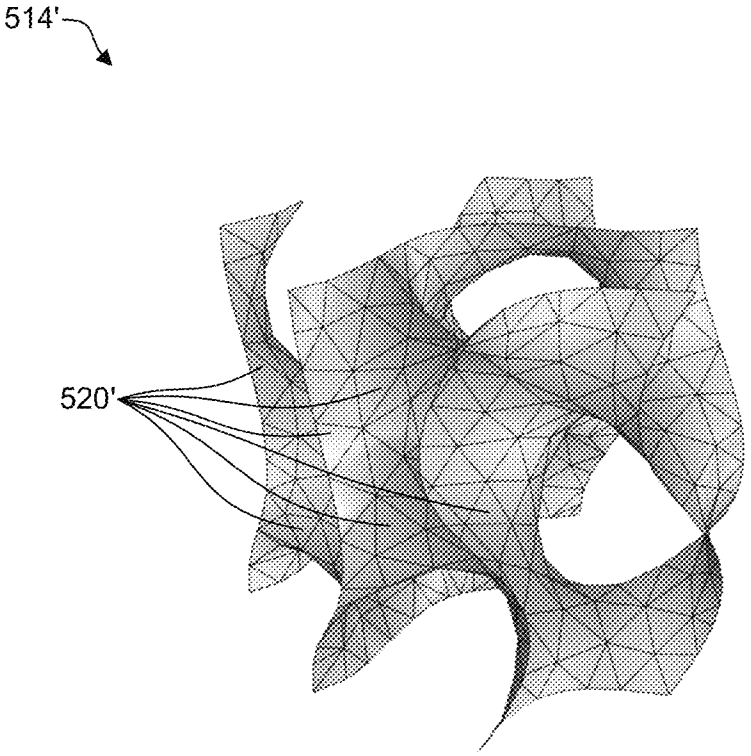
FIG. 6H is a perspective view of a polygon mesh of an implicit surface according to another embodiment.
Figure 6I:
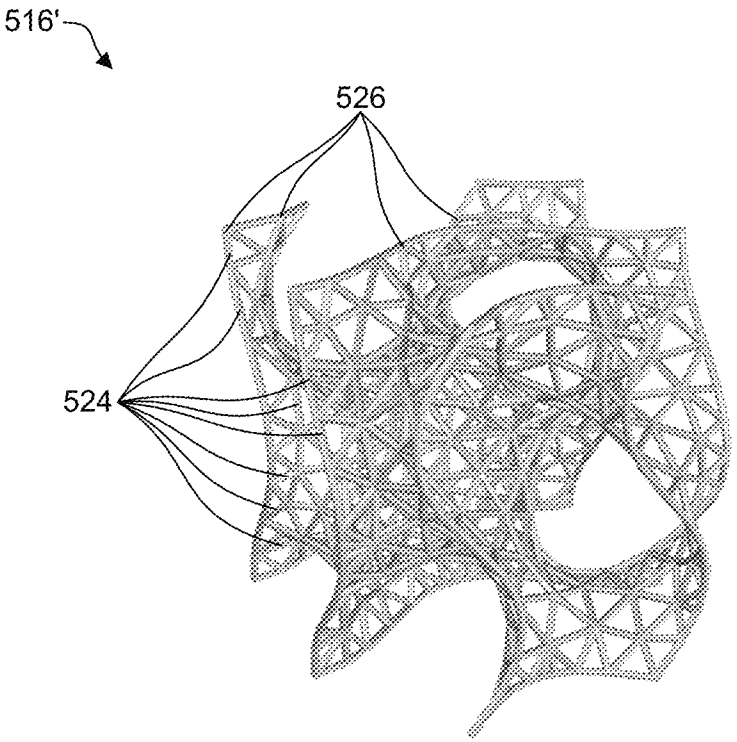
FIG. 6I is a perspective view of a unit cell derived from the polygon mesh of FIG. 6H.

FIG. 6H shows a polygon mesh 514' that approximates the same implicit surface approximated by the polygon meshes 510, 514 described above. Polygon mesh 514' is made of polygons 520'. Polygons 520' are triangles, similar to the triangles of the polygon mesh 510 and the polygons 520 of the polygon mesh 514. However, polygons 520' are larger than the triangles of the polygon mesh 510 and smaller than the polygons 520 of the polygon mesh 514. Polygon mesh 514' therefore has more polygons per unit area than the polygon mesh 514, but fewer polygons per unit area than the polygon mesh 510. Like both above described polygon meshes 510, 514 described above, polygon mesh 514' can be converted to a base strut geometry by methods according to process 590. Thus, by placing struts 524 along the edges of the polygons 520' and placing nodes 526 where the struts meet, a unit cell 516' corresponding to the implicit surface as shown in FIG. 6I can be made.

Figure 6J:
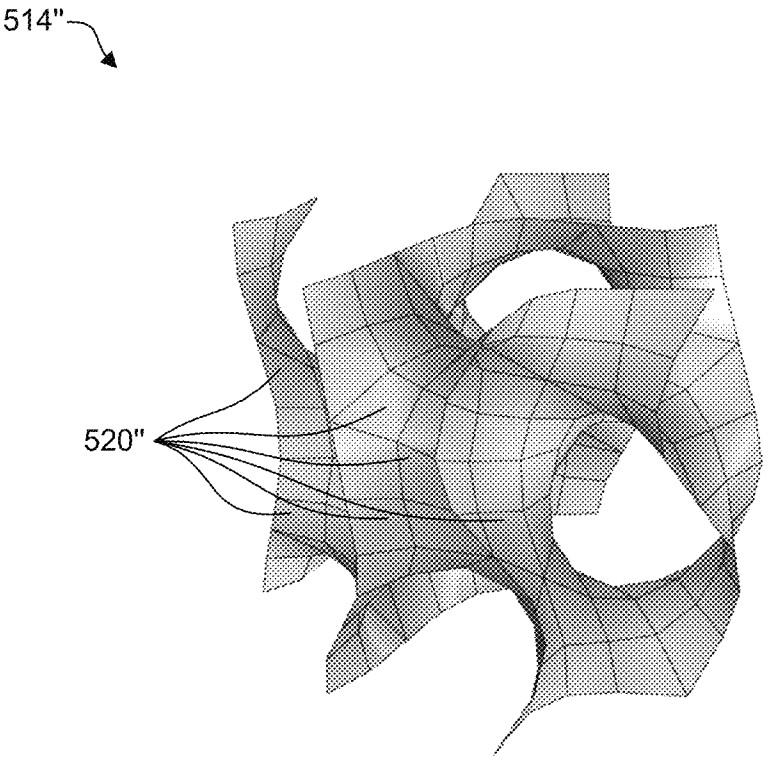
FIG. 6J is a perspective view of a polygon mesh of an implicit surface according to another embodiment.
Figure 6K:
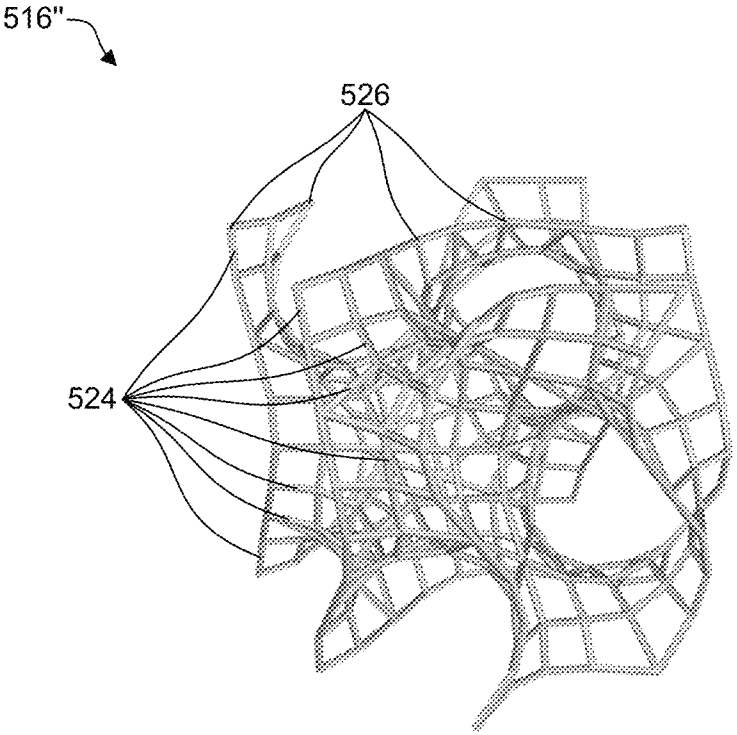
FIG. 6K is a perspective view of a unit cell derived from the polygon mesh of FIG. 6J.

In another embodiment, a polygon mesh 514" can approximate the implicit surface with quadrilateral polygons 520" as shown in FIG. 6J. Like the polygon meshes 510, 514, 514', the polygon mesh 514" can be converted to a unit cell having a base strut geometry corresponding to the implicit surface by using methods according to process 590. Thus, by placing struts 524 along the edges of polygons 520" and placing nodes 526 where the struts meet, a unit cell 516" corresponding to the implicit surface as shown in FIG. 6K can be made.

Figure 6L:
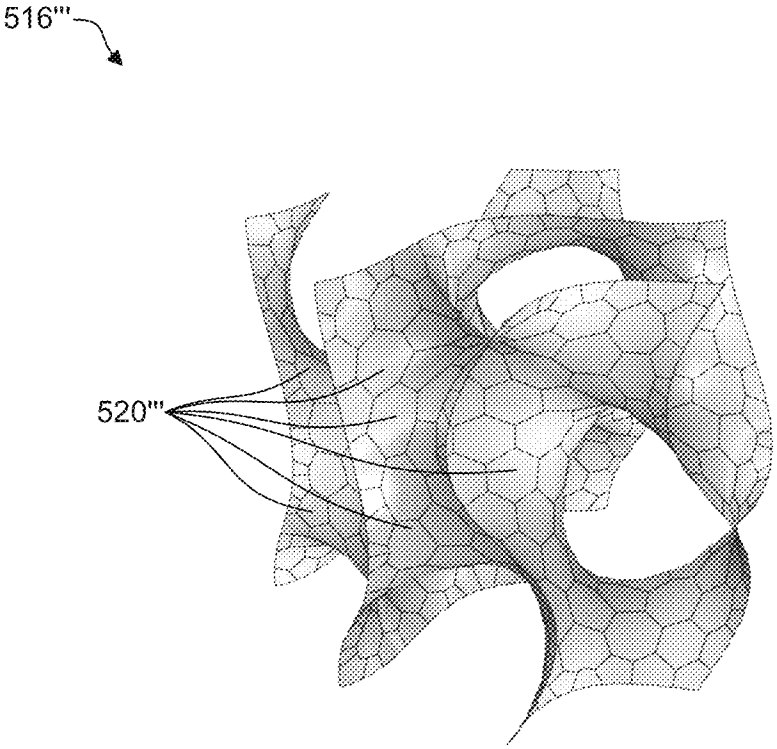
FIG. 6L is a perspective view of a polygon mesh of an implicit surface according to another embodiment.
Figure 6M:
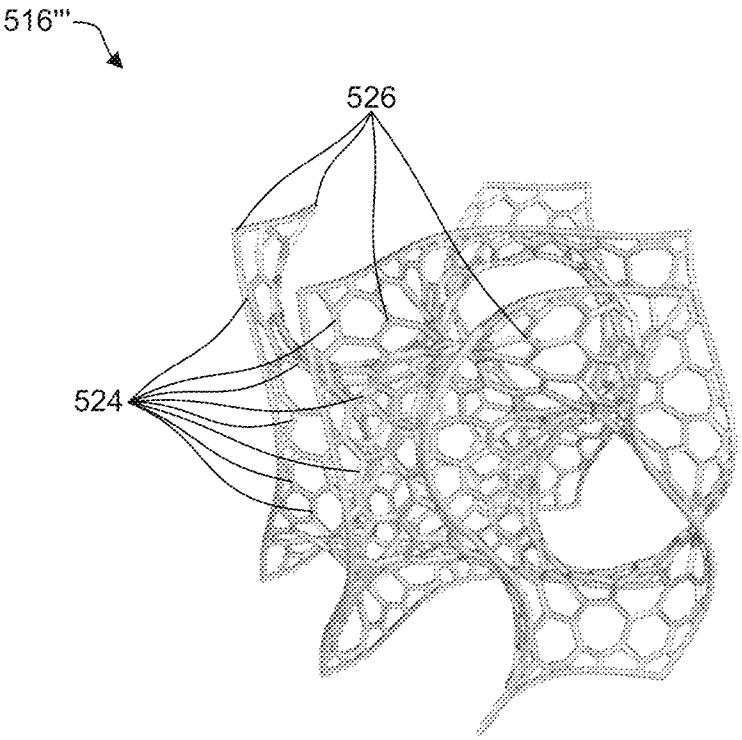
FIG. 6M is a perspective view of a unit cell derived from the polygon mesh of FIG. 6L.

In another embodiment, a polygon mesh 514" can approximate the implicit surface with hexagonal polygons 520'" as shown in FIG. 6L. Like the polygon meshes 510, 514, 514', 514", the polygon mesh 514'" can be converted to a unit cell having a base strut geometry corresponding to the implicit surface by using methods according to process 590. Thus, by placing struts 524 along the edges of polygons 520'" and placing nodes 526 where the struts meet, a unit cell 516'" corresponding to the implicit surface as shown in FIG. 6M can be made.

As demonstrated in the foregoing embodiments, a polygon mesh of an implicit surface for the purpose of being converted to a base strut geometry can be made of any repeatable kind of polygon. Polygons in any such meshes can also be of any size. Such meshes can also be made of any repeatable pattern of polygons. As shown in FIGS. 6L and 6M, any polygons 520'" at the edge of the space within which a unit cell 516'" is to be defined can be truncated, thereby differing in geometry from other polygons in the mesh 514'". Polygons in meshes according to any other embodiment can be similarly truncated at the edge of a space within which a unit cell is to be defined.

In some embodiments, a midsole according to embodiments described herein can include a compound lattice structure including a lattice of unit cells and a skin of cells having geometry that differs from the unit cells. In some embodiments, the unit cells can have a base surface geometry of a solid representation of an implicit surface and the cells of the skin can have a geometry of struts aligned on edges of a theoretical polygon mesh of the implicit surface. In some embodiments, the unit cells can include a base strut geometry being a structure of struts and nodes and the cells of the skin can include struts differing from the base geometry in addition to struts and nodes matching to some or all of the base strut geometry. In some embodiments, the unit cells can include a base strut geometry being a structure of struts in nodes and the skin can include beams extending continuously across multiple cells of the skin. In such embodiments, each cell of the skin intersected by a beam can include both a partial structure of struts and nodes forming a subset of the base strut geometry of the unit cells and additional struts that form geometries not found in the unit cells and connect the beams to the partial structure.

Figure 7A:
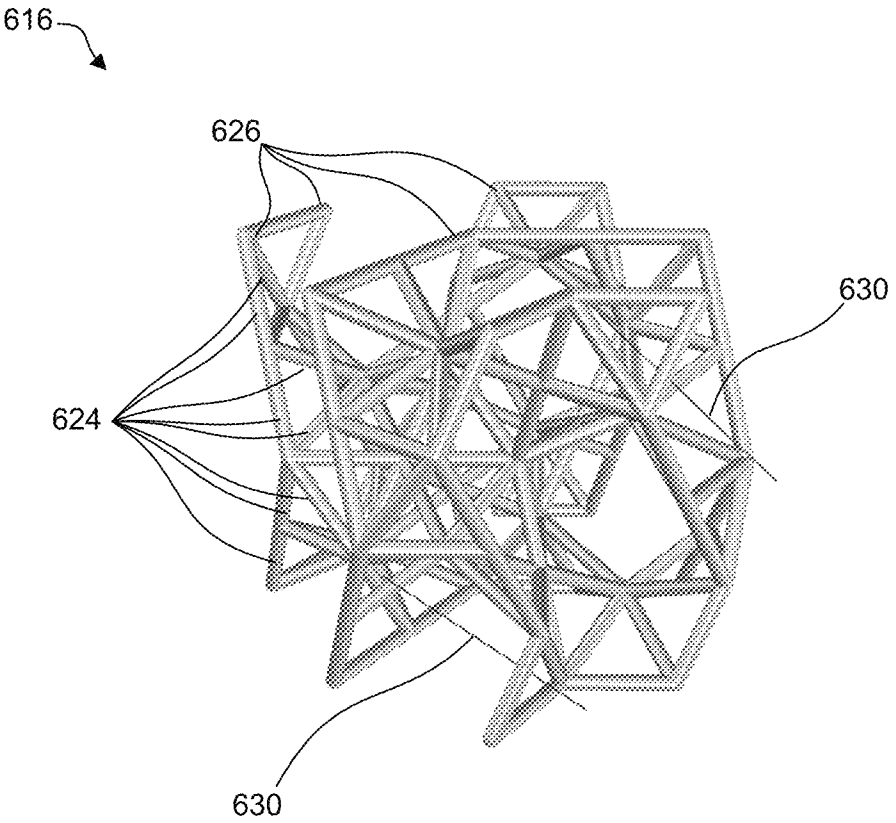
FIG. 7A is a perspective view of a unit cell according to some embodiments.

FIG. 7A illustrates a digital unit cell 616, which can be generally alike to the digital model of unit cell 516 described above. That is, unit cell 616 can optionally be the result of any of the processes described above for creating a digital model of unit cell 516, and unit cell 616 can have any of the properties of the digital model of unit cell 516. Thus, like unit cell 516, unit cell 616 includes struts 624 connected to one another at nodes 626. However, unit cell 616 need not be unit cell 516, and can therefore differ from unit cell 516 in any ways that do not conflict with the following description of unit cell 616.

Figure 7B:
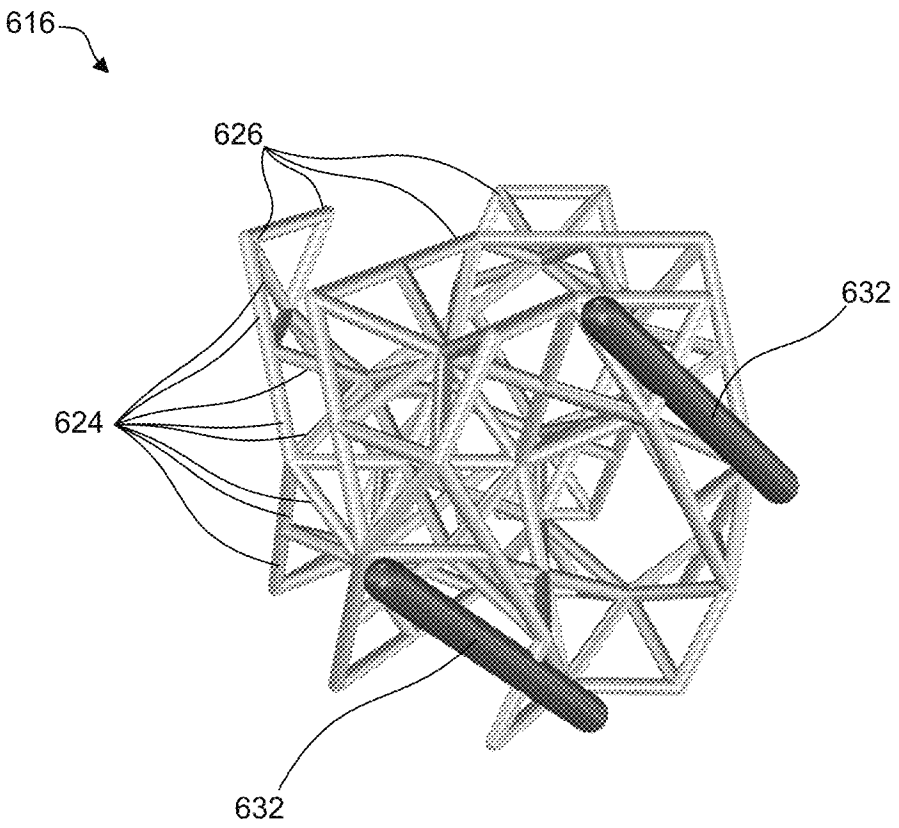
FIG. 7B is a perspective view of a partially modified cell according to some embodiments.
Figure 7C:
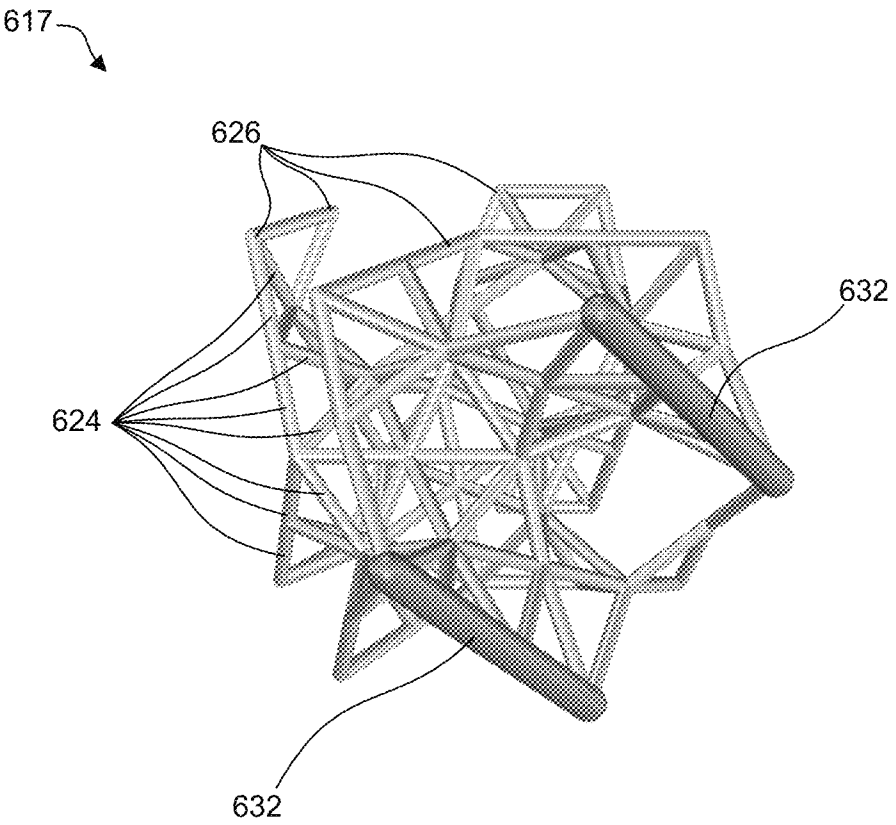
FIG. 7C is a perspective view of the partially modified cell of FIG. 7B with further modifications.
Figure 8A:
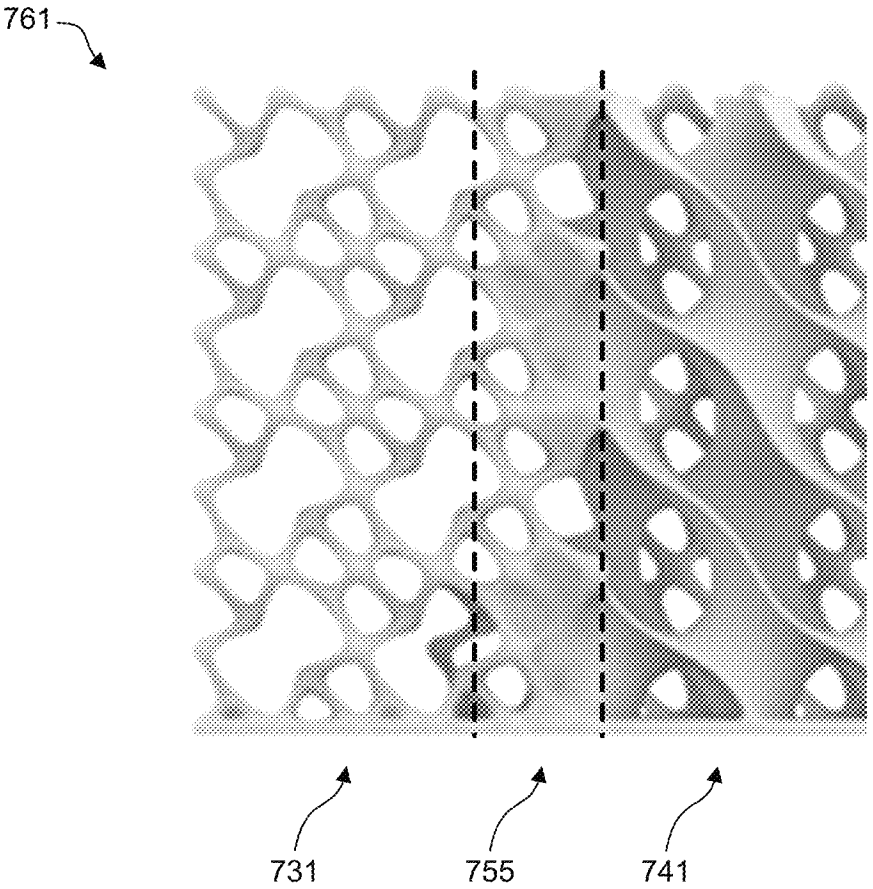
FIG. 8A illustrates a compound lattice according to some embodiments.
Figure 8B:
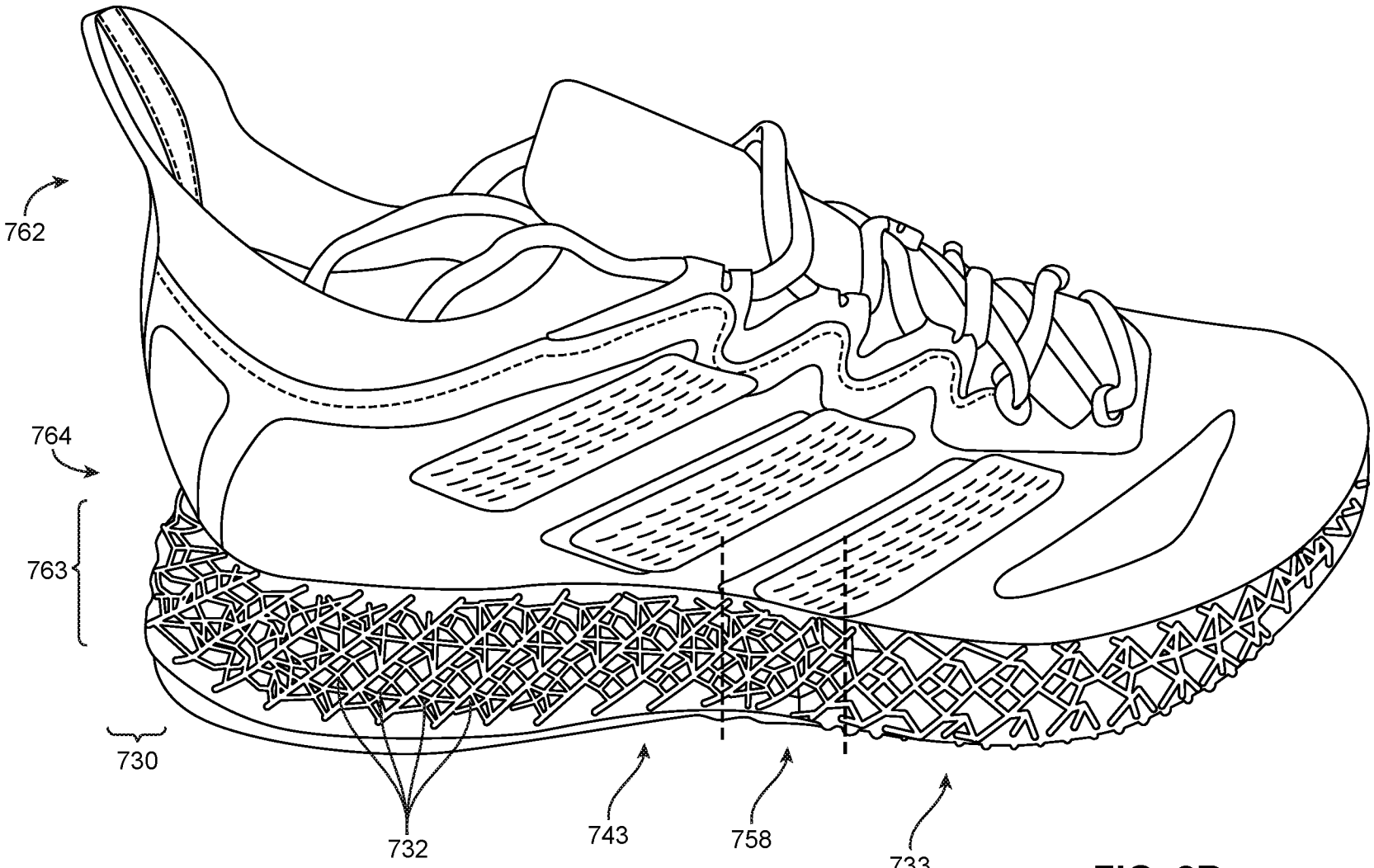
FIG. 8B is a perspective view of a shoe having a midsole that includes a compound lattice according to some embodiments.
Figure 8C:
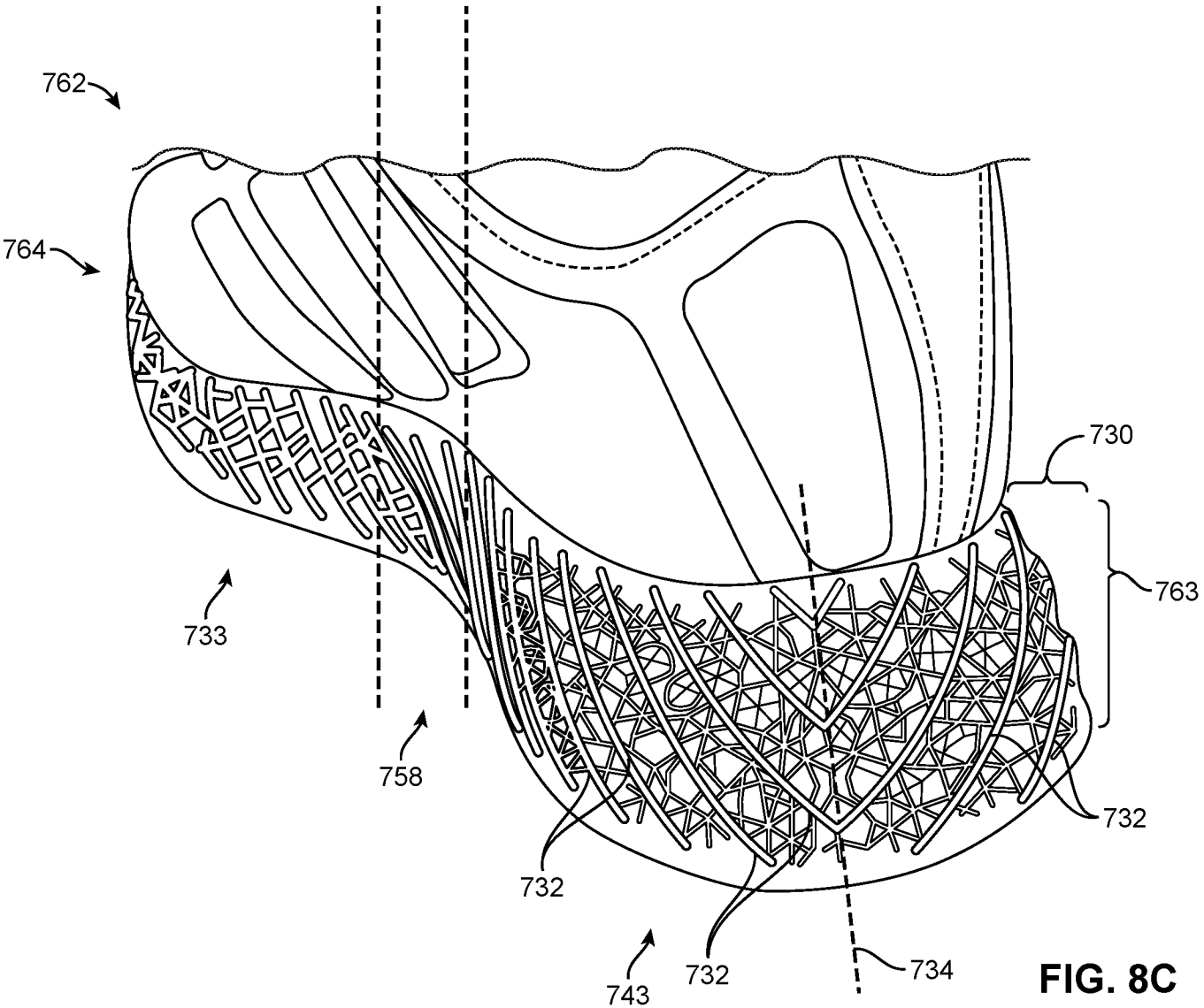
FIG. 8C is another perspective view of the shoe of FIG. 8B.
Figure 8D:
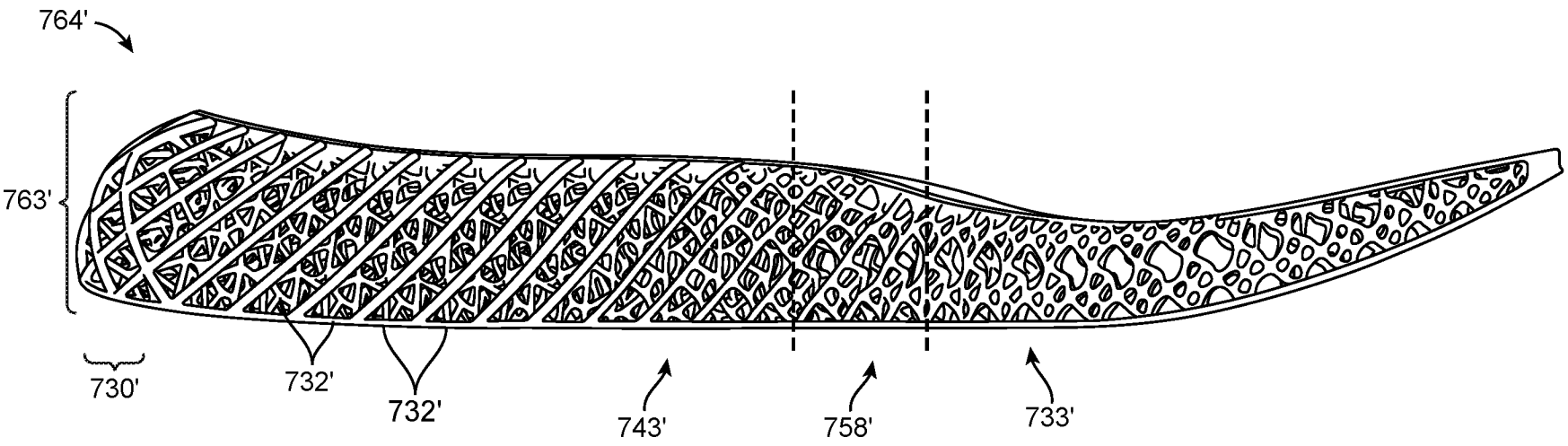
FIG. 8D is a medial side elevation view of a midsole according to some embodiments.

A skin, for example skin 730 as shown in FIGS. 8B and 8C, can be derived from unit cell 616 to enhance desired aesthetic and/or mechanical characteristics of a lattice. In some embodiments, a skin can be created by placing beams 632 across unit cells 616 as shown in FIG. 7B, then modifying the unit cells 616 to accommodate the beams 632, thereby creating partially modified cells 617, such as the partially modified cell 617 shown in FIG. 7C. FIGS. 7B and 7C only show a portion of beams 632, meaning beams 632 include portions not visible in FIG. 7B or FIG. 7C that extend into other cells. Beams 632 can extend across multiple partially modified cells 617 and therefore appear in different places within the partially modified cells 617, or modified cells 618 described below, through which beams 632 pass. Thus, the placement of beams 632 relative to the unit cell 616 shown in FIG. 7B and the partially modified cell 617 shown in FIG. 7C is only an example, and other beams 632 or portions of beams 632 can be located elsewhere within or near other partially modified cells 617 within the same skin as the illustrated partially modified cell 617. Beams 632 may therefore be alike to beams 732 shown in FIG. 8B, wherein beams 732 extend continuously across multiple cells at an exterior of a compound lattice 764 forming a midsole 763.

In some embodiments, beams 632 can have an effective diameter of equal to or about 150% of the average effective diameter of struts 624, or at least 50% greater than the average effective diameter of struts 624. In some embodiments, beams 632 can have an effective diameter greater than or equal to 110% the average effective diameter of struts 624 defining a unit cell to less than or equal to 200% of the average effective diameter of struts 624 defining a unit cell. In some embodiments, beams 632 can have an effective diameter greater than or equal to 120% of the average effective diameter of struts 624 defining a unit cell to less than or equal to 180% of the average effective diameter of struts 624 defining a unit cell 616.

In some embodiments, beams 632 can have an effective diameter greater than or equal to 150% of the average effective diameter of struts 624 defining a unit cell. In some embodiments, beams 632 can have an effective diameter greater than or equal to 150% of the average effective diameter of struts 624 defining a unit cell to less than or equal to 200% of the average effective diameter of struts 624 defining a unit cell.

Figure 7D:
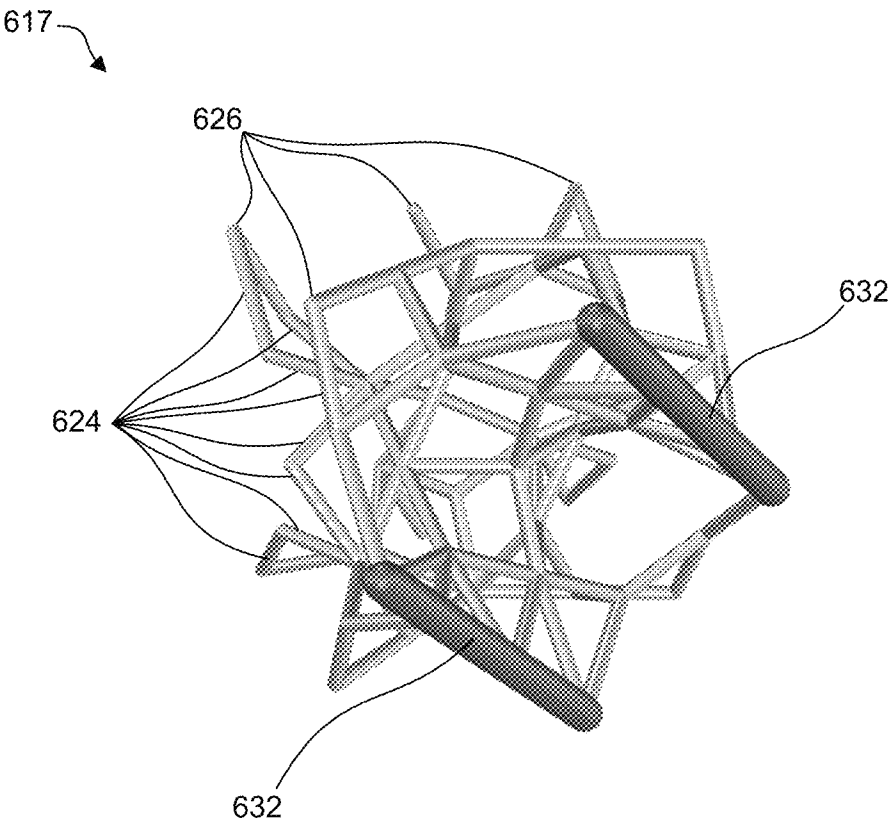
FIG. 7D is a perspective view of a partially modified cell according to some embodiments.

Modifying unit cell 616 to accommodate beams 632, thereby resulting in partially modified cell 617, can include aligning some nodes 626 on beams 632 as shown in FIGS. 7C and 7D. Struts 624 connected to nodes 626 that are relocated to become aligned on beams 632 can be rotated, lengthened, shortened, or any combination of rotated, lengthened, and shortened to remain connected to the relocated nodes 626. In some embodiments, some nodes 626 relocated during the conversion of unit cell 616 to partially modified cell 617 can be moved to lie on beam 632 at an edge of a cubic space within which partially modified cell 617 is defined. Thus, in some embodiments, adjacent partially modified cells 617 or modified cells 618, described below, connecting to the same beam 632 can share nodes 626 located on the shared beam 632, which promotes interconnection between the structures of modified cells 618 within a skin and thereby increases the overall resilience of the skin.

The relocation of nodes 626 to place nodes 626 on beams 632 can include identifying nodes 626 in unit cell 616 within a predefined distance of any beam 632, then moving each identified node 626 to a respective nearest point on any beam 632. The predefined distance can be proportional to a size of unit cell 616. In some embodiments, the predefined distance can be 5% of a length of unit cell 616, 10% of a length of unit cell 616, 15% of a length of unit cell 616, 20% of a length of unit cell 616, or 30% of a length of unit cell 616.

Unit cell 616 or partially modified cell 617 can also be modified by relocating nodes 626 to be in contact with features of adjacent cells to connect modified cell 618 to neighboring cells. For example, some nodes 626 can be relocated to be in contact with features of second unit cell 640, thereby joining modified cell 618 to second unit cell 640. Similarly, some nodes 626 can be relocated to be in contact with features of adjacent unit cells 616, partially modified cells 617, or modified cells 618.

The relocation of nodes 626 to be in contact with features of adjacent cells can include identifying nodes 626 within a predefined distance of any feature of an adjacent cell that extends to a boundary between the adjacent cell and the cell that includes the nodes 626. Each identified node 626 can be relocated onto the boundary at the location of the feature of the adjacent cell that extends to the boundary, thereby creating a connection between the features of the cell that contains the identified node 626 and the adjacent cell. For example, FIG. 7G shows that certain nodes of modified cell 618 have been relocated to contact one another at a boundary between modified cell 618 and second unit cell 640, thereby joining modified cell 618 and second unit cell 640. In some embodiments, the predefined distance can be 5% of a length of unit cell 616, 10% of a length of unit cell 616, 15% of a length of unit cell 616, 20% of a length of unit cell 616, or 30% of a length of unit cell 616.

In further embodiments, the relocation of nodes 626 to be in contact with features of adjacent cells can additionally or alternatively include complementary modification of one or more of the adjacent cells to connect a feature or features of the one or more adjacent cells with one or more nodes 626. The complementary modification can include identifying any features of adjacent cells within a predefined distance of any node 626 on an opposite side of the boundary. A theoretical line that extends across the boundary from each identified feature to a nearest node 626 on the opposite side of the boundary can be found. The identified feature and the nearest node 626 can both be relocated to the location where the theoretical line intersects the boundary, thereby connecting the structure of struts 624 and nodes 626 within the unit cell 616, partially modified cell 617, or modified cell 618 being modified to the structure within the complementarily modified adjacent cell 616, 617, 618, 640. For the purpose of the complementary modification, in some embodiments, the predefined distance can be 5% of a length of unit cell 616, 10% of a length of unit cell 616, 15% of a length of unit cell 616, 20% of a length of unit cell 616, or 30% of a length of unit cell 616.

In some embodiments, unit cell 616 or partially modified cell 617 can also be modified by removing some struts 624 as shown in FIG. 7D. Struts 624 can be chosen for removal as necessary to create as large as desired voids within the cell. In some embodiments, a desired void size can be a void size that is large enough for struts 624 to be additively manufactured according to a contemplated additive manufacturing process at a target size without gaps between struts 624 in the finished product being filled with print material. In further embodiments, the desired void size can be in any range such that the modified unit cell 618, when manufactured, has intended mechanical properties. The removal of some struts 624 can include removing horizontal struts followed by removal of additional struts as necessary to create as large as desired voids within the cell. In other embodiments, struts 626 can be removed in any order. In various embodiments, the removal of some struts 624 from partially modified cell 617 can be done before, during, or after relocating nodes 626 onto beams 632 and into contact with features of adjacent cells as described herein.

Figure 7E:
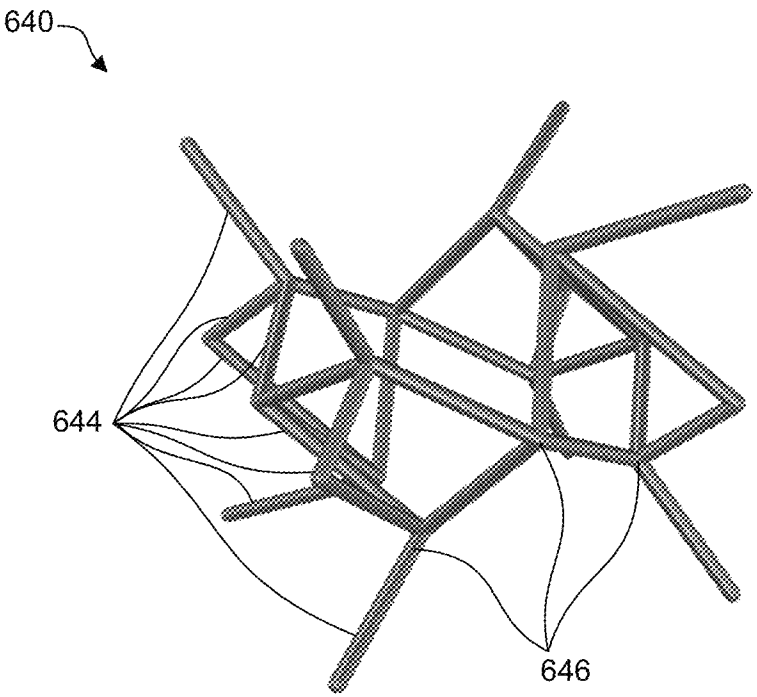
FIG. 7E is a perspective view of a unit cell according to some embodiments.

FIG. 7E illustrates a second unit cell 640 according to some embodiments. Second unit cell 640 can optionally be unit cell 322 or unit cell 405 in some or all respects. In other embodiments, second unit cell 640 can differ from unit cell 322 and unit cell 405. Second unit cell 640 of the illustrated embodiment includes struts 644 that meet at nodes 646, though second unit cell 640 in other embodiments can additionally or alternatively include smooth surfaces, ribbon shaped bodies, one or more solid representations of one or more implicit surfaces, or other shapes.

Figure 7F:
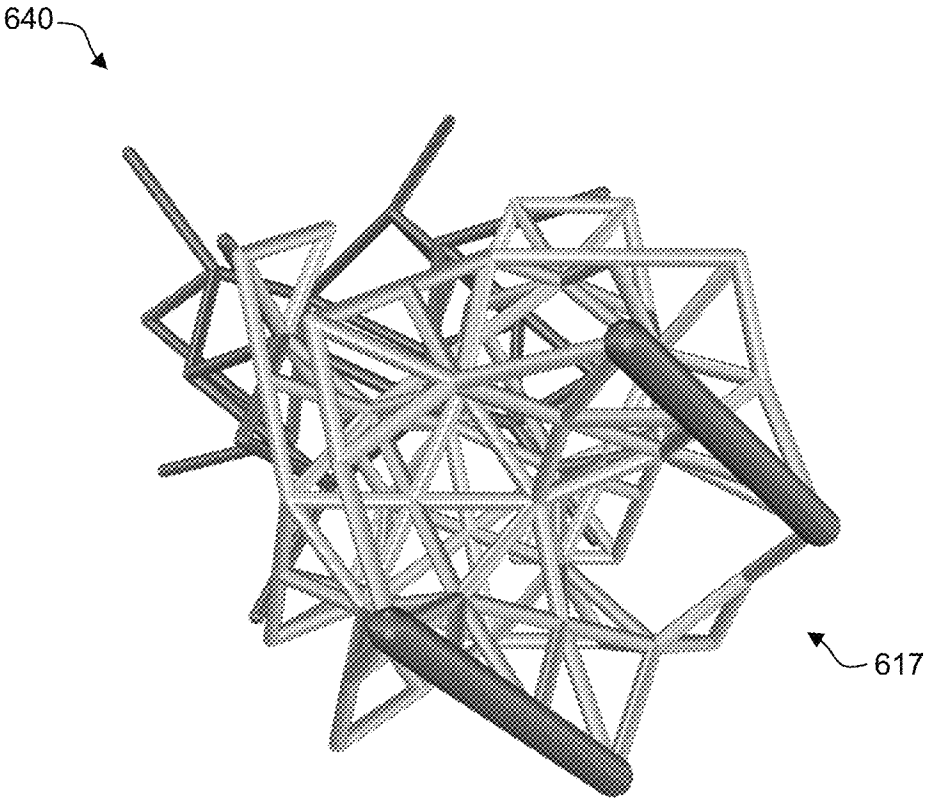
FIG. 7F is a perspective view of the unit cell of FIG. 7D joined to the partially modified cell of FIG. 7C.
Figure 7G:
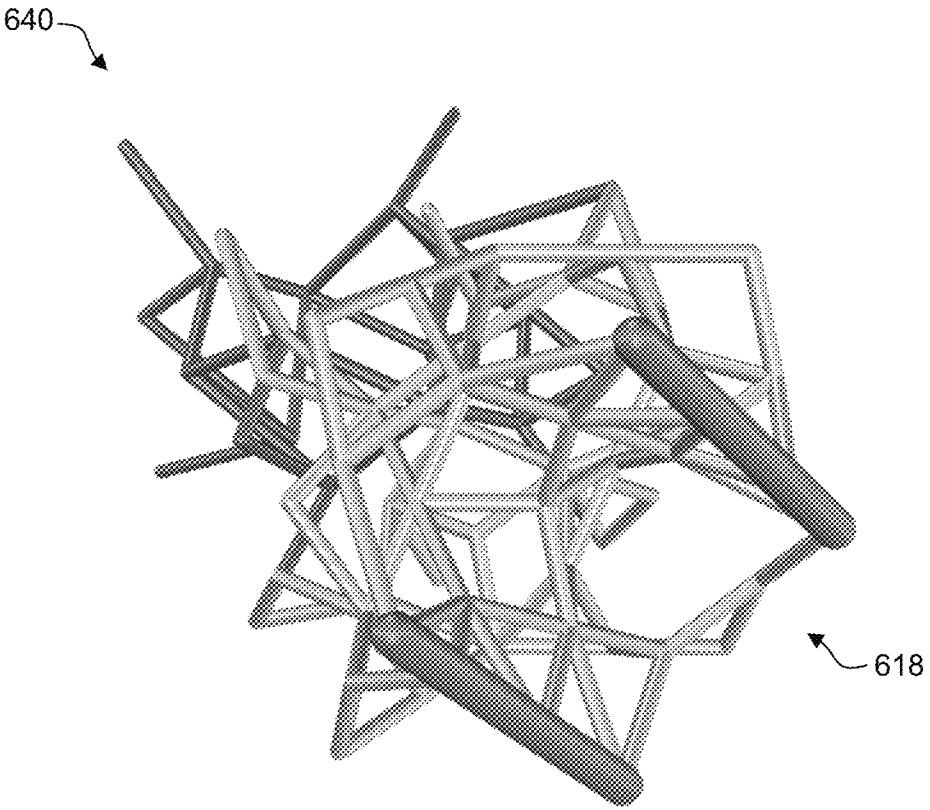
FIG. 7G is a perspective view of a modified cell joined to the unit cell of FIG. 7D.

In some embodiments, turning to FIG. 7F, partially modified cell 617 can be joined to second unit cell 640 to form a compound lattice. Such a compound lattice can optionally include a first lattice populated by first unit cells 616. Instead of or in addition to the first lattice, the compound lattice can optionally include a second lattice populated by second unit cells 640. The compound lattice can therefore have different mechanical properties at different locations as a result of the different mechanical properties of the various cells 616, 618, 640 contained therein.

Partially modified cell 617 as illustrated in FIG. 7F has not had struts 624 removed to create voids in the manner described above with regard to FIG. 7D. Thus, in some embodiments, partially modified cell 617 can be joined to second unit cell 640 without prior removal of struts 624. However, in other embodiments, partially modified cell 617 can be joined to second unit cell 640 after some struts have been removed to create voids in the manner described above with regard to FIG. 7D.

Partially modified cell 617 is further modified to become modified cell 618, shown in FIG. 7G. The modification of partially modified cell 617 to convert partially modified cell 617 to modified cell 618 can include relocating nodes 626 onto beams 632 as described above. In some embodiments, some nodes 626 can be relocated during the conversion of unit cell 616 to modified cell 618 to lie on edges of the cubic space within which modified cell 618 is defined, as described above, at locations remote from beams 632. In such embodiments, the nodes 626 located on the edges of the cubic space can connect to struts, nodes, or other features of neighboring cells so that modified cells 618 are joined to their neighboring cells. For example, in some embodiments, some nodes 626 can be relocated such that modified cell 618 connects to other modified cells 618 within the skin at locations remote from beams 632.

In some embodiments, modification of partially modified cell 617 to convert partially modified cell 617 to modified cell 618 can include removal some struts 624 to create cavities, as described above, if struts 624 were not removed to create the cavities before partially modified cell 617 was joined to second unit cell 640. The removal of some struts 624 can include horizontal struts 624, followed by removal of additional struts 624 as necessary to create as large as possible voids within the cell, followed by relocating remaining nodes 626 adjacent to beams 632 to align nodes on beams 632 as described above. Modified cell 618 therefore lacks certain struts 624 present in unit cell 616, and other struts 624 are rotated and adjusted in length so that some nodes 626 are aligned on beams 632, thereby connecting beams 632 to the struts 624 of modified cell 618. In some embodiments, modified cell 618 can include at least two struts 624 that are not aligned on any edges of the polygon mesh and that are connected to each other by a beam 632.

Conversion of unit cell 616 to modified cell 618 in the illustrated embodiment includes three processes as described above. One of the three processes is relocating some nodes 626 onto beams 632, thereby joining beams 632 to the structure of struts 624 and nodes 624. Another of the three processes is relocating some nodes 626 onto edges of the space in which unit cell 616 or modified cell 618 is defined so that modified cell 618 is joined to neighboring cells. The joining can, in some embodiments, include complementary modification of the neighboring or adjacent cells as described above. Another of the three processes is removing some struts 624 to create cavities in modified cell 618. In various embodiments, the three processes can be performed in any order. Any two of the three processes, or all three of the three processes, can be performed at the same time. Any of the three processes can be split into multiple stages, and any stage of any one process can be performed before, during, or after any stage of another process. In some embodiments, the process of removing some struts 624 to create cavities can be omitted such that modified cell 618 includes the same number of struts as unit cell 616.

The modified cells 618 and beams 632 can form a skin extending across a portion or an entirety of an exterior of the compound lattice. In some embodiments, the skin can extend across a portion or an entirety of an exterior of the first lattice, a portion or an entirety of an exterior of the second lattice, or an entirety or a portion of an exterior of both the first lattice and the second lattice. Thus, a shoe sole can be constructed that includes the compound lattice to have different properties at different locations.

In some embodiments, a compound lattice in a shoe midsole can be constructed such that the first lattice extends to where the properties resulting from first unit cells 616 are desired and the second lattice extends to where the properties resulting from second unit cells 640 are desired. In further embodiments, the skin of modified cells 618 and beams 632 can extend across a portion of an exterior of the compound lattice corresponding to a portion of the shoe where supplementing the properties of the first lattice or second lattice would be desirable. For example, if the mechanical properties of the first lattice are desired at a heel portion of the midsole while the mechanical properties of the second lattice are desired at a toe portion of the midsole, the compound lattice can be designed in a shoe midsole shape with the first lattice at the heel and the second lattice at the toe. In other examples, if the mechanical properties of the second lattice are desired at a to portion of the midsole while the mechanical properties of the second lattice are desired at a heel portion of the midsole, the compound lattice can be designed in a shoe midsole shape with the first lattice at the toe and the second lattice at the heel. In another example, if the aesthetic properties of the first lattice and the mechanical properties of the second lattice are desired, the compound lattice can be designed in a shoe midsole shape with the first lattice partially or entirely surrounding the second lattice on at least one plane. The at least one plane can, in some embodiments, be a horizontal plane. In some embodiments wherein the at least one plane is a horizontal plane, the first lattice will be visible to a user or observer of the complete shoe while the midsole as a whole will exhibit mechanical properties similar to those of the second lattice specifically.

In further embodiments, if the mechanical properties of the first lattice or the second lattice are desired at a portion of the shoe, but the aesthetic properties of the first lattice or second lattice are not desired at that portion of the shoe, the exterior of the lattice at that portion of the shoe can be covered by the skin of modified cells 618 and beams 632. In further embodiments, if the mechanical properties of the first lattice or the second lattice are desired at a portion of the shoe, but supplementing that portion of the shoe with the mechanical properties of the skin of modified cells 618 and beams 632 would be advantageous, the exterior of the lattice at that portion of the shoe can be covered by the skin of modified cells 618 and beams 632. For example, in some embodiments, a shoe midsole can include a compound lattice that includes a first portion, a second portion, and the skin of modified cells 618 and beams 632. In some embodiments, a lattice of a single type of unit cell can extend throughout the first portion and the second portion, while in other embodiments, the first portion can be a lattice of a first type of unit cell while the second portion can be a lattice of a second type of unit cell, the second type of unit cell being different than the first type of unit cell. The skin of modified unit cells 618 and beams 632 can provide part of an exterior of the midsole at locations where the second portion of the compound lattice is present. The skin can be constructed such that beams 632 form the outermost layer of the midsole where the second portion of the compound lattice is present. Thus, the single type of unit cell may be visible at an exterior of the midsole where the first portion of the compound lattice is present, but the second portion of the compound lattice may be covered by the skin. The single type of unit cell can be, in some examples, second unit cell 640. The second portion can be, for example, a heel portion of the compound lattice. The first portion can be, for example, a toe portion of the compound lattice.

In some embodiments, the compound lattice can also include a transition region joining the first lattice to the second lattice. In some embodiments, the transition region can be a transition region 755 as described herein. The transition region can include struts joining nodes 626 of first unit cells 616 and or modified cells 618 to nodes 646 of second unit cells 640. The struts of the transition region can join nodes 626 to nodes 646 either by extending directly from a node 626 to a node 646 or by connecting with other struts, optionally including struts 622 and 642, to form a network of struts and nodes that extends from nodes 626 to nodes 646. The transition region can have a different structure than first unit cells 616, any modified cells 618, and second unit cells 640 such that the transition region does not contain any instance of a base geometry found in the first lattice or second lattice.

Figure 9:
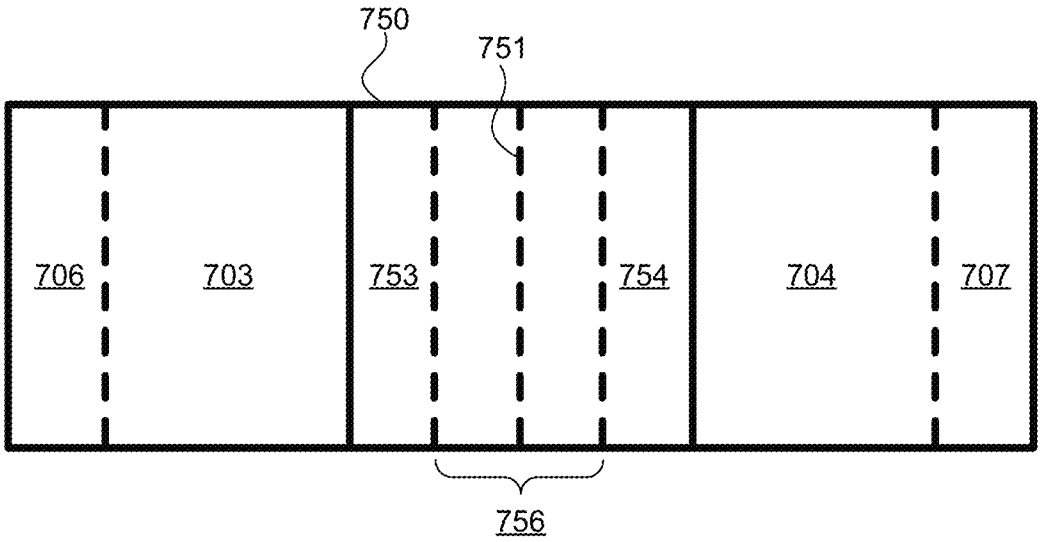
FIG. 9 is a diagram of a structure blending different unit cells according to some embodiments.

In some embodiments, a compound lattice can include a first lattice populated by first unit cells having a first base geometry and a second lattice populated with second unit cells having a second base geometry that differs from the first base geometry. An example of a portion of such a compound lattice is shown in FIG. 9. In some embodiments, the first lattice and the second lattice can be blended together within the compound lattice. The compound lattice can include a transition region that blends the first lattice and the second lattice together. In some embodiments, the transition region blends the first lattice and the second lattice by including portions adjoining the first lattice that are relatively alike to portions of the first base geometry and portions adjoining the second lattice that are relatively alike to portions of the second base geometry.

In some embodiments, the first unit cells can be unit cells that make the first lattice effectively anisotropic with respect to lattice shear modulus, such as unit cells 405. In some embodiments, the second base geometry may be a structure of struts and nodes wherein the struts are aligned on edges of polygons of a polygon mesh of an implicit surface, such as the base geometry of unit cells 516. In some embodiments, the compound lattice can include a skin of beams and modified cells, similar to the skin of modified cells 618 and beams 632 described above, derived from either the first unit cells or the second unit cells that extends across a portion or an entirety of an exterior of any one or any combination of the first lattice, the second lattice, and the transition region.

In some embodiments, the skin can extend across a portion or an entirety of an exterior of the first lattice, a portion or an entirety of an exterior of the second lattice, or a portion or an entirety of an exterior of both the first lattice and the second lattice. Thus, a shoe sole can be constructed that includes the compound lattice to have different properties at different locations. In some embodiments, a compound lattice in the midsole can be constructed such that the first lattice extends to where the properties resulting from first unit cells are desired and the second lattice extends to where the properties resulting from second unit cells are desired. In further embodiments, the skin can extend across a portion of an exterior of the compound lattice corresponding to a portion of the shoe where supplementing the properties of the first lattice or second lattice would be desirable. For example, if the mechanical properties of the first lattice are desired at a heel portion of the midsole while the mechanical properties of the second lattice are desired at a toe portion of the midsole, the compound lattice can be designed in a shoe midsole shape with the first lattice at the heel and the second lattice at the toe. In other examples, if the mechanical properties of the second lattice are desired at a toe portion of the midsole while the mechanical properties of the second lattice are desired at a heel portion of the midsole, the compound lattice can be designed in a shoe midsole shape with the first lattice at the toe and the second lattice at the heel. In another example, if the aesthetic properties of the skin and the mechanical properties of the second lattice are desired, the compound lattice can be designed in a shoe midsole shape with the skin partially or entirely surrounding the second lattice on at least one plane. The at least one plane can, in some embodiments, be a horizontal plane. In some embodiments wherein the at least one plane is a horizontal plane, the first lattice will be visible to a user or observer of the complete shoe while the midsole as a whole will exhibit mechanical properties similar to those of the second lattice specifically.

In some embodiments wherein a compound lattice includes a first lattice populated by first unit cells having a first base geometry and a second lattice populated with second unit cells having a second base geometry that differs from the first base geometry, the first base geometry can be a smooth ribbon of material and the second base geometry can be a structure of struts and nodes wherein the struts are aligned on edges of a polygon mesh of the first base geometry. An example of a portion of such a compound lattice is shown in FIG. 9. In such embodiments, the transition region can blend the first lattice and the second lattice by including portions adjoining the first lattice that are relatively alike to portions of the first base geometry and portions adjoining the second lattice that are relatively alike to portions of the second base geometry. The portions adjoining the first lattice can be or include portions of the ribbon of the first base geometry, and can optionally also include struts or portions of struts. The portions adjoining the second lattice can be or include portions of the structure of struts and nodes of the second base geometry, and can optionally also include a portion or portions of a ribbon.

FIG. 8A illustrates a compound lattice 761. Compound lattice includes a first lattice 731 populated with first unit cells and a second lattice 741 populated with second unit cells. Some or all of the first unit cells of first lattice 731 can share a first base geometry and some or all of the second unit cells of second lattice 741 can share a second base geometry that differs from the first base geometry. In further embodiments, first lattice 731 can include some cells that have modified forms of the first base geometry. In further embodiments, second lattice 741 can include some cells that have modified forms of the second base geometry.

In some embodiments, first lattice 731 can be a lattice of unit cells, such as, for example, unit cells 405, that make first lattice 731 effectively anisotropic with respect to lattice shear modulus. In some embodiments, second lattice 741 can be a lattice of unit cells, such as, for example, unit cells 322, that can have a base geometry of a solid representation of an implicit surface or another smooth ribbon of material. However, the principles described herein with respect to compound lattice 761 can be applied to any compound lattice having a first lattice 731, a second lattice 741, and a transition region blending first lattice 731 and second lattice 741 regardless of the base geometry of unit cells of the first lattice 731 and the base geometry of unit cells of the second lattice 741.

Compound lattice 761 also includes a transition region 755 joining first lattice 731 to second lattice 741. Transition region 755 can include one or more transition cells that resemble the geometry of the first unit cells more closely near first lattice 731 and resemble the geometry of the second unit cells more closely near second lattice 741. Transition region 755 thereby blends the geometries of first lattice 731 and second lattice 741 together. Blending the geometries of two lattices 731, 741 together this way can better transfer force across the boundary between the lattices 731, 741 than a sharp transition, thereby reducing stress concentrations and improving mechanical performance.

FIG. 8B, for example, illustrates a shoe 762 having a midsole 763 that includes a compound lattice 764. Similarly to compound lattice 761, compound lattice 764 includes a first lattice 733, a second lattice 743, and a transition region 758 that blends first lattice 733 to second lattice 743. Like first lattice 731 of compound lattice 761, first lattice 733 of compound lattice 764 can be a lattice of unit cells, such as, for example, unit cells 405, that make first lattice 733 effectively anisotropic with respect to lattice shear modulus. Second lattice 743 can be, by contrast, a lattice of unit cells having a base geometry of a structure of struts and nodes, wherein the struts extend along edges of a polygon mesh of an implicit surface, such as unit cells 516. In other embodiments, second lattice 743 can be the same as first lattice 733 except for the presence of skin 730 on the exterior of second lattice 743. In regard to a compound lattice in a shoe midsole such as compound lattice 764, reference to an exterior or exterior surface of a lattice in the compound lattice refers to a surface of the lattice that is not adjoined by another portion of the compound lattice or another component of the shoe. Thus, in the illustrated example, skin 730 obscures second lattice 743 from view because skin 730 extends across the exterior of second lattice 743 while other sides of second lattice 743 are covered by first lattice 733 or another component of shoe 762.

First lattice 733 makes up a toe portion of midsole 763. Second lattice 743 is located posteriorly of first lattice 733 and makes up a heel portion of midsole 763. Transition region 758 is located in a midfoot portion of midsole 763. Midsole 763 therefore can have different mechanical properties at the toe portion than at the heel portion, and the transition region 758 effectively transfers force between the toe portion and the heel portion.

Skin 730 includes beams 732. In some embodiments, skin 730 can also include modified versions of the unit cells of second lattice 743, such as modified cells 618. Skin 730 is configured such that beams 732 provide an outermost layer of compound lattice 764 where second lattice 743 is present. As noted above, skin 730 covers an entirety of second lattice 743 except where second lattice 743 adjoins transition region 758 or another portion of the shoe 762. In some embodiments, skin 730 can also be absent from a bottom of midsole 763 such that second lattice is exposed on an outsole side or ground facing side of midsole 763. Thus, an observer of the heel portion of midsole 763 within shoe 762 as a whole sees the skin 730 of beams 732 and modified cells, but sees little, if any, of the un-modified cells of second lattice 743. In various embodiments, the un-modified cells of second lattice 743 may be identical to the cells of first lattice 733 or different from the cells of first lattice 733.

In some embodiments, compound lattice 764 includes a first lattice of unit cells that make the first lattice effectively anisotropic with respect to lattice shear modulus, such as, for example, unit cells 405, and a second lattice of unit cells having a base geometry of a structure of struts and nodes, wherein the struts extend along edges of a polygon mesh of an implicit surface, such as, for example, unit cells 516. In any such compound lattice, the struts of the unit cells of the second lattice can, in some embodiments, each have an effective diameter that is equal to or about 90%, equal to or about 100%, between 70% and 90%, or between 50% and 100% of the effective diameter of the thickest struts in the unit cells of the first lattice. In any other compound lattice that includes a first lattice populated by first unit cells and a second lattice populated by second unit cells, wherein first and second unit cells have different base strut geometries, the struts of the second unit cells can have an effective diameter that is equal to or about 90%, equal to or about 100%, between 70% and 90%, or between 50% and 100% of the effective diameter of the thickest struts in the first unit cells.

As shown in FIG. 8C, in some embodiments, skin 730 can include a convergence line 734 relative to which the angles of beams 732 of skin 730 are defined. In such embodiments, beams 732 on either side of shoe 762 can be angled forward to promote transference of compressive force on midsole 763 to forward motion. Thus, in the illustrated embodiment wherein second lattice 743 makes up a heel portion of midsole 763, convergence line 734 extends vertically up a rearward location of a heel portion of midsole 763. In such embodiments, individual beams 732 each terminate at one end on convergence line 734 and extend upward and forward from the end located on convergence line 734. In other embodiments, a lattice with a skin alike to skin 730 can make up a toe portion of a midsole, and the skin can include a convergence line that extends vertically up a forward location of a toe portion of the midsole. In such other embodiments, the skin can include beams that extend upward and forward to terminate at one end on the convergence line at the forward location of the toe portion of the midsole.

FIGS. 8D-8G illustrate a midsole 763' according to another embodiment. Midsole 763' also includes a compound lattice 764'. Midsole 763' of FIGS. 8D-8G is illustrated without an upper, but is otherwise alike to midsole 763 of FIGS. 8B and 8C except for any differences explicitly illustrated or described herein. Thus, any features illustrated or described herein with respect to midsole 763' can also be true for midsole 763 to the extent that such features are not contradicted by FIGS. 8B and 8C or the associated description.

Compound lattice includes a first portion 733', a second portion 743', and a transition region 758' that blends first portion 733' to second portion 743'. First portion 733' makes up a toe portion of midsole 763'. Second portion 743' is located posteriorly of first portion 733' and makes up a heel portion of midsole 763'. Transition region 758' is located in a midfoot portion of midsole 763'.

First portion 733' and second portion 743' can both include lattices of unit cells having the base geometry of unit cells 405. Second portion 743' additionally includes a skin 730' that covers the lattice within second portion 743'. Skin 730' wraps around and covers the medial, lateral, and heel sides of the lattice within second portion 743'. Skin 730' includes beams 732'. In some embodiments, skin 730 can also include unit cells derived from implicit surfaces, such as modified cells 618, to which the beams 732 can be connected.

Figure 8E:
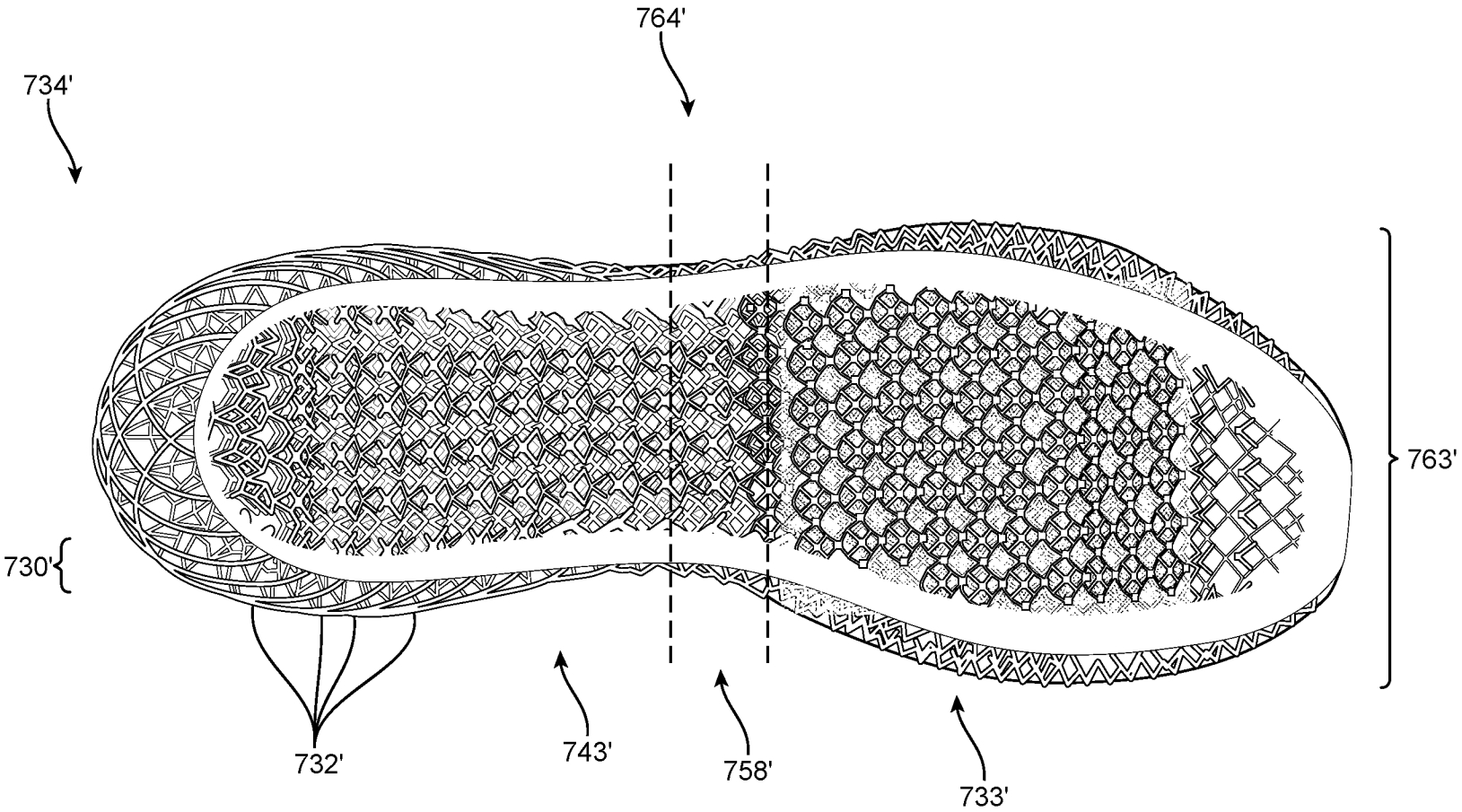
FIG. 8E is a top plan view of the midsole of FIG. 8D.
Figure 8F:
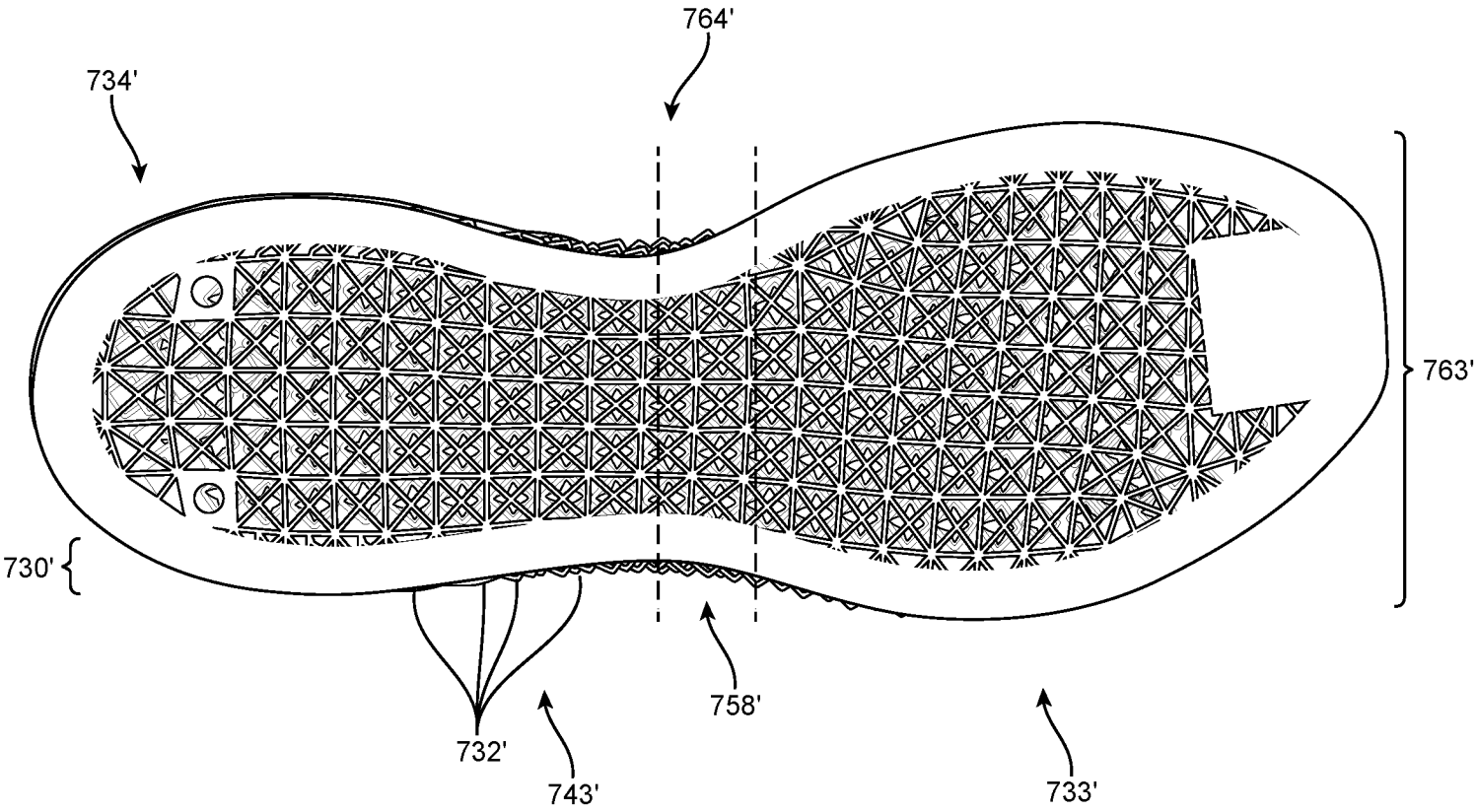
FIG. 8F is a bottom plan view of the midsole of FIG. 8D.

As shown in FIGS. 8E and 8F, the lattices in first portion 733', second portion 743', and transition region 758' are exposed on the top and bottom sides of midsole 763', respectively.

Figure 8G:
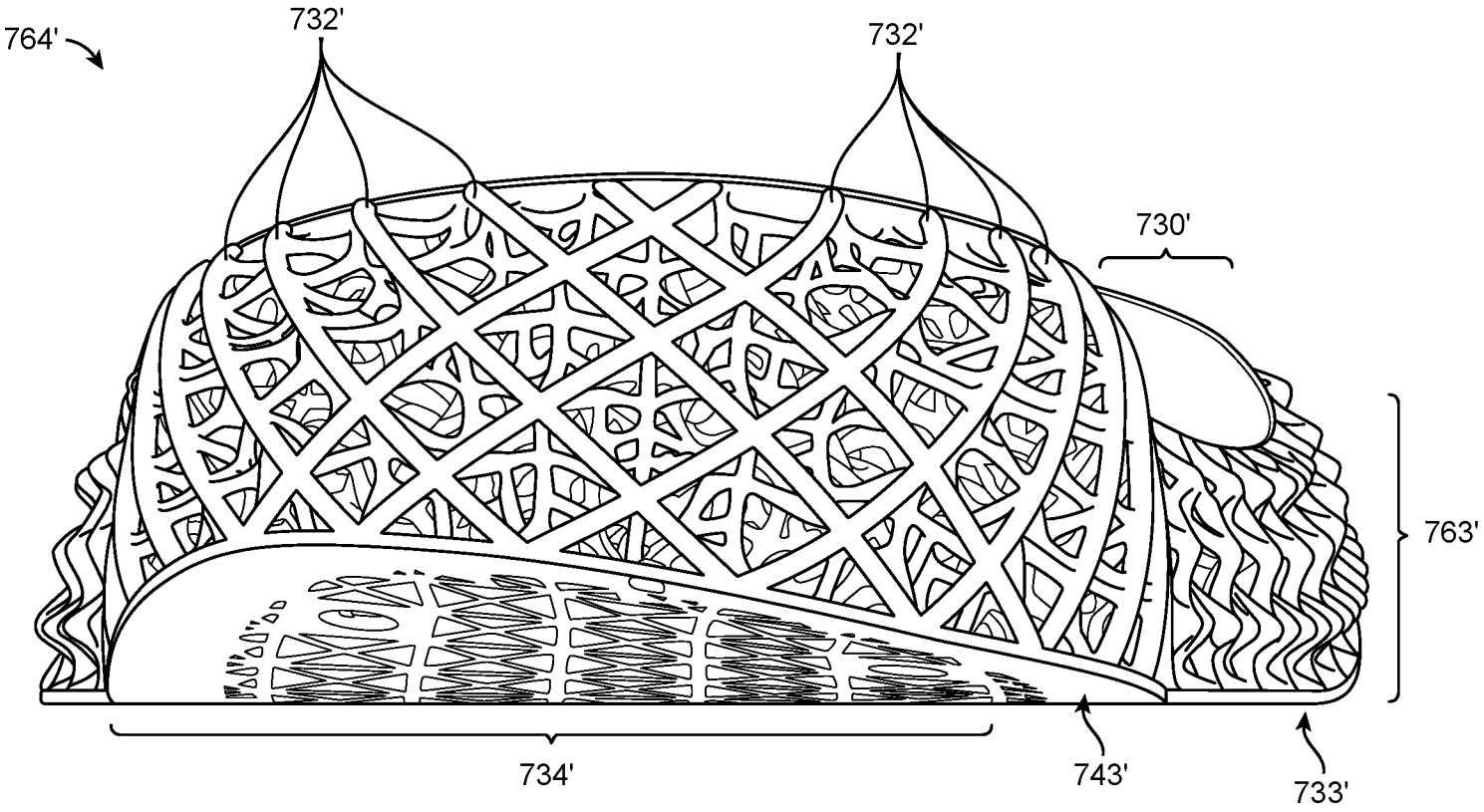
FIG. 8G is a back elevation view of the midsole of FIG. 8D.

As shown in FIG. 8G, a heel region 734' of skin 730' can include crossing beams 732'. Thus, skin 730' can include a medial set of beams 732' and a lateral set of beams 732'. Beams 732' in both the medial set of beams 732' and the lateral set of beams 732' extend from a lower end of midsole 763' toward the toe end and upper end of midsole 763'. Within each of the medial set and the lateral set, beams 732' can spaced and angled to appear parallel. That said, beams 732' of the illustrated embodiment can curve to follow the contours of the shape of midsole 763' and are therefore not strictly parallel at all points. The medial and lateral sets of beams 732' overlap in the heel region 734' to create the crossed arrangement shown in FIG. 8G.

FIG. 9 illustrates an example of a portion of a compound lattice. Portions of compound lattice 761 spanning transition region 755 can follow the pattern illustrated in FIG. 9 and described with respect thereto. Similarly, portions of compound lattice 764 spanning transition region 758 can follow the pattern illustrated in FIG. 9 and described with respect thereto. In FIG. 9, a first unit cell 703 is blended into a second unit cell 704 by a transition unit cell 750. First unit cell 703 adjoins transition unit cell 750 on a first side of transition unit cell 750 and second unit cell 704 adjoins transition unit cell 750 on a second side of transition unit cell 750 opposite the first side of transition unit cell 750. Transition unit cell 750 includes a first segment 753 that includes the first side of transition unit cell 750 and a second segment 754 that includes the second side of transition unit cell 750. Optionally, any above described transition region joining a first lattice to a second lattice can be constructed partially or entirely of transition unit cells 750. For example, a transition region joining a first lattice of first unit cells 616 to a second lattice of second unit cells 640 can be constructed partially or entirely of transition unit cells 750 that blend first unit cells 616 and second unit cells 640. In another example, transition region 755 can be constructed partially or entirely of transition unit cells 750 that blend cells of first lattice 731 and cells of second lattice 741. In another example, transition region 758 can be constructed partially or entirely of transition unit cells 750 that blend cells of first lattice 733 and cells of second lattice 743.

First segment 753 is identical in geometry to a corresponding first unit cell segment 706 within first unit cell 703. First unit cell segment 706 provides a same portion of first unit cell 703 as first segment 753 provides of transition unit cell 750. Thus, first segment 753 of transition unit cell 705 is effectively a continuation of a lattice constructed of unit cells alike to first unit cell 703. Similarly, second segment 754 is identical in geometry to a corresponding second unit cell segment 707 within second unit cell 704 so that second segment 754 is effectively a continuation of a lattice constructed of unit cells alike to second unit cell 704.

In various embodiments, first segment 753 and second segment 754 can comprise various proportions of transition cell 750. In some embodiments, first segment 753 and second segment 754 can each be a respective quarter of transition unit cell 750 such that the remainder third segment 756 of transition unit cell 750 can be half of transition unit cell 750. In other embodiments, either or both of first segment 753 and second segment 754 can be more than or less than a quarter of transition unit cell 750. In further embodiments, first segment 753 and second segment 754 have no thickness such that first segment 753 only includes the side of transition unit cell 750 that adjoins first unit cell 703 and second segment 754 only includes the side of transition unit cell 750 that adjoins second unit cell 704. In further embodiments, first segment 753 and second segment 754 can comprise different amounts of a total volume of transition unit cell 750. In some embodiments wherein first segment 753 and second segment 754 differ in size, either segment may individually be sized according to any one of the foregoing examples while the other segment is sized according to any other of the foregoing examples.

Transition unit cell 750 also includes a third segment 756 that makes up a remainder of transition unit cell 750 outside of first segment 753 and second segment 754. First segment 753, second segment 754, and third segment 756 collectively make up an entirety of transition unit cell 750. Third segment 756 differs in geometry from first unit cell 703 and second unit cell 704 so that third segment 756 is not identical to any structure in the base geometry of first unit cell 703 or the base geometry of second unit cell 704 having the same volume as third segment 756.

In some embodiments, third segment 756 provides a gradual transition from the geometry of the first unit cell 703 to the second unit cell 704 by blending aspects of the geometries of both first unit cell 703 and second unit cell 704, but being more alike to the geometry of first unit cell 703 with increasing proximity to first segment 753 and more alike to the geometry of second unit cell 704 with increasing proximity to second segment 754. In other embodiments, third segment 756 can be distinct from the geometries of first unit cell 703 and second unit cell 704 without becoming more alike to either nearer the first segment 753 and second segment 754.

In embodiments wherein the base geometries of first unit cell 703 and second unit cell 704 are both structures of struts and nodes, the geometry within third segment 756 can be derived from portions of both base geometries. The derivation process may be used, for example, to create geometries for transition unit cells 750 in transition region 758 of certain embodiments of shoe 762 described above. A process of deriving the geometry within third segment can include extending the base geometry of first unit cell 703 from first segment 753 to a middle plane 751 that bisects transition unit cell 750. The process can also include extending the base geometry of second unit cell 704 from second segment 754 to middle plane 751. Struts in either base geometry that would intersect middle plane 751 without ending on a node located on middle plane 751 can be omitted.

The process can also include, after the base geometries of first and second unit cells 703, 704 have been extended to middle plane 751, identifying pairs of nodes that are located both within a predetermined distance of each other and on opposite sides of the middle plane 751 from each other. In some embodiments, the predefined distance can be 5% of a length of unit cell 616, 10% of a length of unit cell 616, 15% of a length of unit cell 616, 20% of a length of unit cell 616, or 30% of a length of unit cell 616. The process can also include, after the pairs of nodes have been identified, finding a mean average location between the two nodes in each identified pair and then relocating both nodes in each identified pair to the respective mean average location for that pair. Third segment 756 derived according to the process described herein therefore includes a plurality of nodes, and each node in the plurality of nodes is located at a position within transition unit cell 750 that is a mean average of a position of a node of the base geometry of first unit cell 703 within first unit cell 703 and a position of a node of the base geometry of second unit cell 704 within second unit cell 704. Struts connected to nodes in the identified pairs can be elongated, rotated, and otherwise repositioned as necessary to remain connected to repositioned nodes.

For the purpose of the above described relocation of nodes to derive third segment 756, the mean average position is an average of coordinates of the relevant node of the base geometry of first unit cell 703 within first unit cell 703 and coordinates of the relevant node of the base geometry of second unit cell 704 within second unit cell 704. For example, each node in the base geometry of first unit cell 703 can have a coordinate position within first unit cell 703, such as an X, Y, and Z coordinate position defined relative to a center of first unit cell 703. Each node in the base geometry of second unit cell 704 can similarly have a coordinate position within second unit cell 704, such as an X, Y, and Z coordinate position defined relative to a center of second unit cell 704. The mean average between the positions of two nodes is therefore a coordinate position having values halfway between the values of the coordinate positions of those nodes. For example, where a first node within the base geometry of first unit cell 703 has an X, Y, Z coordinate position of −1, −1, −1 relative to the center of first unit cell 703, and a second node within the base geometry of second unit cell 704 has an X, Y, Z coordinate position of 2, 2, 2, relative to the center of second unit cell 704, a node within the geometry of transition region 756 located at a mean average of the positions of the first node and second node would be located at an X, Y, Z coordinate position of 0.5, 0.5, 0.5 relative to the center of transition unit cell 750.

In some embodiments according to the foregoing, third segment 756 may be defined as a smallest portion of transition unit cell 750 between any two parallel planes that contains all struts and nodes affected by the repositioning of nodes within the identified pairs. For this purpose, affected nodes include relocated nodes and affected struts include struts that are lengthened, rotated, or otherwise repositioned.

Figure 10A:
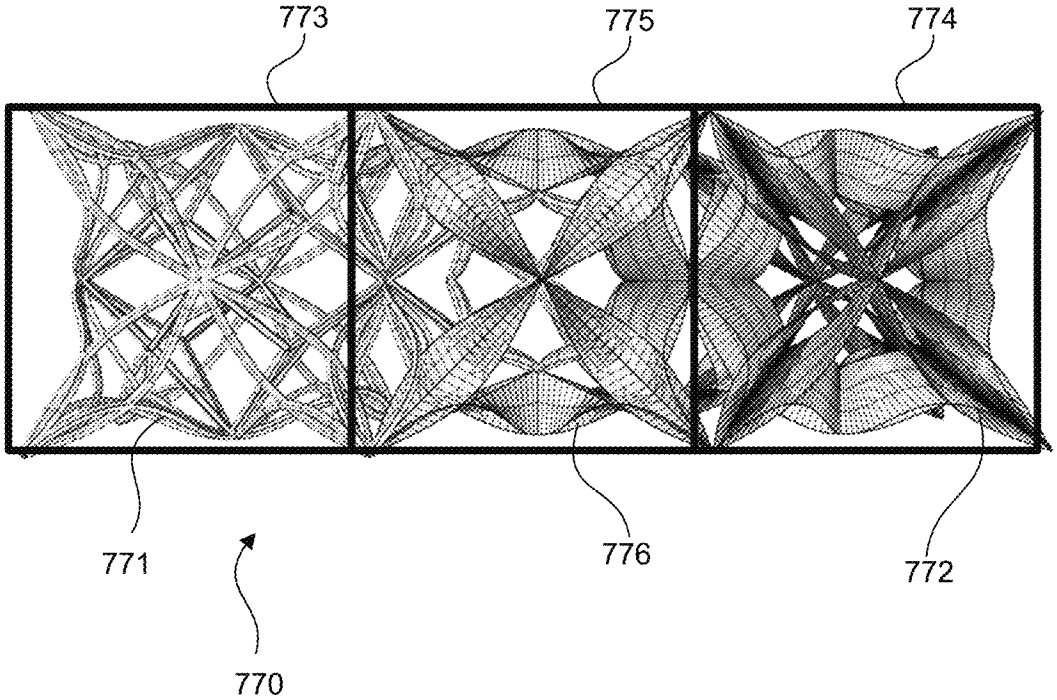
FIG. 10A shows blended unit cells according to some embodiments.
Figure 10B:
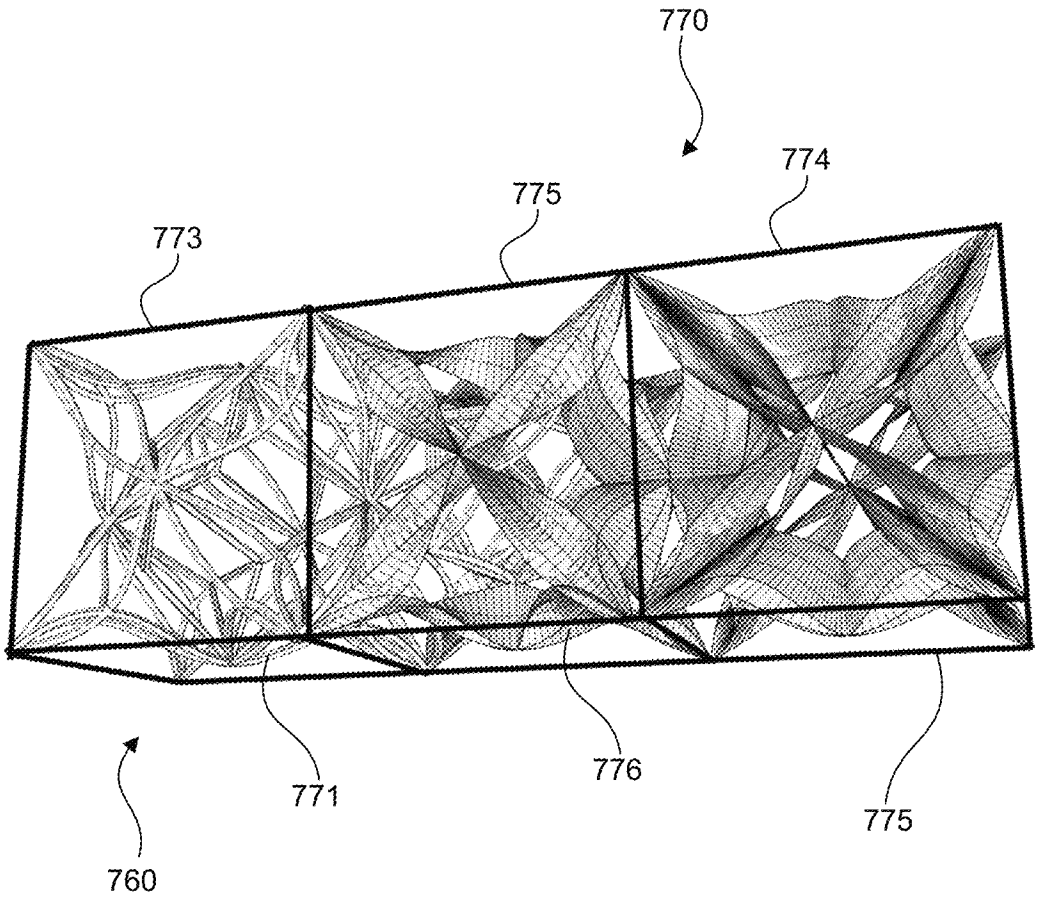
FIG. 10B is a perspective view of the blended unit cells of FIG. 10A.

FIGS. 10A and 10B illustrate an example row 770 within another framework for blending a first unit cell 773 and a second unit cell 774 by use of a transition unit cell 775, wherein first unit cell 773 has a base strut geometry 771 and second unit cell 774 has a base surface geometry 772. In various embodiments, base surface geometry 772 may optionally be an implicit surface or a polygon mesh of an implicit surface. Base strut geometry 771 corresponds to the overall shape of base surface geometry 772 such that the struts are located at the same positions within base strut geometry 771 as the positions of edges of the ribbons within base surface geometry 772. Base strut geometry 771 could therefore be converted to base surface geometry 772 by filling in certain gaps between struts in base strut geometry 771 with additional material. Thus, base strut geometry 771 includes struts with inter-strut gaps defined therebetween in place of certain surfaces of base surface geometry 772.

Compound lattice 761 shown in FIG. 8A is an example of a compound lattice that may be blended according to the framework described herein with respect to example row 770 because first lattice 731 is a lattice of unit cells having a base strut geometry and second lattice 741 is a lattice of unit cells having a base surface geometry. In another embodiment, the framework described herein with respect to example row 770 may be used to blend a lattice of a polygon mesh unit cells, such as unit cells having a base geometry of polygon mesh 514, with a lattice of unit cells having a base geometry of struts and nodes corresponding to edges of the polygon mesh, such as unit cell 516.

Example row 770 includes a transition unit cell 775 that blends base strut geometry 751 of first unit cell 753 with base surface geometry 772 of second unit cell 774. Within transition unit cell 775 is a transition geometry 776 that connects base strut geometry 751 to base surface geometry 752. A side of transition geometry 776 that adjoins base strut geometry 771 is alike to base strut geometry 771. A side of transition geometry 776 that adjoins base surface geometry 772 is alike to base surface geometry 772. Transition geometry 776 therefore includes some inter-strut gaps corresponding to inter-strut gaps of base strut geometry 771 and some ribbons corresponding to ribbons of base surface geometry 772. At any position within transition geometry 776 that corresponds to a position occupied by a ribbon in base surface geometry 772, whether an inter-strut gap or a ribbon exists in transition geometry 776 depends on a relative proximity of the position to first unit cell 773 and second unit cell 774 as well as a size of an inter-strut gap at a corresponding position within base strut geometry 771. At the side of transition geometry 776 that adjoins base surface geometry 772, transition geometry 776 includes no inter-strut gap at any position corresponding to a position within base surface geometry 772 occupied by a ribbon. Likewise, at the side of transition geometry 776 that adjoins base strut geometry 771, transition geometry 776 includes no ribbon at any position corresponding to a position within base strut geometry 771 occupied by an inter-strut gap. Between the sides adjoining base strut geometry 771 and base surface geometry 772, transition geometry 776 includes only relatively small ribbons near base strut geometry 771 and gradually larger ribbons with increasing proximity to base surface geometry 772. Thus, the maximum size of inter-strut gaps in transition geometry 776 at positions corresponding to positions occupied by ribbons in base surface geometry 772 increases gradually with increasing proximity to base strut geometry 771. Transition geometry 776 thereby blends base strut geometry 771 and base surface geometry 772. Transition region 755 of compound lattice 761 illustrated in FIG. 8A can include transition unit cells that blend the base geometry of unit cells of first lattice 731 with the base geometry of unit cells of second lattice 741 in a similar manner.

In some embodiments, a lattice can be populated with unit cells having a base geometry of a structure of struts and nodes, wherein some of the struts have a different effective diameter than at least one other strut in the structure. In some embodiments, the struts having various effective diameters within the base geometry can be arranged such that the unit cell imparts a greater effective anisotropy with respect to lattice shear modulus in a lattice populated by the unit cell on a given plane that the lattice would have if every strut in the base geometry had an equal effective diameter while the base geometry remained otherwise the same. In some embodiments, the base geometry can be a base geometry that would make the lattice populated by unit cells having the base geometry anisotropic with respect to lattice shear modulus in the same direction but by a lesser magnitude on the given plane if the base geometry were altered such that all struts in the base geometry had an equal effective diameter while the base geometry remained otherwise the same.

With respect to at least multi-diameter unit cell 822, description of any strut as being "connected to" a node or "directly connected to" a node means the relevant strut is directly connected to the node. Any two struts within multi-diameter unit cell 822 described as "connected to" one another adjoin the same node. Any two nodes within multi-diameter unit cell 822 described as "connected to" one another are both connected to a same strut. Nodes of multi-diameter unit cell 822 that extend into more than one quadrant 830, 840 of multi-diameter unit cell 822 are described herein as being included in each quadrant 830, 840 into which they extend. Thus, nodes described as being included by or within a quadrant 830, 840 of multi-diameter unit cell 822 may extend into other quadrants 830, 840 or outside of multi-diameter unit cell 822 unless stated otherwise (i.e., described as being "contained entirely within" a specific quadrant or similar terms).

Figure 11A:
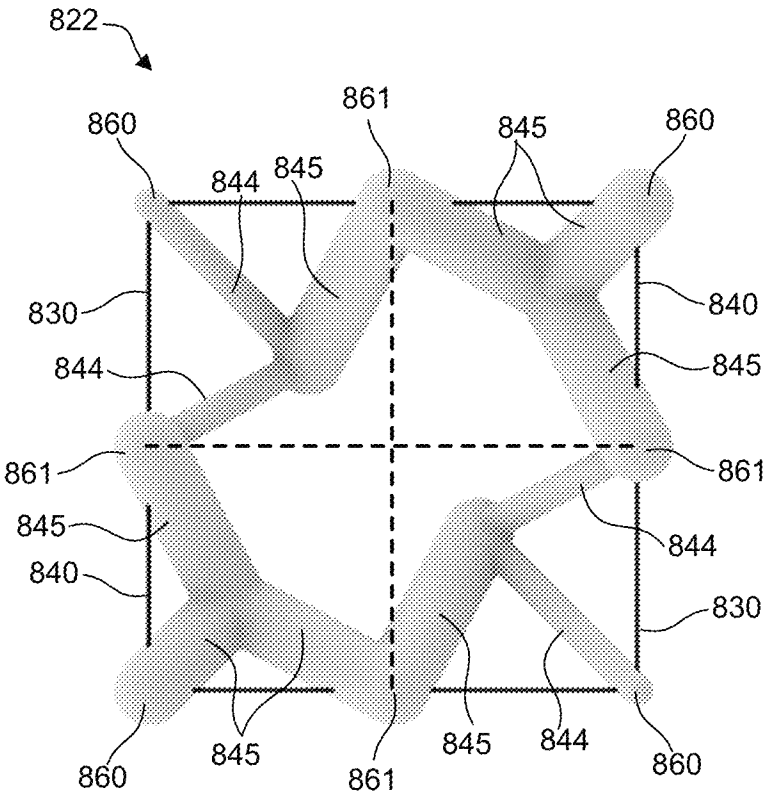
FIG. 11A is a side view of a multi-diameter unit cell according to some embodiments.

FIG. 11A illustrates a multi-diameter unit cell 822. Multi-diameter unit cell 822 can be alike to unit cell 405 illustrated and described above except where specifically illustrated or stated below. Thus, multi-diameter unit cell 822 has eight cubic sub-cells divided across four quadrants. The four quadrants include two soft quadrants 830 and two stiff quadrants 840. Each of the quadrants 830, 840 includes two sub-cells defining one eighth of multi-diameter unit cell 822 in the same manner that each quadrant 420, 422, 424, 426 of unit cell 405 includes two sub-cells defining one eighth of unit cell 405. From the perspective of FIG. 11A, multi-diameter unit cell 822 includes an upper left soft quadrant 830, which can be an upper-forward quadrant within a lattice of multi-diameter unit cells 822 in a shoe midsole, and a lower right soft quadrant 840, which can be a lower-rearward quadrant within a lattice of multi-diameter unit cells 822 in a shoe midsole. Also from the perspective of FIG. 11A, multi-diameter unit cell 822 includes an upper right stiff quadrant 840, which can be an upper-rearward quadrant within a lattice of multi-diameter unit cells 822 in a shoe midsole, and a lower left stiff quadrant 840, which can be a lower-forward quadrant within a lattice of multi-diameter unit cells 822 in a shoe midsole.

Each soft quadrant 830 includes two soft sub-cells among the eight sub-cells that make up multi-diameter unit cell 822 and each stiff quadrant 840 includes two stiff sub-cells among the eight sub-cells that make up multi-diameter unit cell 822. The sub-cells within each quadrant 830, 840 are symmetrical across a plane of symmetry that bisects multi-diameter unit cell 822 and extends parallel to the plane on which FIG. 11A is projected such that the properties illustrated in FIG. 11A and described below for each strut and node shown in FIG. 11A are equally true for another strut or node at the same vertical and front-to-back position on an opposite side of multi-diameter unit cell 822. With respect to multi-diameter unit cell 822 or portions thereof, all planes of symmetry described herein are planes relative to which the structure of struts and nodes within unit cell 822 or the relevant portion thereof are symmetrical with respect to both position and thickness.

Unit cells described above with respect to other aspects of the present disclosure can be multi-diameter unit cells 822. For example, either or both of second unit cell 640 and strut unit cell 719 can be multi-diameter unit cell 822. Any concept, structure, or product that can include unit cell 405 can additionally or instead include multi-diameter unit cell 822 in the same place. Thus, in any concept, structure, or product mentioned herein as including unit cell 405 can include multi-diameter unit cell 822 instead of unit cell 405.

The use of the terms "soft quadrant" and "stiff quadrant" as used with respect to quadrants 830 and 840 of multi-diameter unit cells 822 refers to the same properties described above with respect to soft sub-cells and stiff sub-cells in unit cell 405. Accordingly, each soft quadrant 830 is defined by a geometry of thin struts 844 and thick struts 845 that has (i) a modeled compressive modulus that is less than a modeled compressive modulus of a different geometry of thin struts 844 and thick struts 845 that defines each stiff quadrant 840, (ii) a modeled shear modulus that is less than a modeled shear modulus of the different geometry of thin struts 844 and thick struts 845 that defines each stiff quadrant 840, or (iii) both.

Multi-diameter unit cell 822 includes thin struts 844 and thick struts 845. Each soft quadrant 830 includes a geometry formed by an arrangement of thin struts 844 and thick struts 845 and each stiff quadrant 840 includes a geometry formed by an arrangement of thin struts 844 and thick struts 845. The geometry in each soft quadrant 830 differs from the geometry in each stiff quadrant 840.

Thick struts 845 have a greater effective diameter along their length than thin struts 844. As used herein, the term "effective diameter" describes the diameter or size of a strut, but this term should not be interpreted as requiring a strut to have a circular shape. Instead, struts can have non-circular cross-sectional shapes, and in such embodiments, the term "effective diameter" is intended to refer to the maximum cross-sectional dimension of the cross-sectional shape. For example, the effective diameter of a strut having a square cross-sectional shape would be the diagonal dimension across the square. As another example, the effective diameter of a strut having an oval cross-sectional shape would be the length of the oval-shape's major axis. For a strut having an effective diameter that varies along the length of the strut (e.g., an hourglass shape), the effective diameter is the smallest effective diameter.

A ratio of the effective diameter of each thin strut 844 along its length to the effective diameter of each thick strut 845 along its length can be equal to or about 0.6, which can also be expressed as equal to or about 3:5. In other embodiments, a ratio of the effective diameter of each thin strut 844 along its length to the effective diameter of each thick strut 845 along its length can be equal to or about 0.8, which can also be expressed as equal to or about 4:5. In further embodiments, the ratio of the effective diameter of each thin strut 844 along its length to the effective diameter of each thick strut 845 can be less than or equal to 0.95, greater than or equal to 0.6, or within a range of 0.6 through 0.95.

In further embodiments which can be according to any of the foregoing, the dimensions of the thin struts 844 and thick struts 845 can be such that multi-diameter unit cell 822 has a relative density of equal to or about 15%. In other words, equal to or about 15% of the volume of the multi-diameter unit cell 822 can be occupied by solid material, while the remainder of multi-diameter unit cell 822 is empty. In some embodiments, the dimensions of the thin struts 844 and thick struts 845 can be such that multi-diameter unit cell 822 has a relative density of greater than or equal to 6% to less than or equal to 20%.

Multi-diameter unit cell 822 is defined in a cubic space. A multi-diameter lattice 841 can be populated by multi-diameter unit cells 822 with the respective cubic spaces arranged adjacent one another as shown in FIG. 11C. Multi-diameter unit cell 822 includes eight corner nodes 860. Each corner node 860 is located at a corner of the cubic space within which multi-diameter unit cell 822 is defined. With respect to multi-diameter unit cell 822, a corner of the cubic space refers to a point where three of the six planar faces of the cubic space meet. Each corner node 860 connects a strut within multi-diameter unit cell 822 to another strut in a neighboring cell. In each soft quadrant 830, each strut that connects directly to a corner node 860 is a thin strut 844. In each stiff quadrant 840, each strut that connects directly to a corner node 860 is a thick strut 845.

Multi-diameter unit cell 822 is defined within a cubic space having eight corners. Each quadrant 830, 840 includes two corner nodes 860, and each corner node 860 is located at a respective one of the eight corners. Each corner node 860 in each soft quadrant 830 is connected directly to a respective thin strut 844 in the same quadrant 830. Thus, in the illustrated embodiment, an upper-forward quadrant 830 and a lower-rearward quadrant 830 each include two corner nodes 860, and each corner node 860 in the upper-forward and lower-rearward quadrants 830 is connected directly to a respective thin strut 844 in the same quadrant. Each corner node 860 in each stiff quadrant 840 is connected directly to a respective thick strut 845 in the same thick quadrant 845. Thus, in the illustrated embodiment, an upper-rearward quadrant 840 and a lower-forward quadrant 840 each include two corner nodes 860, and each corner node 860 in the upper-rearward and lower-forward quadrants 840 is connected directly to a respective thick strut 845 in the same quadrant 840.

In each soft quadrant 830, each thin strut 844 connected directly to a corner node 860 is connected by another node to one thick strut 845 and two thin struts 844. In each stiff quadrant 840, each thick strut 845 connected directly to a corner node 860 is connected by another node to one thin struts 844 and two thick struts 845.

Multi-diameter unit cell 822 includes eight boundary edge nodes 861. Each boundary edge node 861 is located on an edge of the cubic space within which multi-diameter unit cell 822 is defined and at a boundary between a soft quadrant 830 and a stiff quadrant 840. Thus, each boundary edge node 861 is shared by two adjacent quadrants 830, 840 of multi-diameter unit cell 822. With respect to multi-diameter unit cell 822, an edge of the cubic space refers to a line along which two of the six planar faces of the cubic space meet. Each boundary edge node 861 connects struts within multi-diameter unit cell 822 to at least one strut in a neighboring cell. In each stiff quadrant 840, each strut that connects directly to a boundary edge node 861 is a thick strut 845. Thus, each stiff quadrant 840 includes a geometry wherein a thick strut 845 connects directly to each boundary edge node 861 that extends into the stiff quadrant 840 and no thin struts 844 connect directly to any boundary edge node 861 that extends into the soft quadrant.

In each soft quadrant 830, each strut that connects directly to a boundary edge node 861 shared with a vertically adjacent stiff quadrant 840, meaning a stiff quadrant 840 above or below the relevant soft quadrant 830 from the perspective of FIG. 11A, is a thin strut 844. In each soft quadrant 830, each strut that connects directly to a boundary edge node 861 shared with a horizontally adjacent stiff quadrant 840, meaning a stiff quadrant 840 left, right, forward, or rearward of the relevant stiff quadrant 840 from the perspective of FIG. 11A, is a thick strut 845. Thus, in the illustrated embodiment, each soft quadrant 830 includes a geometry wherein two thin struts 844 that connect to respective boundary edge nodes 861 that extend into the soft quadrant 830 and two thick struts 845 that connect to respective boundary edge nodes 861 that extend into the soft quadrant 830.

Figure 11B:
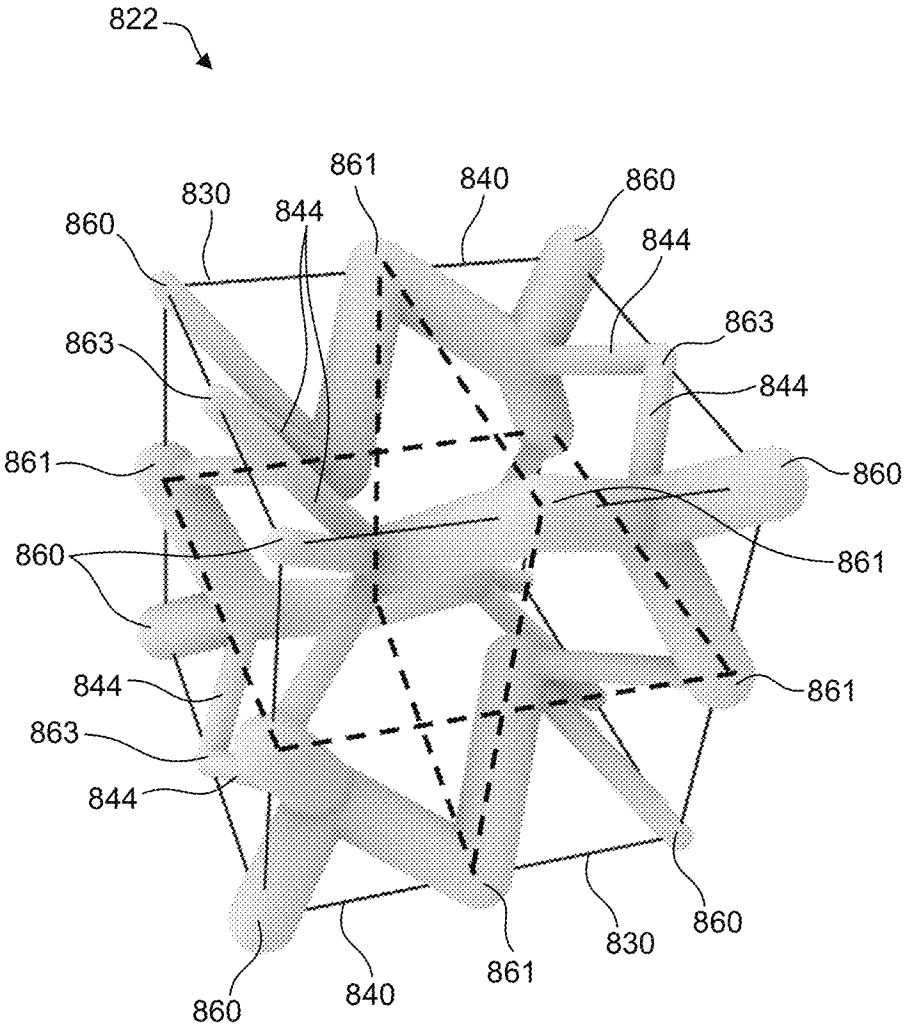
FIG. 11B is a perspective view of the multi-diameter unit cell of FIG. 11A.
Figure 11C:
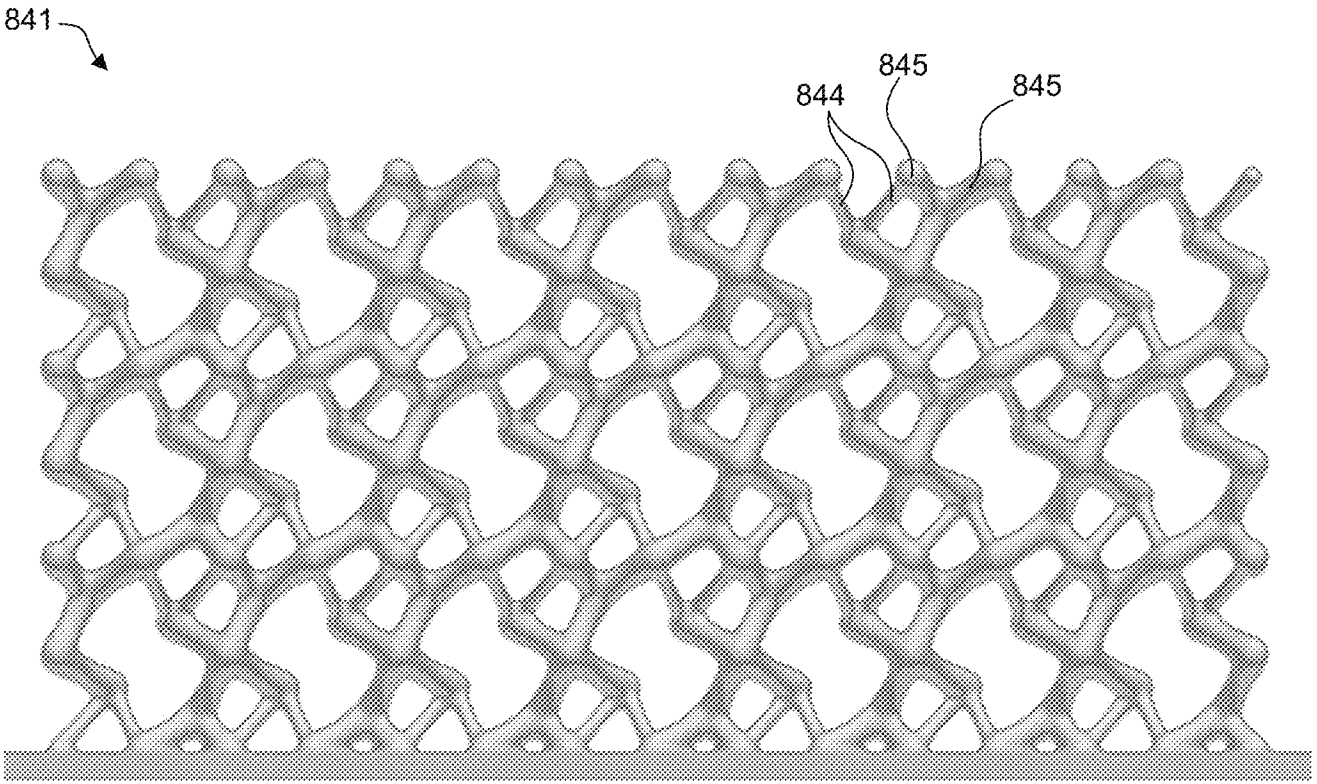
FIG. 11C is a lattice populated by multi-diameter unit cells of FIG. 11A.

As shown in FIG. 11B, multi-diameter unit cell 822 includes four internal edge nodes 863. Each internal edge node 863 is located on an edge of the cubic space within which multi-diameter unit cell 822 is defined and at the boundary of two sub-cells within one of the quadrant 830, 840. That is, each internal edge node 863 is located at the boundary between two sub-cells within either a soft quadrant 830 or a stiff quadrant 840 of multi-diameter unit cell 822. Thus, each internal edge node 863 is located on a plane that bisects all four quadrants 830, 840 of multi-diameter unit cell 822. In some embodiments, every strut in multi-diameter unit cell 822 that connects directly to an internal edge node 863 can be a thin strut 844. Thus, each internal edge node 863 in the illustrated example is directly connected to two thin struts 844 in each quadrant 830, 840 that includes any part of internal edge node 863. In some embodiments, including the illustrated embodiment, no internal edge node 863 is directly connected to any thick strut 845.

In view of the above described arrangements of thin struts 844 and thick struts 845 in stiff quadrants 840, both stiff quadrants 840 are symmetrical about a plane that contains all four corners of the cubic space in which multi-diameter unit cell 822 is defined that are within the stiff quadrants 840. By contrast, neither soft quadrant 830 is symmetrical about a plane that contains all four corners of the cubic space in which multi-diameter unit cell 822 is defined that are within the stiff quadrants 840 because each sub-cell in each soft quadrant 840 includes one thin strut 844 that connects directly to a boundary edge node 861 and one thick strut 845 that connects directly to another boundary edge node 861. The soft quadrants 830 therefore have one less plane of symmetry than the stiff quadrants 830. Specifically, stiff quadrants 840 are both symmetrical about a first plane that contains four corners of the cubic space within which multi-diameter unit cell 822 is defined and bisects both stiff quadrants 840. However, soft quadrants 830 are asymmetrical about a second plane that extends normal to the first plane, contains four corners of the cubic space within which multi-diameter unit cell 822 is defined, and bisects both soft quadrants 830. However, soft quadrants 830 of the illustrated embodiment are symmetrical about the second plane except that each soft quadrant 830 includes thin struts 844 connecting directly to boundary edge nodes 861 on one side of the second plane and thick struts 845 connecting directly to boundary edge nodes 861 on the other side of the second plane. However, soft quadrants 830 in other embodiments can include more asymmetries. Thus, in the illustrated embodiment, stiff quadrants 840 have one more plane of symmetry than soft quadrants 830 because all struts directly connected to boundary edge nodes 861 in stiff quadrants 830 are thick struts 845. As a result, stiff quadrants 840 are symmetrical with respect to the first plane whereas soft quadrants 830 are asymmetrical with respect to the second plane. Further, soft quadrants 830 and stiff quadrants 840 in the illustrated embodiment include equal total numbers of struts, but stiff quadrants 840 include more thick struts 845 than soft quadrants 830 include and soft quadrants 830 include more thin struts 844 than stiff quadrants 840 include. However, in other embodiments, soft quadrants 830 can include different total numbers of struts than stiff quadrants 840, soft quadrants 830 can include more thick struts 845 than stiff quadrants 840 include, and stiff quadrants 840 can include more thin struts 844 than soft quadrants 830 include.

Multi-diameter unit cell 822 can result in improved mechanical characteristics for some purposes compared to otherwise identical unit cells having struts of only one effective diameter. Such multi-diameter unit cells 822 may have the improved mechanical characteristics while weighing the same as or less than the otherwise identical unit cells having struts of only one effective diameter. For example, multi-diameter unit cells 822 in some embodiments can weigh at least 10% less than functionally comparable unit cells with similar base geometries and struts of only one diameter. The differentiated strut diameters can also improve durability of the lattice. In some embodiments, a lattice populated by the multi-diameter unit cells 822 can have a lower lattice shear modulus in a forward direction compared to the lattice shear modulus of a lattice populated by unit cells with the same base geometry and only thick struts 845 (i.e., single-diameter unit cells). In some embodiments, the lower lattice shear modulus can be between 5% and 20% less than the lattice shear modulus of a lattice populated by the single-diameter unit cells. In some embodiments, the lower lattice shear modulus can be between 5% and 15% less than the lattice shear modulus of a lattice populated by the single-diameter unit cells. In some embodiments, the lower lattice shear modulus can be about 10% less than the lattice shear modulus of a lattice populated by the single-diameter unit cells. In embodiments, a lattice populated by the multi-diameter unit cells 822 can achieve such a lower lattice shear modulus in the forward direction while retaining about the same lattice compressive modulus. For example, a lattice populated by the multi-diameter unit cells 822 can have a lattice compressive modulus that is equal to the lattice compressive modulus of a lattice populated by the single-diameter unit cells +/−5%. As another example, a lattice populated by the multi-diameter unit cells 822 can have a lattice compressive modulus that is equal to the lattice compressive modulus of a lattice populated by the single-diameter unit cells +/−2%.

In multi-diameter unit cell 822, struts are selected to be thin struts 844 or thick struts 845 to promote motion in a certain direction. For example, where a shoe midsole includes a lattice populated with multi-diameter unit cells 822 such that the left side of multi-diameter unit cell 822 from the perspective of FIG. 11A is nearer the toe portion of the midsole, struts that resist forward deformation are thin struts 844 and struts that resist backward deformation are thick struts 845. More generally, for a lattice populated by multi-diameter unit cells 822, the relative locations of thin struts 844 and thick struts 845 increase a difference between a lattice shear modulus to the left and lattice shear modulus to the right.

From the perspective of FIG. 11A, multi-diameter unit cell 822 resists deformation that includes moving the top end of multi-diameter unit cell 822 to the left while the lower end of multi-diameter unit cell 822 remains stationary less than multi-diameter unit cell 822 resists deformation that includes moving the top end of multi-diameter unit cell 822 to the right while the lower end of multi-diameter unit cell 822 remains stationary. That difference in resistance is greater for multi-diameter unit cell 822 than for a unit cell that has only struts of equal diameter but is otherwise identical to multi-diameter unit cell 822. Accordingly, a lattice populated by multi-diameter unit cell 822 is effectively anisotropic with respect to lattice shear modulus, and the difference in effective diameter between thin struts 844 and thick struts 845 increases the degree to which the lattice populated by multi-diameter unit cell 822 is effectively anisotropic with respect to lattice shear modulus. This anisotropy promoting nature of the multi-diameter unit cell 822 contributes to a difference between a relatively large backward lattice shear modulus and a relatively small forward lattice shear modulus of a lattice, such as an additively manufactured shoe midsole, populated by multi-diameter unit cells 822.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed. Finally, when the term "about" is used in describing a value or an end-point of a range, the disclosure should be understood to include the specific value or end-point referred to. Whether or not a numerical value or end-point of a range recites "about," the numerical value or end-point of a range is intended to include two embodiments: one modified by "about," and one not modified by "about."

As used herein, the term "about" refers to a value that is within +10% of the value stated. For example, about 10% can include any percentage between 9% and 11%.

The terms "comprising," "comprises," "including," and "includes" are open-ended transitional phrases. A list of elements following the transitional phrase "comprising," "comprises," "including," and "includes" is a non-exclusive list, such that elements in addition to those specifically recited in the list can also be present.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A midsole for an article of footwear, the midsole comprising:

a three-dimensional mesh comprising:

a first lattice comprising a plurality of interconnected first unit cells, each interconnected first unit cell comprising a first base strut geometry defined by a first plurality of struts and a first plurality of nodes at which one or more struts are connected;

a second lattice comprising a plurality of interconnected second unit cells outside of the plurality of interconnected first unit cells, each interconnected second unit cell comprising a second base strut geometry different than the first base strut geometry and defined by a second plurality of struts and a second plurality of nodes at which one or more struts are connected;

a transition region located between the plurality of interconnected first unit cells and the plurality of interconnected second unit cells and comprising a third plurality of struts connecting nodes among the first plurality of nodes to nodes among the second plurality of nodes, wherein the transition region does not contain any instance of the first base strut geometry or any instance of the second base strut geometry;

a ground facing side defined by the three-dimensional mesh; and a skin that covers at least a portion of an exterior of the first lattice and a portion of an exterior of the second lattice, wherein:

the skin comprises a plurality of skin cells that comprise skin struts and skin nodes and that differ in strut geometry from the first unit cells and second unit cells, the skin comprises a lower edge that defines a portion of a border of the ground facing side, and the plurality of unit cells of the skin extends upward from the lower edge of the skin to an upper end of the midsole.

2. The midsole of claim 1, wherein the struts of the first plurality of struts are aligned on edges of polygons of a polygon mesh of an implicit surface and contact struts of the plurality of struts in at least one neighboring second unit cells.

3. The midsole of claim 1, wherein:

each second unit cell comprises:

an upper-forward quadrant and a lower-rearward quadrant, each of which contains thin struts and thick struts among the second plurality of struts and nodes among the second plurality of nodes; and an upper-rearward quadrant and a lower-forward quadrant, each of which contains thin struts and thick struts among the second plurality of struts and nodes among the second plurality of nodes, wherein the thick struts and thin struts in the upper-forward and lower-rearward quadrants are arranged differently than in the upper-rearward and lower-forward quadrants.

4. The midsole of claim 1, wherein the plurality of interconnected first unit cells surrounds the plurality of interconnected second unit cells on at least one plane.

5. The midsole of claim 1, wherein the transition region comprises a plurality of third unit cells, wherein each third unit cell comprises:

a first side and a second side, the first side being adjoined by one of the first unit cells and the second side being adjoined by one of the second unit cells;

a first segment that comprises the first side and is identical in structure to a segment of the adjoining first unit cell;

a second segment that comprises the second side and is identical in structure to a segment of the adjoining second unit cell and is different in structure than the first segment.

6. The midsole of claim 5, wherein each third unit cell comprises a third segment that is located between the first segment and the second segment, comprises every part of the third unit cell other than the first segment and second segment, and is not identical to any portion of the first base strut geometry having equal volume to the third segment or the second base strut geometry having equal volume to the third segment.

7. The midsole of claim 5, wherein the first segment and second segment are each a respective quarter of the third unit cell.

8. The midsole of claim 5, wherein each third unit cell comprises a third segment that comprises a third plurality of nodes, and each node of the third plurality of nodes is located at a position within the third unit cell that is a mean average of a position of a node of the first plurality of nodes within the first unit cell and a position of a node of the second plurality of nodes within the second unit cell.

9. The midsole of claim 1, wherein the skin comprises beams extending continuously across multiple of the skin cells.

10. A midsole for an article of footwear, the midsole comprising:

a three-dimensional mesh comprising:

a first lattice comprising a plurality of interconnected first unit cells, each interconnected first unit cell comprising a base surface geometry that comprises a solid representation of a periodic implicit surface that contacts solid representations of the implicit surface in at least two neighboring first unit cells, wherein the base surface geometry comprises ribbons and the ribbons comprise edges located at a respective position within the base surface geometry; and a second lattice comprising a plurality of interconnected second unit cells outside of the plurality of interconnected first unit cells, each interconnected second unit cell comprising a base strut geometry comprising a plurality of struts and a plurality of nodes at which one or more struts are connected, wherein the base strut geometry comprises multiple struts that are each located at a respective position within the base strut geometry that is the same as the position of a respective one of the edges within the base surface geometry; and a transition region located between the plurality of interconnected first unit cells and the plurality of interconnected second unit cells and comprising a third plurality of struts connecting some of the solid representations of the implicit surface to some of the nodes among the plurality of nodes, wherein the transition region does not contain any instance of the base surface geometry or any instance of the base strut geometry.

11. The midsole of claim 10, wherein the plurality of interconnected second unit cells forms a lattice having a first lattice shear modulus in a first direction and a second lattice shear modulus in a second direction opposite the first direction, and wherein the first lattice shear modulus is at least 10% greater than the second lattice shear modulus.

12. The midsole of claim 11, wherein each second unit cell comprises:

an upper-forward quadrant and a lower-rearward quadrant, each of which contains thin struts and thick struts among the plurality of struts and nodes among the plurality of nodes arranged in a first geometry; and an upper-rearward quadrant and a lower-forward quadrant, each of which contains thin struts, thick struts, and nodes among the plurality of nodes arranged in a second geometry, wherein the thick struts and thin struts are arranged differently in the first geometry than in the second geometry.

13. The midsole of claim 10, wherein the transition region comprises a plurality of third unit cells, wherein each third unit cell comprises:

a first side and a second side, the first side being adjoined by one of the first unit cells and the second side being adjoined by one of the second unit cells;

a first segment that comprises the first side and is identical in structure to a segment of the adjoining first unit cell that comprises a side of the first unit cell;

a second segment that comprises the second side and is identical in structure to a segment of the adjoining second unit cell that comprises a side of the second unit cell.

14. The midsole of claim 13, wherein each third unit cell comprises a third segment that is located between the first segment and the second segment, comprises every part of the third unit cell other than the first segment and second segment, and is not identical to any portion of the base surface geometry having equal volume to the third segment or the base strut geometry having equal volume to the third segment.

15. The midsole of claim 14, wherein the third segment comprises a transition geometry, and the transition geometry includes first structures identical to portions of the base surface geometry and second structures identical to portions of the base strut geometry.

16. The midsole of claim 15, wherein the first structures are ribbons and the second structures are struts and inter-strut gaps.

17. The midsole of claim 10, wherein each of the ribbons comprises a surface defined between the ribbon's edges, each surface has a surface location within the base surface geometry, and a gap between two struts exists at each location within the base strut geometry that is the same as one of the surface locations within the base surface geometry.

18. A sole for an article of footwear, the sole comprising:

a midsole comprising:

a three-dimensional lattice comprising a plurality of interconnected unit cells, wherein the three-dimensional lattice comprises a medial side and a lateral side;

a skin that covers at least a portion of an exterior of the three-dimensional lattice and includes a plurality of skin cells that differ in geometry from the unit cells, wherein the skin covers a portion of the medial side and a portion of the lateral side of the three-dimensional lattice; and a ground facing side defined by the three-dimensional lattice, wherein a lower edge of the skin defines a portion of a border of the ground facing side, and wherein the plurality of unit cells of the skin extends upward from the lower edge of the skin to an upper end of the midsole; and an outsole attached to the ground facing side of the midsole.

19. The sole of claim 18, wherein each unit cell comprises:

a plurality of struts defining a three-dimensional shape and a plurality of nodes at which two or more struts are connected;

an upper-forward quadrant and a lower-rearward quadrant, each of which contains struts among the plurality of struts and nodes among the plurality of nodes arranged in a first geometry; and an upper-rearward quadrant and a lower-forward quadrant, each of which contains struts among the plurality of struts and nodes among the plurality of nodes arranged in a second geometry that differs from the first geometry.

20. The sole of claim 19, wherein the plurality of struts comprises thin struts, each of which has a first effective diameter along its length, and a plurality of thick struts, each of which has a second effective diameter along its length, the second effective diameter being greater than the first effective diameter.

21. The sole of claim 19, wherein the skin comprises beams that extend across multiple of the skin cells.

22. The sole of claim 21, wherein the skin includes a convergence line extending up a heel portion of the midsole, wherein a first group of the beams extend along the medial side of the lattice to the convergence line and a second group of the beams extend along the lateral side of the lattice to the convergence line, and the beams of the first group of beams meet the beams of the second group of beams at the convergence line.

23. The sole of claim 18, wherein the skin is absent from the ground facing side such that the three-dimensional lattice is exposed on the ground facing side.

24. The sole of claim 18, wherein the outsole is attached directly to the three-dimensional lattice.

* * * * *